US012774141B2

(12) United States Patent
Gilligan et al.

(10) Patent No.: US 12,774,141 B2
(45) Date of Patent: Oct. 27, 2026

(54) BEVERAGE CONTAINER PACKAGING

(71) Applicant: Acorn West LLC, Los Angeles, CA (US)

(72) Inventors: John Gilligan, Santa Barbara, CA (US); Ron Valtierra, Vacaville, CA (US); Gord Heyting, Toronto (CA); Chris Russell, Brough (GB); Justin Haas, Fairfield, CA (US)

(73) Assignee: Acorn West LLC, Los Angeles, CA (US)

( * ) Notice: Subject to any disclaimer, the term of this patent is extended or adjusted under 35 U.S.C. 154(b) by 235 days.

(21) Appl. No.: 17/993,822

(22) Filed: Nov. 23, 2022

(65) Prior Publication Data

US 2023/0091646 A1 Mar. 23, 2023

Related U.S. Application Data

(63) Continuation-in-part of application No. 17/581,431, filed on Jan. 21, 2022, now Pat. No. 11,713,173, (Continued)

(51) Int. Cl.
*B65D 71/70* (2006.01)
*B65D 1/24* (2006.01)

(Continued)

(52) U.S. Cl.
CPC ..... *B65D 71/70* (2013.01); *B65D 1/243* (2013.01); *B65D 1/36* (2013.01); *B65D 25/108* (2013.01);

(Continued)

(58) Field of Classification Search
CPC ..... B65D 71/70; B65D 1/36; B65D 1/243; B65D 5/5028; B65D 25/108;

(Continued)

(56) References Cited

U.S. PATENT DOCUMENTS 1,310,161 A 7/1919 Johnson
1,892,170 A * 12/1932 Sneed, Jr. ..... B65D 85/305 217/19

(Continued)

FOREIGN PATENT DOCUMENTS

BE 882835 A 8/1980
GB 2328934 A 3/1999

(Continued)

OTHER PUBLICATIONS

Non-Final Rejection dated Mar. 21, 2024, directed to U.S. Appl. No. 18/143,697; 7 pages.

(Continued)

*Primary Examiner* — Don M Anderson
*Assistant Examiner* — Jennifer Castriotta
(74) *Attorney, Agent, or Firm* — Michele V. Frank; Venable LLP

(57) ABSTRACT

A beverage container packing assembly includes a bottom tray, center support, and a top tray. The bottom tray defines first compartments. The first compartments receive a first portion of a beverage container. The bottom tray includes one or more first support columns. The center support defines through holes. Each of the through holes is configured to receive a second portion of a beverage container. The center support is configured to accommodate a thermo pack. The top tray defines second compartments. Each of the second compartments is configured to receive a third portion of a beverage container. The top tray is configured to accommodate the thermo pack between a first row and a second row of the second compartments.

12 Claims, 29 Drawing Sheets

Related U.S. Application Data which is a continuation of application No. 17/098,190, filed on Nov. 13, 2020, now Pat. No. 11,261,015.

(60) Provisional application No. 63/282,980, filed on Nov. 24, 2021, provisional application No. 63/011,705, filed on Apr. 17, 2020, provisional application No. 62/934,708, filed on Nov. 13, 2019.

(51) Int. Cl.

| | |
|---|---|
| ***B65D 1/36*** | (2006.01) |
| ***B65D 5/50*** | (2006.01) |
| ***B65D 25/10*** | (2006.01) |
| ***B65D 81/18*** | (2006.01) |
| ***B65D 85/30*** | (2006.01) |
| ***F25D 3/08*** | (2006.01) |

(52) U.S. Cl.

CPC ..... *B65D 81/18* (2013.01); *B65D 85/305* (2013.01); *F25D 3/08* (2013.01); *B65D 5/5028* (2013.01); *F25D 2331/812* (2013.01)

(58) Field of Classification Search

CPC .... B65D 81/133; B65D 81/18; B65D 85/305; F25D 2331/803; F25D 3/08; F25D 2331/805

USPC ..... 206/433, 427, 561, 139–203; 220/512, 220/513, 509

See application file for complete search history.

(56) References Cited

U.S. PATENT DOCUMENTS 1,907,606 A * 5/1933 Stoddard ..... F25D 3/06 217/19
1,908,389 A 5/1933 White
1,919,427 A * 7/1933 Foreman ..... B65D 9/34 217/66
1,960,279 A 5/1934 Read
1,977,160 A 10/1934 White
2,003,134 A 5/1935 Bowman
2,024,648 A 12/1935 Kissling
2,050,143 A 8/1936 White
2,189,410 A 2/1940 Stute
2,222,572 A 11/1940 Reger
2,393,245 A 1/1946 Hadsell
2,609,670 A 9/1952 Wheeler et al.
2,807,402 A 9/1957 Nelbach
2,973,119 A 2/1961 Parker
2,979,227 A 4/1961 Taber et al.
3,023,885 A 3/1962 Kindseth
3,038,625 A 6/1962 Sinner et al.
3,039,667 A 6/1962 Kozlik
3,368,709 A 2/1968 Waller
3,421,679 A 1/1969 Goldman
3,643,812 A * 2/1972 Mander ..... B01L 9/06 220/519
3,802,220 A 4/1974 Pompo
3,930,579 A 1/1976 Kurtz
4,037,722 A 7/1977 Bremer
4,088,259 A 5/1978 Sutton
4,213,310 A * 7/1980 Buss ..... F25D 3/08 206/544
4,266,407 A 5/1981 Gibson
4,292,817 A 10/1981 Loucks
4,344,300 A 8/1982 Taylor
4,499,997 A 2/1985 Swingley, Jr.
4,554,798 A 11/1985 D'Amour et al.
4,560,064 A 12/1985 Peterson et al.
4,580,412 A 4/1986 Wells
4,607,502 A 8/1986 Tomac
4,793,548 A 12/1988 Ross
4,819,793 A 4/1989 Willard et al.
4,911,300 A 3/1990 Colonna
4,932,548 A 6/1990 Bensinger
4,947,658 A 8/1990 Wheeler et al.
5,071,026 A 12/1991 Apps
5,096,085 A 3/1992 Eek et al.
5,201,421 A 4/1993 Maier
5,215,195 A 6/1993 Williams
5,335,770 A 8/1994 Baker et al.
5,377,862 A 1/1995 Oakes et al.
5,427,222 A 6/1995 Miura et al.
5,501,352 A 3/1996 Apps
5,582,343 A 12/1996 Dalvey
5,816,409 A 10/1998 Baker et al.
5,913,444 A 6/1999 Steiner
5,950,829 A 9/1999 Gale
5,975,300 A 11/1999 Gale
6,290,057 B1 9/2001 Hurley
6,325,210 B1 12/2001 Henry, Jr.
6,334,329 B1 1/2002 Weller
6,336,556 B1 1/2002 Gale
6,598,419 B1 7/2003 Tago
6,702,115 B1 3/2004 Roper
6,820,743 B2 11/2004 Hurley et al.
6,910,582 B2 6/2005 Lantz
7,017,746 B2 3/2006 Apps
D561,025 S 2/2008 Gilfert
D561,588 S 2/2008 Gilfert
D590,715 S 4/2009 Gilfert
7,584,852 B2 9/2009 O'Brien et al.
7,743,626 B2 6/2010 Buckingham
7,789,239 B2 9/2010 Juliano
D631,352 S 1/2011 Gilfert
D632,960 S 2/2011 Gilfert
7,883,001 B2 2/2011 Goodrich
8,333,275 B2 12/2012 McFarlane et al.
8,434,620 B2 5/2013 Hall
8,607,984 B2 12/2013 Breton et al.
8,701,884 B2 4/2014 Williams et al.
8,844,718 B2 9/2014 Hall
8,887,916 B2 11/2014 Gilfert et al.
10,059,495 B1 8/2018 Korustan et al.
10,124,924 B2 11/2018 Gilligan et al.
10,281,188 B2 5/2019 Shew
10,507,950 B2 12/2019 Carrier et al.
10,619,905 B2 * 4/2020 Starling ..... F25D 3/06
10,696,441 B2 6/2020 Gilligan et al.
11,104,471 B2 8/2021 Gilligan et al.
11,261,015 B2 3/2022 Gilligan et al.
11,377,290 B2 * 7/2022 Morine ..... B65D 81/05
11,685,570 B2 6/2023 Gilligan et al.
11,713,173 B2 8/2023 Gilligan et al.
11,718,442 B2 8/2023 Gilligan et al.
11,801,966 B2 10/2023 De Blay
12,104,847 B1 10/2024 Hurley et al.
12,415,646 B2 9/2025 Gilligan et al.
2003/0070951 A1 4/2003 Hurley et al.
2004/0031711 A1 2/2004 O'Malley
2007/0138047 A1 6/2007 Berglin
2007/0277546 A1 * 12/2007 Lehman ..... F25D 3/08 62/457.2
2008/0184674 A1 8/2008 Hall et al.
2008/0302691 A1 12/2008 Olson et al.
2010/0112292 A1 5/2010 Gilfert
2010/0326858 A1 12/2010 Williams et al.
2011/0024318 A1 2/2011 Gilfert
2011/0030418 A1 2/2011 Starling
2012/0037529 A1 2/2012 Hall
2013/0068829 A1 3/2013 Dillon et al.
2013/0126384 A1 5/2013 Ogg
2013/0213854 A1 8/2013 Orgeldinger et al.
2013/0313145 A1 11/2013 Gilfert et al.
2014/0319018 A1 10/2014 Collison
2015/0129447 A1 5/2015 Tremblay
2015/0210457 A1 7/2015 DiMauro
2016/0290703 A1 10/2016 Allen
2017/0050757 A1 2/2017 Gray et al.
2017/0138664 A1 5/2017 Greenberg
2018/0037359 A1 2/2018 Gilligan et al.
2019/0100347 A1 4/2019 Carrier et al.
2019/0178571 A1 6/2019 Kelly

(56) References Cited

U.S. PATENT DOCUMENTS

| | | | | |
|---|---|---|---|---|
| 2020/0109888 | A1 | 4/2020 | Gosselin | |
| 2021/0018244 | A1 | 1/2021 | Diaz | |
| 2021/0139215 | A1 | 5/2021 | Gilligan et al. | |
| 2021/0354870 | A1 | 11/2021 | Gilligan et al. | |
| 2022/0127057 | A1* | 4/2022 | Ronning | B65D 5/5059 |
| 2023/0159255 | A1 | 5/2023 | Gilligan et al. | |
| 2023/0192348 | A1 | 6/2023 | Gilligan et al. | |
| 2023/0271742 | A1 | 8/2023 | Gilligan et al. | |

FOREIGN PATENT DOCUMENTS

| | | | |
|---|---|---|---|
| WO | 2008058346 | A1 | 5/2008 |
| WO | 2011073406 | A1 | 6/2011 |
| WO | 2015/049702 | A1 | 4/2015 |

OTHER PUBLICATIONS

Notice of Allowance dated Jun. 7, 2024, directed to U.S. Appl. No. 18/108,799; 5 pages.
Non-Final Rejection mailed Aug. 29, 2023, directed to U.S. Appl. No. 18/108,799; 7 pages.
Notice of Allowance mailed Nov. 3, 2023, directed to U.S. Appl. No. 18/108,799; 7 pages.
Defendants' Joint Answer, Affirmative Defenses, and Counterclaims to Plaintiff's Second Amended Complaint for Patent Infringement and Breach of Contract dated Oct. 12, 2022; 67 pages.
Notice of Allowance and Fee(s) Due mailed Feb. 16, 2023, directed to U.S. Appl. No. 17/321,195; 8 pages.
Notice of Allowance and Fee(s) Due dated Jun. 23, 2021, directed to U.S. Appl. No. 17/098,190; 10 pages.
Notice of Allowance and Fee(s) Due dated Oct. 8, 2021, directed to U.S. Appl. No. 17/098,190; 10 pages.
Non-Final Rejection mailed Apr. 4, 2022, directed to U.S. Appl. No. 17/581,431; 12 pages.
Notice of Allowance and Fee(s) Due mailed Aug. 3, 2022, directed to U.S. Appl. No. 17/581,431; 7 pages.
Corrected Notice of Allowability mailed Aug. 30, 2022, directed to U.S. Appl. No. 17/581,431; 4 pages.
Notice of Allowance and Fee(s) Due mailed Mar. 16, 2023, directed to U.S. Appl. No. 17/581,431; 8 pages.
Notice of Allowance dated Jul. 31, 2024, directed to U.S. Appl. No. 18/108,799.
Non-Final Rejection dated Oct. 18, 2024, directed to U.S. Appl. No. 17/993,818; 10 pages.
Final Rejection dated Nov. 14, 2024, directed to U.S. Appl. No. 18/143,697; 8 pages.
Notice of Allowance mailed Jan. 29, 2025, directed to U.S. Appl. No. 18/143,697; 8 pages.
Final Rejection dated Feb. 27, 2025, directed to U.S. Appl. No. 17/993,818; 12 pages.
Complaint for Patent Infringement, dated Dec. 20, 2018, Docket No. 1 in the US District Court, Central District of California—Western Division, Case No. 2:18-cv-10568.
Defendant's Answer to Complaint; Counterclaims; and Demand for Jury Trial, dated Jun. 7, 2019 , Docket No. 22 in the US District Court, Central District of California—Western Division, Case No. 2:18-cv-10568-CJC-SK.
Answer and Affirmative Defenses to Defendants; and Counterclaims and Demand for Jury Trial, dated Jun. 28, 2019 Docket No. 27 in the US District Court, Central District of California—Western Division, Case No. 2:18-cv-10568-CJC-SK.
Complaint for Patent Infringement, dated Jan. 15, 2021, U.S. District Court Eastern District of Washington, Case No. 2:21-cv-00036-1 with Exhibits A (U.S. Pat. No. 10,124,924) and B (U.S. Pat. No. 10,696,441) (97 pages).
Notice of Allowance and Fees Due dated Jul. 31, 2018, directed to U.S. Appl. No. 15/671,348; 13 pages.
Non-Final Office Action dated May 28, 2019, directed to U.S. Appl. No. 16/180,840; 19 pages.
Final Office Action dated Sep. 12, 2019, directed to U.S. Appl. No. 16/180,840; 21 pages.
Notice of Allowance and Fees Due dated Jan. 15, 2020, directed to U.S. Appl. No. 16/180,840; 8 pages.
Notice of Allowance and Fees Due dated Mar. 18, 2020, directed to U.S. Appl. No. 16/180,840; 8 pages.
Non-Final Office Action dated Aug. 26, 2020, directed to U.S. Appl. No. 16/884,922; 16 pages.
Non-Final Office Action dated Mar. 15, 2021, directed to U.S. Appl. No. 17/098,190; 15 pages.
Notice of Allowance dated Apr. 28, 2021, directed to U.S. Appl. No. 16/884,922; 7 pages.
Non-Final Office Action dated Aug. 11, 2021, directed to U.S. Appl. No. 17/321,195; 14 pages.
Complaint for Patent Infringement and Breach of Contract; Jury Trial Demanded, dated Sep. 30, 2021, United States District Court for the Central District of California; Case No. 2:21-cv-7821; 20 pages.
Defendants' Joint Answer, Affirmative Defenses, and Counterclaims to Plaintiff's Complaint; Demand for a Jury Trial dated Dec. 28, 2021; United States District Court for the Central District of California; Case No. 2:21-cv-07821-CJC-SK; 29 pages.
First Amended Complaint for Patent Infringement and Breach of Contract, Jury Trial Demanded dated Jan. 18, 2022; United States District Court for the Central District of California; Case No. 2:21-cv-07821-CJC-SK; 20 pages.
Defendants' Joint Answer, Affirmative Defenses, and Counterclaims to Plaintiff's First Amended Complaint for Patent Infringement and Breach of Contract; Demand for a Jury Trial dated Feb. 1, 2022; United States District Court for the Central District of California; Case No. 2:21-cv-07821-CJC-SK; 43 pages.
Plaintiff Acorn West LLC's Answer to Counterclaims and Affirmative Defenses; Jury Trial Demanded, dated Feb. 22, 2022; United States District Court for the Central District of California; Case No. 2:21-cv-07821-CJC-SK; 14 pages.
Notice of Allowance and Fee(s) Due dated Mar. 15, 2022, directed to U.S. Appl. No. 17/397,619; 7 pages.
Notice of Allowance and Fee(s) Due dated Mar. 31, 2022, directed to U.S. Appl. No. 17/321,195; 9 pages.
Notice of Allowance and Fee(s) Due dated Jun. 14, 2022, directed to U.S. Appl. No. 17/397,619; 5 pages.
Corrected Notice of Allowability dated Jun. 23, 2022, directed to U.S. Appl. No. 17/397,619; 2 pages.
Notice of Allowance and Fee(s) Due dated Jul. 6, 2022, directed to U.S. Appl. No. 17/321,195; 8 pages.
Notice of Motion to Amend First Amended Complaint; Memorandum of Points and Authorities in Support Thereof filed Sep. 7, 2022, United States District Court for the Central District of California, Case No. 2:21-cv-07821-CJC-SK; 10 pages.
Declaration of Sarah S. Brooks in Support of Plaintiff's Notice of Motion to Amend First Amended Complaint and Memorandum of Points and Authorities in Support Thereof filed Sep. 7, 2022, United States District Court for the Central District of California; 114 pages.
Notice of Allowance dated Oct. 7, 2025, directed to U.S. Appl. No. 18/143,697; 8 pages.
Non-Final Rejection dated Dec. 30, 2026, directed to U.S. Appl. No. 17/993,818; 11 pages.

* cited by examiner

BEVERAGE CONTAINER PACKAGING

CROSS-REFERENCE OF RELATED APPLICATION

This application claims priority to U.S. Provisional Application No. 63/282,980, entitled "BEVERAGE CONTAINER PACKAGING," filed Nov. 24, 2021, which is incorporated herein by reference in its entirety. This application also claims priority as a continuation-in-part of U.S. application Ser. No. 17/581,431, entitled "BEVERAGE CONTAINER PACKAGING," filed Jan. 21, 2022, which is a continuation of U.S. application Ser. No. 17/098,190, entitled "BEVERAGE CONTAINER PACKAGING," filed Nov. 13, 2020, now U.S. Pat. No. 11,261,015, issued Mar. 1, 2022, which claims priority to U.S. Provisional Application No. 62/934,708, entitled "BEVERAGE CONTAINER PACKAGING," filed on Nov. 13, 2019, and U.S. Provisional Application No. 63/011,705, entitled "BEVERAGE CONTAINER PACKAGING," filed on Apr. 17, 2020, the disclosures of which are incorporated by reference herein in their entirety.

TECHNICAL FIELD

This disclosure relates to packaging for materials, and particularly to packaging for beverage containers, such as wine bottles, beer bottles, spirits bottles, and the like.

BACKGROUND

Historically, packaging and/or packaging materials for shipment of beverage containers (e.g., wine bottles, beer bottles, spirits bottles, etc.) have included bubble wrap, Styrofoam, popcorn, and other traditional packaging materials. For example, multiple bottles could be wrapped in bubble wrap, positioned in Styrofoam, and/or otherwise secured and placed into a box for transit. More recently, molded paper pulp trays have been used to secure multiple bottles during transit. There still remains a need for improved beverage container packaging and, more particularly, improved molded paper pulp tray packaging that can accommodate temperature or environmental control of beverage containers.

SUMMARY

A beverage container packing assembly includes a bottom tray, center support, and a top tray. The bottom tray defines first compartments. The first compartments may be configured to receive a first portion of a beverage container. The bottom tray includes one or more first support columns. The center support defines through holes. Each of the through holes is configured to receive a second portion of a beverage container. The center support is configured to accommodate a thermo pack. The top tray defines second compartments. Each of the second compartments is configured to receive a third portion of a beverage container. The top tray is configured to accommodate the thermo pack between a first row and a second row of the second compartments.

The beverage container packing assembly may include a top tray that is configured to accommodate the thermo pack such that the thermo pack extends between a plurality of beverage containers installed in the first row and a plurality of beverage containers installed in the second row. The beverage container packing assembly may include top tray that includes a surface to accommodate the thermo pack.

The beverage container packing assembly may include a top tray that includes a thermo pack accommodating space to house the thermo pack between the first row and the second row of the second compartments. The beverage container packing assembly may include a top tray that includes vertical posts. The beverage container packing assembly may include a plurality of the vertical posts that are configured to contact the thermo pack. The beverage container packing assembly may include a plurality of the vertical posts that include a boundary of a thermo pack accommodating space. The beverage container packing assembly may include a thermo pack that is installed in the thermo pack accommodating space in one or more of an interference fit, a fixed fit, a press fit, and temporary fastening. The beverage container packing assembly may be configured so that the bottom tray, the center support, and the top tray are configured to be disposed in a shipping container. The bottom tray, the center support, and the top tray may extend to an inner surface of the shipping container. The beverage container packing assembly may be configured so that the bottom tray, the center support, and the top tray include molded paper pulp. The beverage container packing assembly may be configured so that the bottom tray, the center support, and the top tray further comprise a water-resistant coating. The beverage container packing assembly may include a center support that defines a through hole corresponding to each of said plurality of first compartments.

A beverage container packing assembly top tray may include a multiple second compartments. Each of the second compartments may be configured to receive a portion of a beverage container therein. The top tray may include at least one thermo pack accommodating space including a thermo pack surface and bounded by one or more support posts. The thermo pack accommodating space is configured to accommodate a thermo pack between a first row and a second row of the second compartments.

The beverage container packing assembly top tray may include a thermo pack accommodating space that is configured to accommodate the thermo pack such that the thermo pack extends between a plurality of beverage containers installed in the first row and a plurality of beverage containers installed in the second row. The beverage container packing assembly top tray may be configured so that the thermo pack is installed in the thermo pack accommodating space in one or more of an interference fit, a fixed fit, a press fit, and a temporary fastening.

A method of packing beverage containers is disclosed. A plurality of beverage containers are placed in a plurality of first compartments defined by a bottom tray of a beverage container packing assembly. A center support of the beverage container packing assembly is placed on top of the bottom tray such that the plurality of beverage containers extend through a plurality of through holes defined by the center support. A thermo pack is placed between a first row and a second row of the plurality of beverage containers such that the thermo pack extends between a plurality of beverage containers of the first row and a plurality of beverage containers of the second row, and is supported by the center support of the beverage container packing assembly. A top tray of the beverage container packing assembly is placed on top of the center support such that the thermo pack is installed in a thermo pack accommodating space in the top tray. The thermo pack accommodating space may be bounded by a plurality of vertical posts. The thermo pack is installed in the thermo pack accommodating space in one or more of an interference fit, a fixed fit, a press fit, and temporary fastening.

A beverage container packing assembly includes a bottom tray defining a plurality of first compartments. The plurality of first compartments are configured to receive a first portion of a beverage container therein. The bottom tray includes one or more first support columns. The beverage container packing assembly includes a center support defining a plurality of through holes. Each of the plurality of through holes is configured to receive a second portion of a beverage container therethrough. The center support includes second support columns each configured to stack on one of the first support columns. The beverage container packing includes a top tray defining a plurality of second compartments. The second compartments are configured to receive a third portion of a beverage container therein. The center support is configured to accommodate a thermo pack between a first row and a second row of the through holes.

According to various aspects, the center support is configured to accommodate a thermo pack installed in either a first configuration or a second configuration. The first configuration may include installing the thermo pack between the first row and second row and the second configuration comprises installing the thermo pack between a first column of through holes and a second column of through holes. The rows and columns may include different numbers of through holes.

According to various aspects, the center support includes a plurality of second support columns, and total number of second support columns is less than a total number of the first support columns.

According to various aspects, the center support comprises a plurality of second support columns. The second support columns include diamond-shaped elements and star point elements that extend away from the center of the support columns.

According to various aspects, the top tray includes third support columns, and a total number of the second support columns is less than a total number of the third support columns.

According to various aspects, each of the bottom tray, the center support, and the top tray are configured to be disposed in a shipping container. Each of the bottom tray, the center support, and the top tray may extend to an inner surface of the shipping container.

In various aspects, the bottom tray, the center support, and the top tray comprise molded paper pulp. In some instances, the bottom tray, the center support, and the top tray further include a water-resistant coating.

According to various aspects, the first support columns and/or the second support columns are hollow. In certain instances, the second support columns may have an inverted shape with respect to a shape of the one or more first support columns.

According to various aspects, the center support defines a through hole corresponding to each of said plurality of first compartments.

A beverage container packing assembly center support includes a support body defining a plurality of through holes. The through holes may be configured to receive a portion of a beverage container therethrough. The support body may include one or more support columns. The support columns may be configured to stack on a corresponding support column of a bottom tray of the beverage container packing assembly. In use, the center support is configured to accommodate a thermo pack between a first row and a second row of the plurality of beverage containers such that the thermo pack extends linearly between a plurality of beverage containers of the first row and a plurality of beverage containers of the second row.

According to various aspects, the center support is configured to accommodate a thermo pack installed in either a first configuration or a second configuration. The first configuration may include installing the thermo pack between the first row and second row and the second configuration may include installing the thermo pack between a first column of the beverage containers and a second column of the beverage containers.

According to various aspects, the center support may include a surface to accommodate installation of the thermo pack. In some aspects, the support body is configured to be disposed in a shipping container, the support body extends to an inner surface of the shipping container. In certain aspects, the center support comprises molded paper pulp.

A method of packing beverage containers includes placing a plurality of beverage containers in a plurality of first compartments defined by a bottom tray of a beverage container packing assembly. A center support of the beverage container packing assembly is placed on top of the bottom tray such that the beverage containers extend through a plurality of through holes defined by the center support. A thermo pack is placed between a first row and a second row of the plurality of beverage containers such that the thermo pack extends linearly between a plurality of beverage containers of the first row and a plurality of beverage containers of the second row. The thermo pack may be supported by the center support of the beverage container packing assembly. A top tray of the beverage container packing assembly is placed on top of the center support such that the beverage containers extend into a plurality of second compartments defined by the top tray.

BRIEF DESCRIPTION OF DRAWINGS

The foregoing and other features and advantages of the disclosure will be apparent from the following, more particular description of various exemplary embodiments, as illustrated in the accompanying drawings wherein like reference numbers generally indicate identical, functionally similar, and/or structurally similar elements. The first digits in the reference number indicate the drawing in which an element first appears.

DETAILED DESCRIPTION

Figure 1:
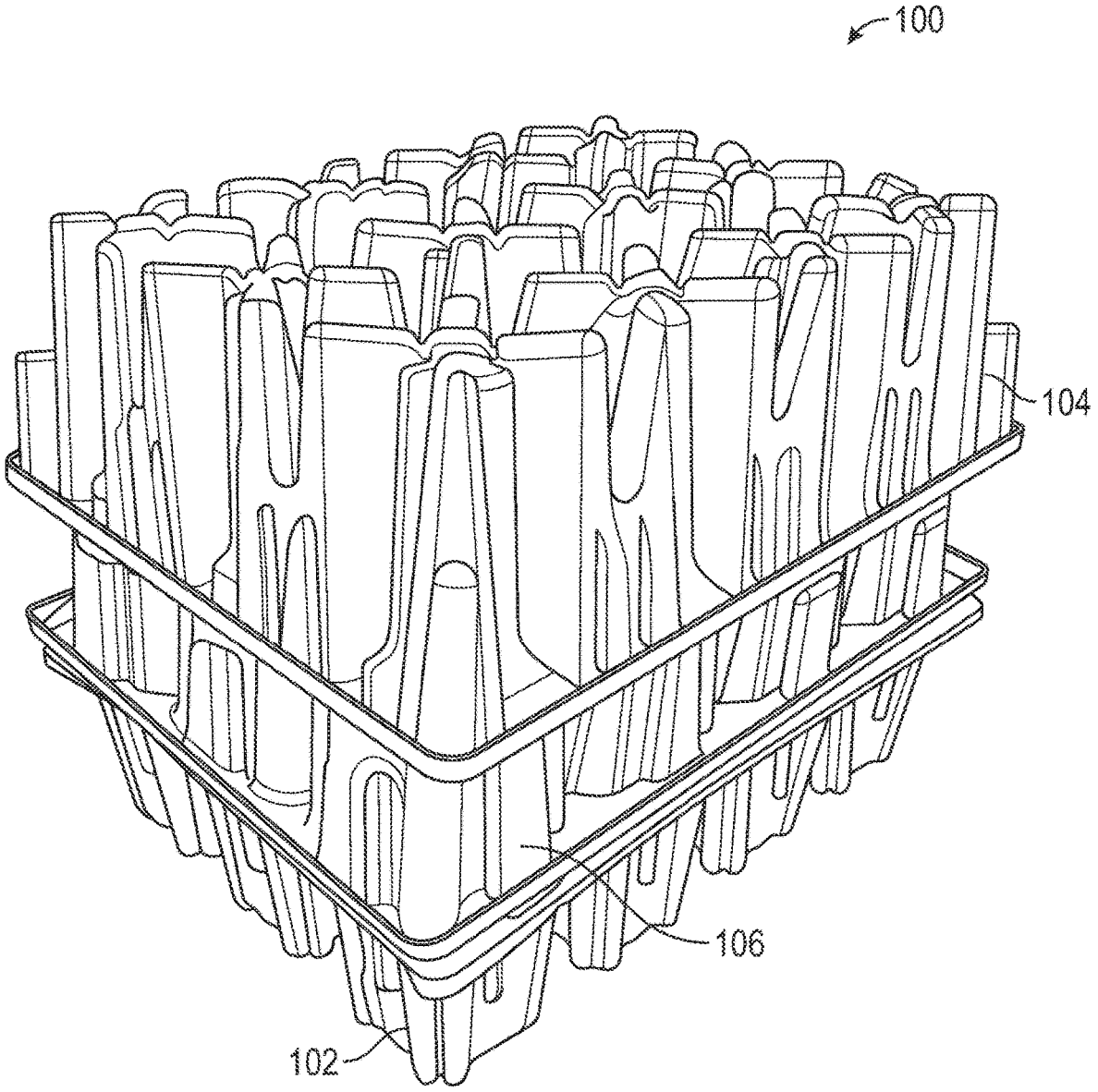
FIG. 1 depicts a beverage container packing assembly according to various embodiments.

Exemplary embodiments are discussed in detail below. While specific exemplary embodiments are discussed, it should be understood that this is done for illustration purposes only. In describing and illustrating the exemplary embodiments, specific terminology is employed for the sake of clarity. However, the embodiments are not intended to be limited to the specific terminology so selected. A person skilled in the relevant art will recognize that other components and configurations may be used without parting from the spirit and scope of the embodiments. It is to be understood that each specific element includes all technical equivalents that operate in a similar manner to accomplish a similar purpose. The examples and embodiments described herein are non-limiting examples.

Any publications and references cited herein are hereby incorporated by reference in their entirety.

As used herein, the term "a" refers to one or more. The terms "including," "for example," "such as," "e.g.," "may be" and the like, are meant to include, but are not be limited to, the listed examples.

Beverage container packing as described and shown herein is directed to molded trays, such as molded paper-pulp trays, that can accommodate temperature-controlled beverage containers. More particularly, the molded paper pulp trays can accommodate components, elements, and/or mechanisms for controlling the temperature in the packaging, such as thermo packs, ice packs, and the like to prevent spoiling during transport, especially during hotter times of year.

Beverage container packaging is disclosed herein in various embodiments. These various embodiments and configurations may include a bottom element (bottom tray, bottom insert), a top element (top tray, top insert), and/or a center support (center support element, center tray, support body). These elements may retain multiple beverage containers, such as wine bottles, beer bottles, spirits bottles, and the like, for shipment in a container, such as a cardboard box, crate, or other container. The beverage containers may vary in size including, for example, 375 ml, 500 ml, 750 ml, or any other size. The term beverage container as used herein may also refer to any container that encloses a fluid, whether or not the fluid is a beverage. Beverage containers may be placed bottom down in the bottom tray. The center support rests on top of the bottom tray and separates the multiple bottles. The center support separates the bottom tray and top tray, thereby providing stacking support. The top tray rests on the center support. And the top element accommodates the top (neck) of the beverage containers. The bottom tray, center support, top tray, and beverage containers are placed in a container, such as a cardboard box, regular slotted container (RSC), crate, etc., for transit.

In various embodiments, the bottom tray comprises molded paper pulp fabricated from, for example, recycled paper products. The bottom tray may include multiple cup-shaped elements (cup-shaped cavities) each contoured to encapsulate the bottom of a beverage container, such as a wine bottle, beer bottle, spirits bottles, and the like. In certain cases, the cylindrical cup-shaped element includes an hourglass-shaped deformable element and/or a cross shaped deformable element protruding from the bottom surface of the cup, deformable protrusions on the walls of the cup, and/or other features. These features retain the base of the beverage container in a stationary position during shipment by contacting the base of the container in multiple locations. These features of the cup-shaped element, particularly the hourglass shaped and/or cross-shaped deformable element absorb energy when the container is subjected to impact forces, such as when the packaging is dropped or roughly handled.

In some embodiments, the top tray comprises molded paper pulp. In certain cases, the top tray may include multiple rectangular cup-shaped elements each contoured to encapsulate the top of a beverage container, such as the neck of a wine bottle, beer bottle, spirits bottle, or other container. The rectangular cup-shaped element may include a cylindrical depression, vertical protrusions on the walls of the cup, and/or other features. These features retain the neck and/or upper portion of the beverage container in a stationary position during shipment by contacting the neck of the container in multiple locations.

In various embodiments, the center support may comprise molded paper pulp that is molded to encapsulate beverage containers.

The beverage container packing assembly disclosed herein in various embodiments enables beverage containers to be packaged with thermo packs positioned between the containers. The beverage container packaging disclosed herein allows temperature-sensitive beverages to be packaged and transported without spoiling and/or degradation due to environmental effects. The beverage container packaging includes space to accommodate thermo packs and/or other items used to control temperature, while maintaining the structural integrity of the packaging. For example, beverage container packaging includes a combination of spaces or voids to accommodate thermo packs and/or other items used to control temperature and sufficient structural elements to withstand loads, impacts, and/or other dynamic events during shipping. In certain cases, the molded paper pulp and/or other packaging materials include a liquid resistant coating, plastic wrapping (though potentially less environmentally friendly), material treatment, and/or other features to accommodate the environmental effects of a thermo pack housed in the packaging. As disclosed herein, inclusion of thermo packs and/or other temperature regulation components with molded paper pulp or other packaging materials allows for temperature control in a cost effective, light weight, structurally sound, and environmentally-conscious packaging assembly. Other temperature regulation components or items used to control temperature may include heaters, mechanisms to provide heat, coolers, refrigerators, fans, ice packs, heating packs, chemical elements that heat or cool the packaging, and/or any other item or device to modify or control temperature in the packaging.

The center support according to some embodiments includes side walls around the perimeter of the center support. The center support include multiple walls that at least partially encapsulate the beverage containers. In certain cases, the center support includes multiple separate walls that encapsulate a beverage container. For example, a first wall may encapsulate a first portion of the beverage container, and a second wall may encapsulate a second portion of the beverage container. The center support includes center posts and structural supports that both increase stacking support and provide lateral protection.

The center support according to some embodiments may include a moisture resistant material that retains structural integrity throughout transit and storage. The thermo packs can provide additional protection of the beverage containers, but the packing assembly can also be used without thermo packs. The moisture resistance within the center support allows the center support to absorb excess moisture and pull moisture from the wine labels, thus adding another protection benefit. In contrast, expanded polystyrene (EPS) containers do not allow excessive moisture to escape from the cavity, leaving bottle labels at risk. The rapid exchange of temperature within the packing assembly described herein allows for rapid evaporation of moisture from within the regular slotted container (RSC) shipping container.

In various embodiments, the beverage container may also include box liners. For example, a box liner may provide insulation surrounding the packaging elements, such as the bottom tray, center support, and top tray. The box liner may line the inside a shipping container, such as cardboard box. Box liners of varying degrees of thickness, materials, and other properties may be used to enhance the thermal capabilities of the beverage container packaging. In certain cases, the box liner may include polylitic acid (PLA) materials. PLA materials provide favorable insulation capabilities, are made of organic materials, and compostable and recyclable. The box liner may in conjunction with, for example, the thermo transport packs increase the R value of the cooling time range for the beverage container packaging. In certain cases, the box liner is fabricated from recyclable materials to reduce the environmental impact of the beverage container packaging.

FIG. 1 depicts a beverage container packing assembly according to various embodiments. In the example shown, a beverage container packing assembly 100 may include a bottom tray 102 (e.g., bottom element), a top tray 104 (e.g., a top element), a center support 106 (e.g., center support element, partition element), and/or other components. The beverage container packing assembly 100 (also referred to as a packaging system or assembly) is configured to package a plurality of beverage containers for transit. In the example shown, the beverage container packing assembly 100 is configured to package twelve (12) beverage containers (not shown). The base of the beverage container (not shown) sits in a compartment of the bottom tray 102. The center support 106 separates the bottom tray 102 and top tray 104. The top tray 104 rests on the center support 106. The top of the beverage container is encapsulated in a compartment of the top tray 104. The center support 106 prevents the beverage containers from contacting during shipping and provides spacing between the bottom tray 102 and top tray 104. As discussed in detail herein, the center support 106 is also configured to accommodate one or more transport thermo packs (not shown) that contact the beverage containers and/or maintain the beverage containers within in desired temperature range during transit.

Figure 2:
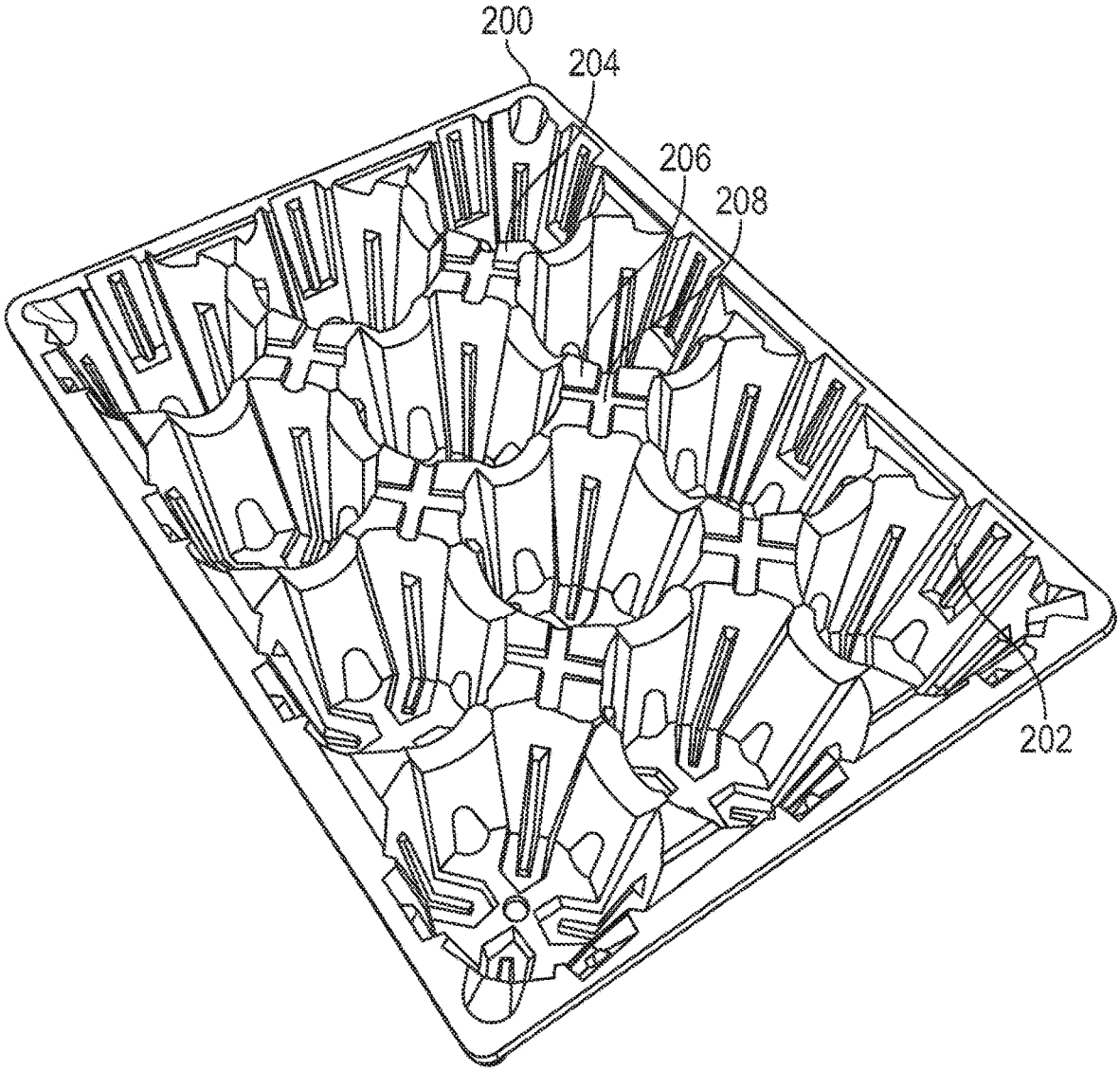
FIG. 2 depicts a bottom tray of a beverage container packing assembly according to some embodiments.

FIG. 2 depicts a bottom tray of a beverage container packaging assembly according to some embodiments. As shown, the bottom tray 200 includes a plurality of first compartments 202. The number of first compartments 202 corresponds to a number of beverage containers the bottom tray 200 is configured to accommodate. In the example shown, the bottom tray 200 includes twelve first compartments 202—three rows of four first compartments 202 or four columns of three first compartments 202. The bottom tray 200 shown is configured to accommodate 12 beverage containers. FIG. 2 depicts one example configuration of first compartments. Aspects of this disclosure, however, are in no way limited to the depicted configuration or number of first compartments 202. In other instances, a bottom tray (and associated beverage container packaging) be configured to accommodate six beverage containers (three rows of two beverage containers), nine beverage containers (three rows of three containers), 15 containers (five rows of three containers), 16 containers (four rows of four containers), and so on.

In certain cases, the bottom tray 200 includes one or more first support columns 204 configured to support the center support (not shown). Each of the first support columns 204 (six in the example shown) may include a plurality of platforms 206 (e.g., deformable post elements, protrusions, etc.) that form flat surfaces to contact the center support. The platforms 206 may be arranged in sets to resemble a cross-shape or X-shape. The platforms 206 may also be deformable and/or flexible to absorb load applied to the bottom tray 200, thereby reducing any load applied to the beverage containers. The platforms 206 may be separated by a depressed portion, such as the cross-shaped or X-shaped depressed portion 208 in FIG. 2.

Figure 3:
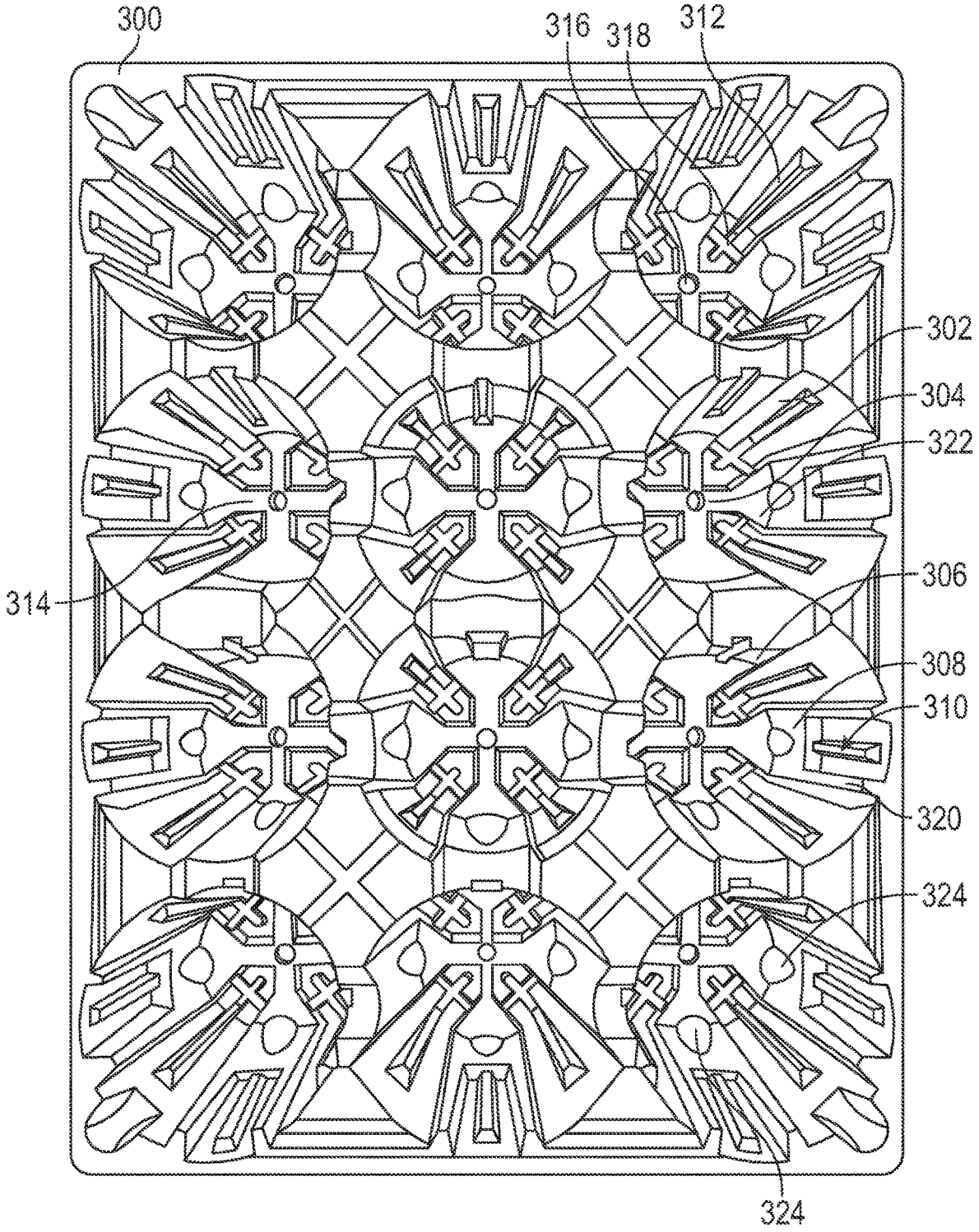
FIG. 3 depicts a second view of a bottom tray according to various embodiments.

FIG. 3 depicts a first view of a bottom tray according to various embodiments. In the example shown, a bottom tray 300 includes a plurality of first compartments 302 (twelve first compartments shown). In certain cases, each of the first compartments 302 is cylindrical and/or substantially cylindrical. The first compartments 302 may include a bottom portion and multiple side walls forming a cup shape. In certain cases, the side walls may not be vertical but may include draft, such as a seven-degree draft, to enable the bottom tray 300 to be easily removed from a mold during fabrication.

The first compartments 302 may include one or more of base deformable elements 304 on the base (bottom) of the first compartment 302. The first compartment 302 may include a first side panel deformable element 306, a second side panel deformable element 308, and a third side panel deformable element [[310]]. The first compartment 302 may include a thin deformable element 312 (for example, a corner deformable element) that extends from the side of the first compartment 302 to the base of the first compartment 302. In various embodiments, the first compartments 302 include multiple thin deformable elements 312. In certain cases, the thin deformable elements 312 extend from a center of first compartments and up a side of the first compartments 302. The thin deformable elements 312 terminate at the bottom of the first compartment 302 in a cross-shape and/or X-shape end 318 (e.g., cross shape element). The ends 318 include multiple overlapping elements. The cross-shaped ends 318 may assist in absorbing impact from a bottom of bottle when, for example, an assembly is dropped. The cross-shaped ends 318 may reduce damage to the end of thin deformable element 312 when, for example, the bottom tray 300 is bent. The cross-shaped ends 318 eliminate a stress concentration point and allow load to be distributed to other elements when the bottom tray 300 is bent or otherwise loaded.

In various embodiments, base deformable elements 304 on the base (bottom) of the first compartments 302 may be raised (protrusions) from the bottom surface of the first compartment 302. The base deformable elements 304 on the bottom of the first compartments 302 may resemble a cross, a plus sign, overlapping bowties, spirals, wheels with spokes, ovals, lines of logo or design, pictures resembling common shapes, and/or other a variety of similar shapes. The base deformable elements 304 are configured to absorb impact with the bottom of a beverage container, such as a load applied to a top or bottom of a beverage container when boxes are stacked, a box is dropped, and/or otherwise handled. The base deformable element 304 may be particularly effective in absorbing impact on a bottle with a convex bottom shape, such as certain wine bottles. In certain cases, wider portions 322 of the cross-shaped base deformable element 304 are configured to contact the outer edges of the bottom of a beverage container, such as a wine bottle. Thinner portions 314 of the cross-shaped base deformable element 304 allow the element to deform (for example, by bending, crumpling, and/or otherwise deforming) when a load is applied to a beverage container housed in the bottom tray 300. The base deformable element 304 deforms to absorb load and reduce damage to a bottle, particularly when a load is applied down from the top on the bottle or when the packing assembly is dropped.

In some embodiments, the base deformable elements 304 on the bottom of the first compartments 302 include holes 316. The holes 316 may vent air as the bottom tray 300 is lowered into a box (not shown). The holes 316 may reduce the vacuum in the box as the bottom tray 300 is installed in a box, thereby making assembly easier. Vent holes 316 may also enable air to enter the space between the box and the bottom tray 300 when the bottom tray 300 is removed from the box.

In various embodiments, the first compartment 302 includes multiple side panel deformable elements 306, 308. The side panel deformable elements 306, 308 are configured to contact the sides of a beverage container (not shown). In certain cases, the first side panel deformable element 306 and the second side panel deformable element 308 are configured to contact the outside of a bottle. The side panel deformable elements 306, 308 may be sized such that a bottle contacts at least a portion of each of the side panel deformable elements 306, 308 when loaded into the first compartment 302. The bottle (not shown) and side panel deformable elements 306, 308 may contact one another in an interference fit, such that a force is necessary to push the bottle into the first compartment 302 and a force is necessary to remove the bottle from the first compartment 302. Securing the bottle in the first compartment 302 in such a manner ensures that the bottle is stationary during transit, thereby reducing any potential damage.

In certain cases, a first type of side panel deformable elements 306 are included on the walls between adjacent first compartments 302. The side panel deformable elements 306 include a contoured protrusion configured to contact the outside of a bottle.

In some embodiments, a second type of side panel deformable elements 308 are included on outer walls of the first compartment 302 (e.g., walls of the first compartments 302 not adjacent to any other first compartments 302). A lower portion of the second side panel deformable elements 308 may resemble the structure of the first side panel deformable elements 306, and an upper portion may include multiple thinner protrusions 310, 320. In the example shown, the multiple thinner protrusions 310, 320 may resemble tines of a fork.

According to some embodiments, the first compartment 302 includes multiple thin deformable elements 312 (e.g., corner deformable elements). In certain cases, thin deformable element 312 may extend from a center of the first compartment 302 up a side of the first compartment 302. The corner deformable elements 312 may include thin protrusions spaced roughly 90 degrees apart from one another. In certain cases, the thin deformable elements 312 may be spaced roughly 45 degrees from the intersection of the cross-shaped base deformable element 304. In the example shown, there are four thin deformable elements 312 in each first compartment 302. Though in other cases, the first compartment 302 may include other numbers of thin deformable elements 312.

In various embodiments, the cup-shaped elements 302 elements include rounded corners 324 at a base of the cup-shaped elements 302. The rounded corners 324 may allow the bottom tray 300 to endure more repeated loading. The rounded corners 324 also accommodate the shape of the bottom of a beverage container.

Figure 4:
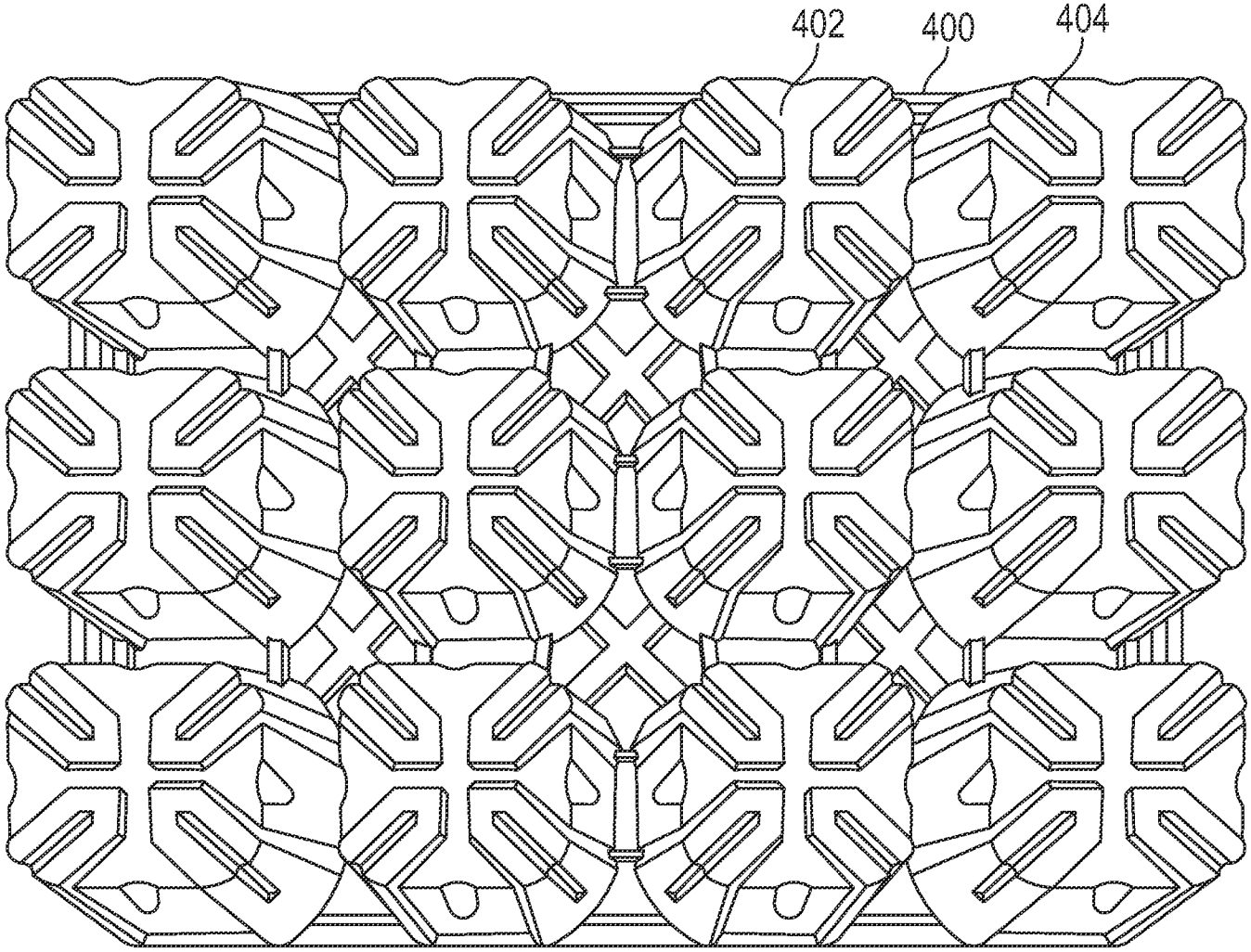
FIG. 4 depicts a third view of a bottom tray according to various embodiments.

FIG. 4 depicts a second view of a bottom tray according to various embodiments. In the example shown, which may include an opposite side of the bottom tray from FIG. 3, a bottom tray 400 includes multiple first compartments 402. The bottom side of the bottom tray 400 includes pulp paper. The bottom side of the first compartments 402 may include protrusions 404 (e.g., four protrusions in the example shown) extending from the bottom of the first compartments 402 up each side. The protrusions 404 may absorb impact and reduce loads applied to the beverage containers during, for example, an impact event.

Figure 5:
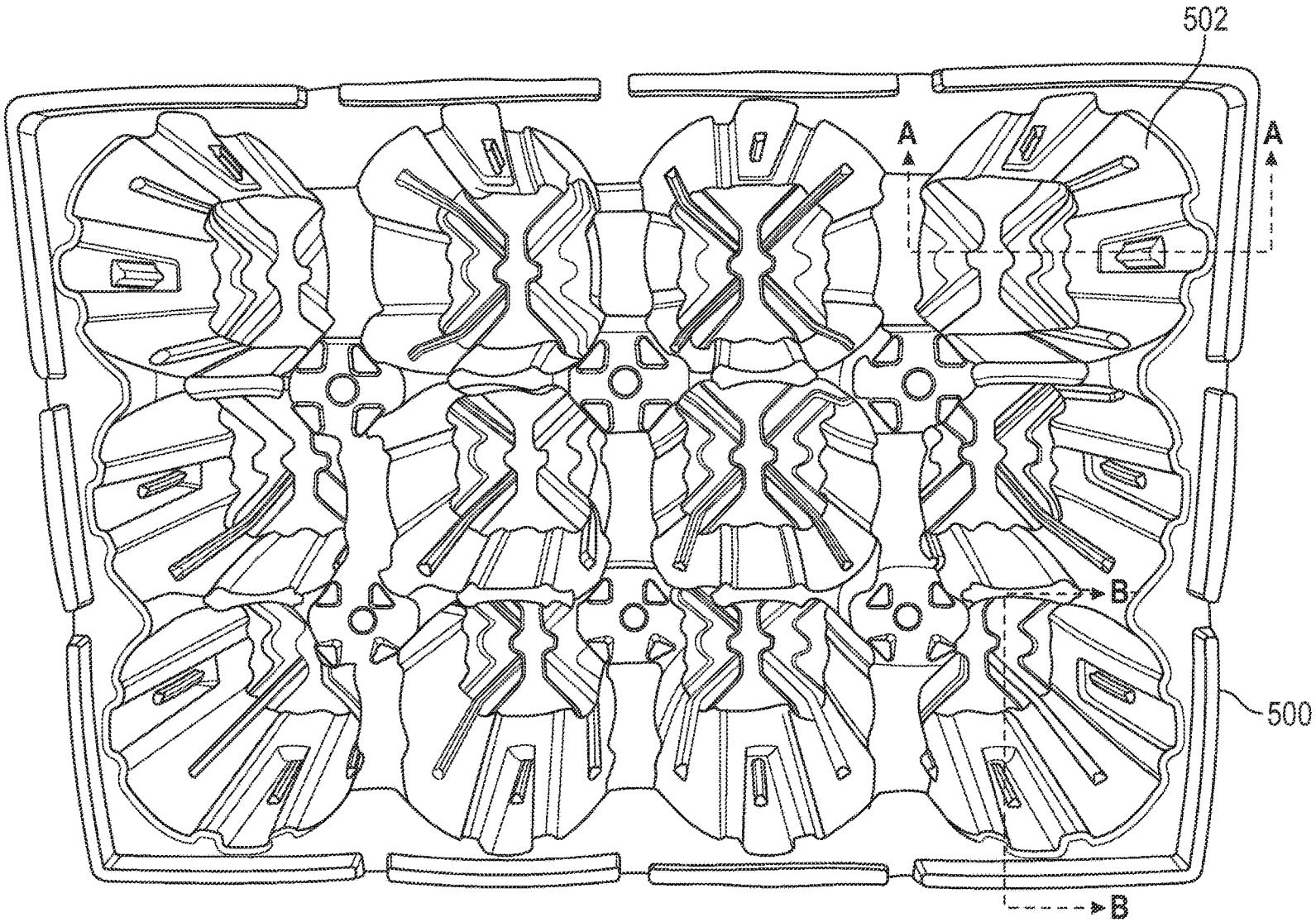
FIG. 5 depicts a bottom tray according to various embodiments.
Figure 6:
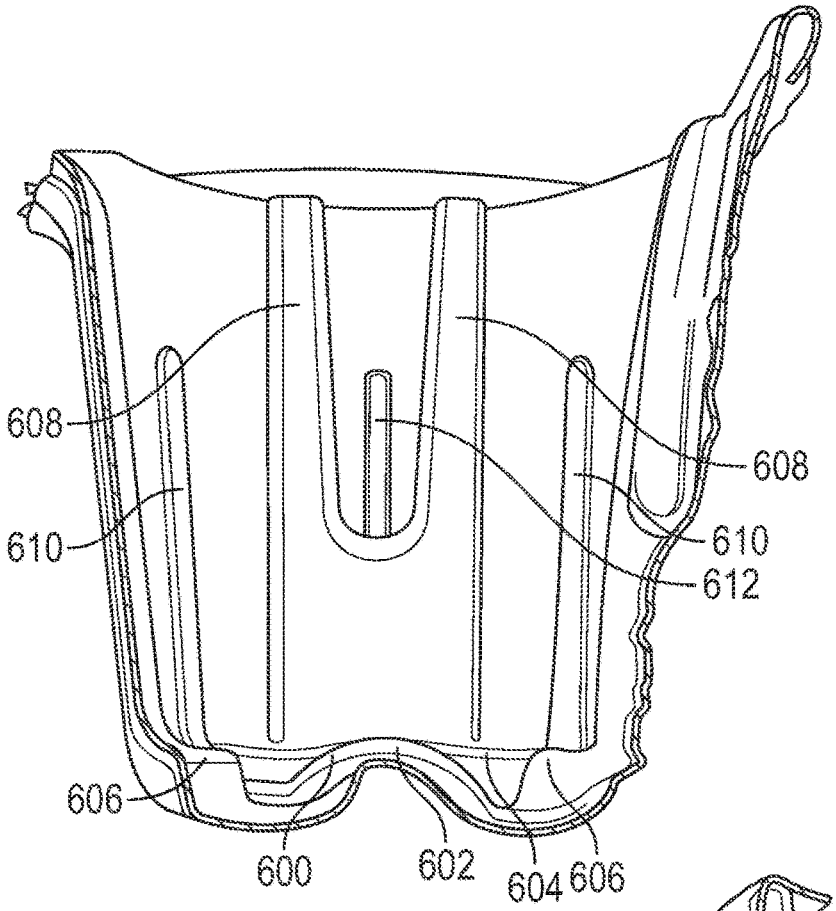
FIG. 6 depicts a first cross-section view of a first compartment of a bottom tray according to various embodiments.

FIG. 5 depicts a bottom tray according to various embodiments. In the bottom tray 500 shown, a first cross-section A-A depicts a cross-section of the first compartment 502 of the bottom tray 500 in a first direction. The first cross-section A-A is depicted in FIG. 6. A second cross section B-B depicts a cross-section of the first compartment 502 in a direction perpendicular to the first direction. The second cross-section B-B is depicted in FIG. 7.

FIG. 6 depicts a first cross-section view of a first compartment of a bottom tray according to various embodiments. FIG. 6 includes a cross-section view along section A-A as shown in FIG. 5. In the example shown, the cross-section passes through the center of the hourglass shaped deformable element 600. The center of the hourglass shaped deformable element 600 includes a thinner portion 602 of the hourglass shaped deformable element 600. The wider portion 604 of the hourglass shaped deformable element 600 is shown in the background. The wider portion 604 contacts the outer edges of the bottom of a beverage container. The second deformable elements 606 also contact the outer edges of the bottom of the beverage container (not shown). First vertical elements 608 contact the sides of the beverage container to retain the container in place. Thin deformable elements 610 extend from the center of the cup-shaped element up the sides of the first compartment. In certain cases, a thin deformable element 612 may be disposed between the first vertical elements 608.

Figure 7:
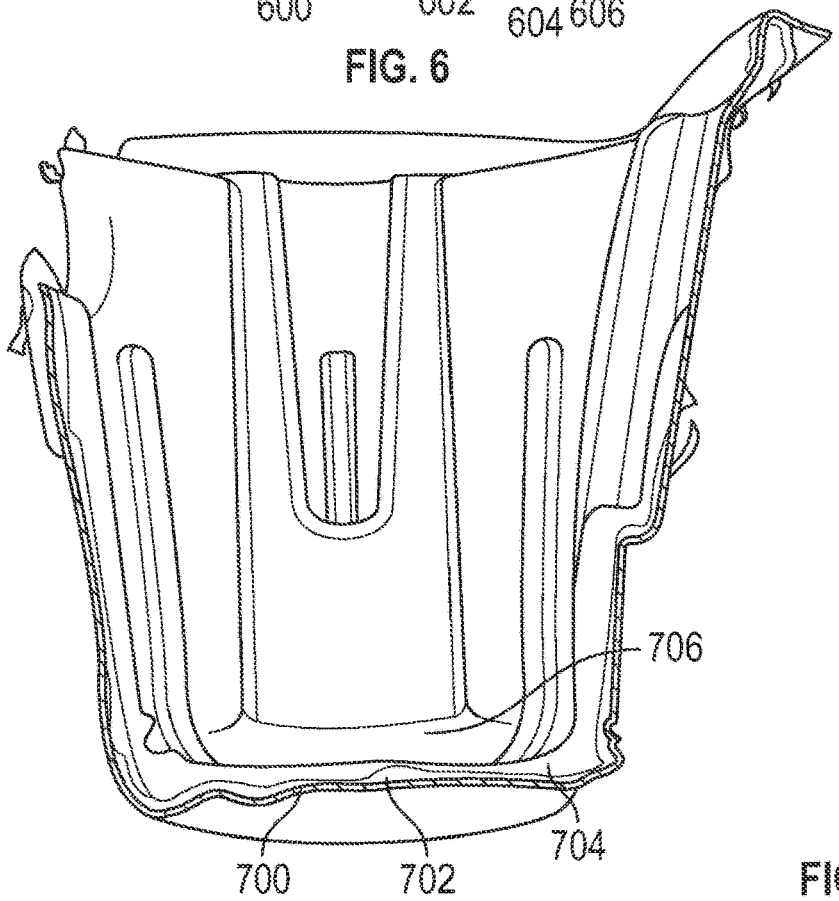
FIG. 7 depicts a second cross-section view of a first compartment of a bottom tray according to various embodiments.

FIG. 7 depicts a second cross-section view of a first compartment of a bottom tray according to various embodiments. FIG. 7 includes a cross-section view along section B-B as shown in FIG. 5. In the example shown, the cross-section passes through the center of the hourglass shaped deformable element 700. The thinner portions 702 and wider portions 704 of the hourglass shaped element 700 are raised up from a bottom surface of the first compartment. The wider portions of the hourglass shaped element 700 contact a beverage container placed into the cup-shaped element. When a load is applied to a beverage container with a convex bottom (such as a wine bottle, beer bottle, etc.), the wider portions 704, which contact the bottom of the bottle, are configured to deform and absorb the energy of the load. The second deformable portion 706 (shown in the background of the cross-section) is similarly configured to deform and absorb a load applied to a beverage container.

Figure 8:
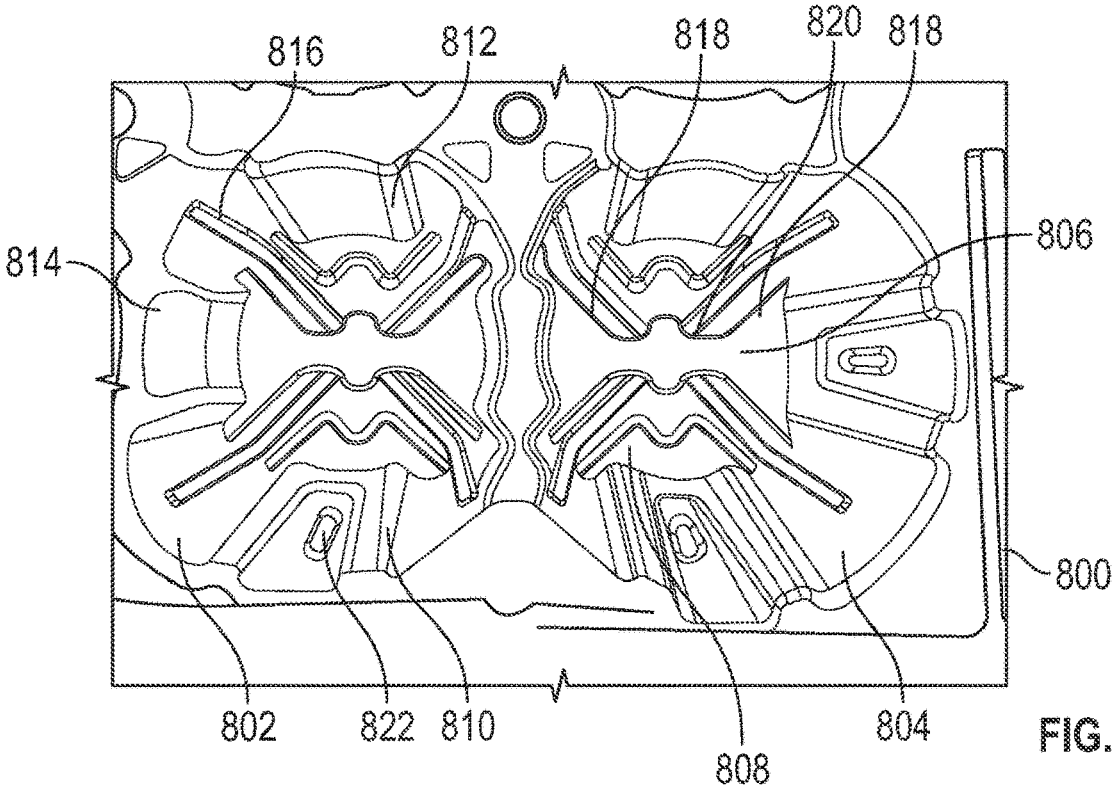
FIG. 8 depicts first compartments of a bottom tray according to various embodiments.

FIG. 8 depicts first compartments of a bottom tray according to various embodiments. In the example shown, the bottom tray 800 may include first compartments 802, 804 that are cylindrical and/or substantially cylindrical. The bottom tray 800 may include a detailed view of the compartments of bottom tray 500 of FIG. 5. The first compartments may include a bottom portion and multiple side walls forming a cup shape. In certain cases, the side walls may not be exactly vertical but may include draft to enable the bottom tray 800 to be easily removed from a mold during fabrication.

Each of the multiple first compartments 802, 804 includes a first deformable element 806 (e.g., an hourglass shaped element, bow-tie shaped element), second deformable elements 808, vertical elements 810, 812, 814, and other elements. The first deformable element 806 may be raised (e.g., a protrusion) from the bottom surface of the first compartments 802, 804. The first deformable element 806 may resemble an hourglass, bow tie, or other similar shape. The first deformable element 806 is configured to absorb impact applied to a top of a beverage container (not shown). The first deformable element 806 may be particularly effective in absorbing impact from a bottle with a convex bottom surface, such as a wine bottle. Wider portions 818 of the hourglass shaped element 806 are configured to contact the outer edges of the bottom of a bottle, such as a wine bottle. Thinner portions 820 of the hourglass shaped element 806 allow the element to deform (for example, by bending, crumpling, and/or otherwise deforming) when a load is applied to a beverage container housed in the bottom tray 800. The hourglass shaped element 806 deforms to absorb load and reduce damage to a bottle, particularly when a load is applied down from the top on the bottle or when the packing assembly is dropped.

The first compartments 802, 804 may include second deformable elements 808. The second deformable elements 808 may resemble two adjacent mountain peaks. Similar to the first deformable element 806, the second deformable elements 808 are configured to contact the outer edges of the bottom of a bottle, such as a wine bottle. When a load is applied to the top of the wine bottle, when the beverage container packaging is dropped, or when the bottle is otherwise subjected to a force, the second deformable elements 808 are configured to absorb the load and/or energy of the load by, for example, crushing, buckling, and/or otherwise deforming.

In various embodiments, the first compartments 802, 804 include multiple vertical deformable elements 810, 812, 814. The vertical deformable elements 810, 812, 814 contact the sides of a beverage container (not shown). In certain cases, first vertical elements 810, second vertical elements 812, and third vertical elements 814 are configured to contact the outside of a bottle. The first vertical elements 810, second vertical elements 812, and third vertical elements 814 may be sized, such that a bottle contacts all of the vertical elements 810, 812, 814 when loaded into the first compartments 802, 804. The bottle (not shown) and vertical deformable elements 810, 812, 814 may contact one another in an interference fit, such that a force is necessary to push the bottle into one of the first compartments 802, 804 and a force is necessary to remove the bottle from the first compartments 802, 804. Securing the bottles in the first compartments 802, 804 in such a manner ensures that the bottles are stationary during transit, thereby reducing any potential damage.

According to various embodiments, the first compartments 802, 804 include multiple thin deformable elements 816, 822. In certain cases, four thin deformable elements 816 may extend from a center of the first compartments 802, 804 up a side of the first compartments 802, 804. The four thin deformable elements 816 may include thin protrusions spaced roughly 90 degrees apart from one another. The thin deformable elements 816 may collectively form an X-shape, with each thin deformable element 816 extending from the center of the X along the bottom and up a side wall. In certain cases, a portion of a first thin deformable element 816 extending along the wall of the first compartments 802, 804 may extend further from the surface than a portion of the thin deformable element spanning the bottom of the first compartments 802, 804. In other words, the portion of the thin deformable element 816 spanning the wall may be taller (higher) than the portion spanning the bottom of the first compartments 802, 804. In some embodiments, second thin deformable elements 822 may be disposed between vertical elements 810. Similar to the vertical elements, thin deformable elements 816, 822 are configured to absorb impact energy and/or loads applied to the sides of the bottle. The thin deformable elements 816, 822 prevent damage to the bottom and sides of the bottle.

Figure 9:
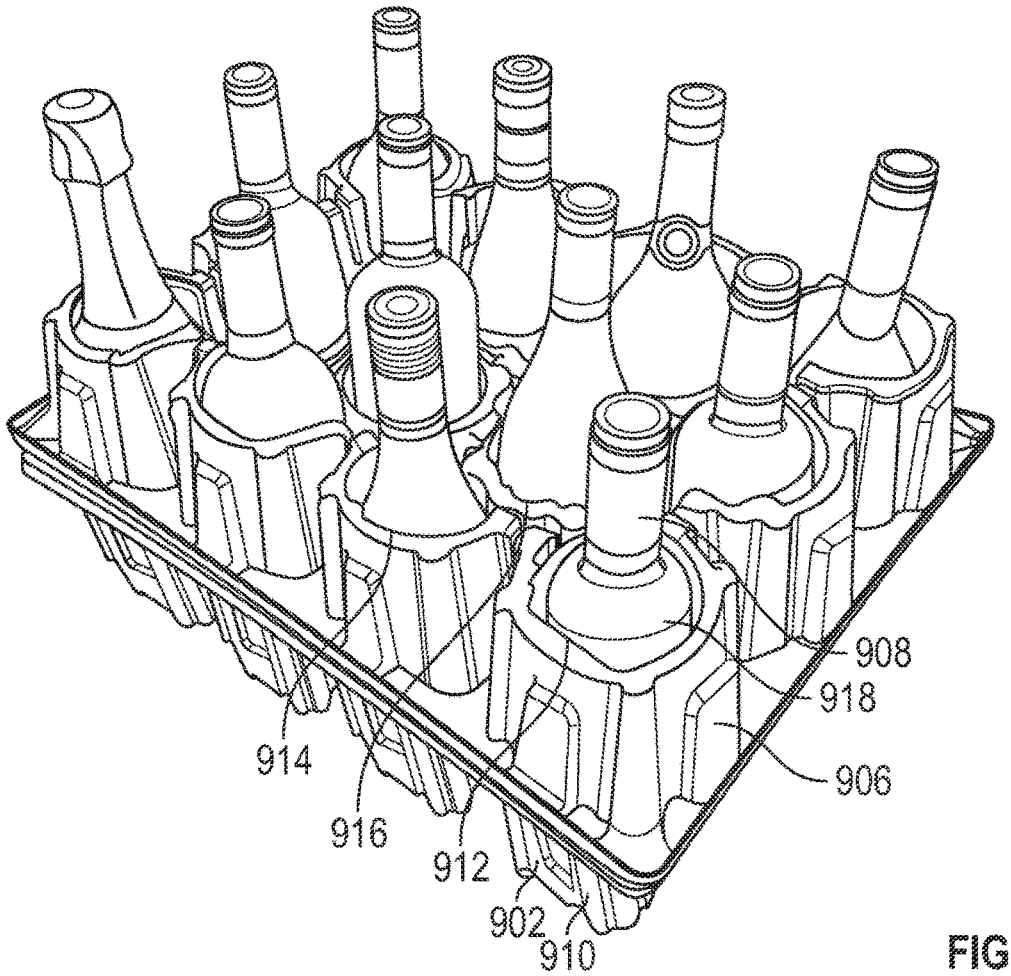
FIG. 9 depicts a bottom tray and center support of a beverage container packing assembly according to various embodiments.

FIG. 9 depicts a bottom tray and center support of a beverage container packing assembly according to various embodiments. In the example shown, a bottom tray 902 houses a plurality of beverage containers 908, and a center support 906 rests upon the bottom tray 902. A beverage container 908 (e.g., a wine bottle) is seated in a compartment 910 of the bottom tray 902. The compartment 910 is shaped to retain the beverage container 908 in a vertical configuration during transit. In the example shown, the center support 906 is fabricated from molded paper pulp and/or similar materials. The center support 906 defines a plurality of through holes 912, 914, 916. Each of the plurality of through holes 912, 914, 916 is configured to receive a portion of a beverage container therethrough. In the example shown, the center support 906 includes 12 through holes. A middle portion of the beverage container 918 extends through each of the through holes (e.g., beverage container 908 extends through hole 912).

FIG. 9 depicts one example configuration of the bottom tray and center support that accommodates 12 beverage containers. This disclosure, however, is in no way limited to a beverage container packing configuration accommodating 12 beverage containers. For example, a bottom tray, center support, top tray, and associated beverage container packaging may be configured to accommodate six beverage containers (three rows of two beverage containers), nine beverage containers (three rows of three containers), 15 containers (five rows of three containers), 16 containers (four rows of four containers), 20 containers (five rows of four containers), and/or any other number of beverage containers.

Figure 10:
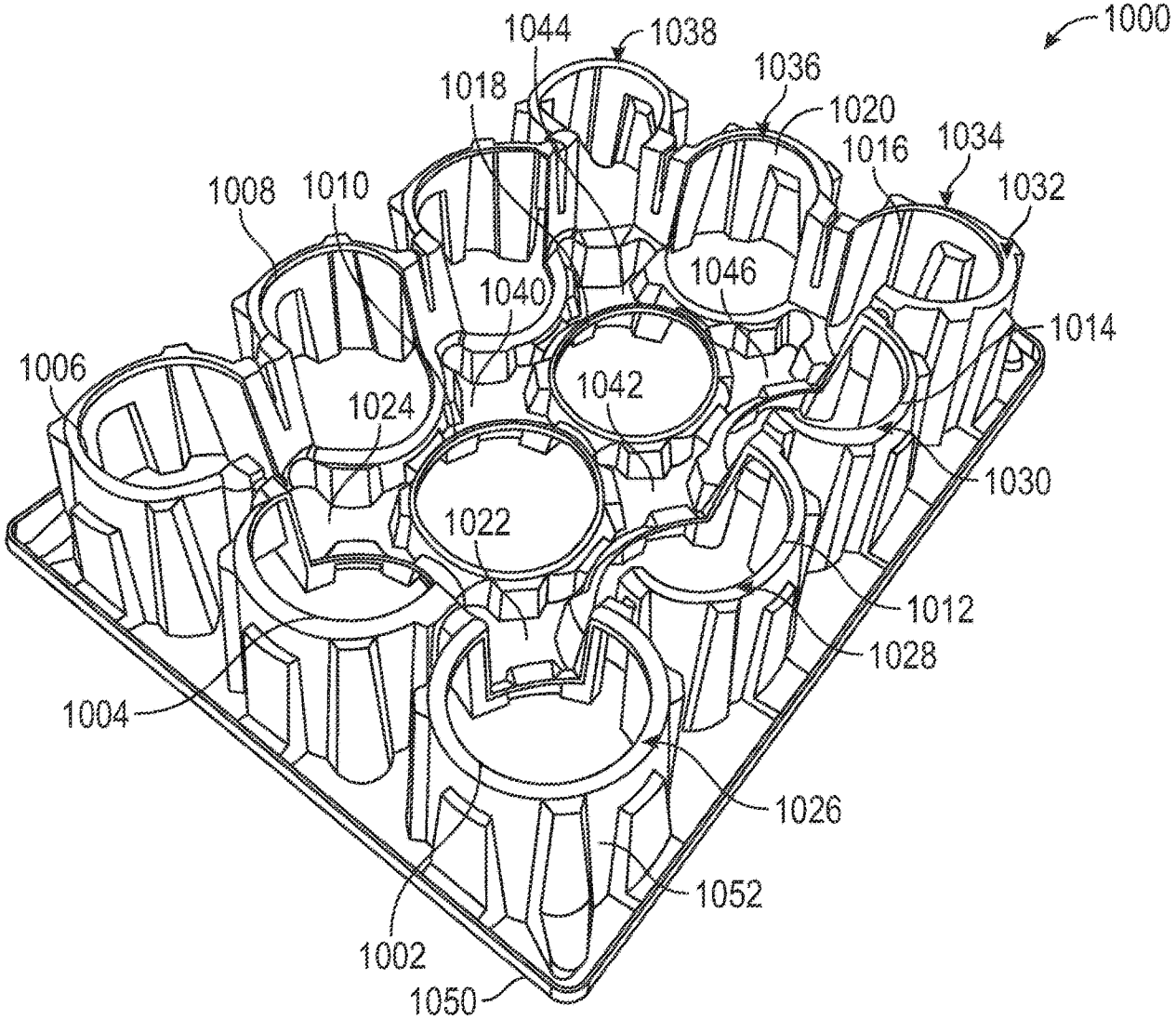
FIG. 10 depicts a center support of a beverage container packing assembly according to various embodiments.

FIG. 10 depicts a center support of a beverage container packing assembly according to various embodiments. In the example shown, a center support 1000 (also referred to as a support body) of a beverage container packing assembly is depicted. The center support 1000 defines a plurality of through holes 1002-1020. Each of the plurality of through holes 1002-1020 is configured to receive a portion of a beverage container therethrough. The center support 1000 may include support columns 1022, 1024, 1040, 1042, 1044, 1046 (six shown), which may include second support columns. The support columns 1022, 1024, 1040, 1042, 1044, 1046 are configured to stack on one of the one or more first support columns of the bottom tray (e.g., first support columns 204 of FIG. 2).

In use, the center support 1000 is configured to accommodate one or more transport thermo packs. The transport thermo packs may be installed in various configurations in the center support 1000. The center support 1000 comprises multiple surfaces to accommodate installation of the thermo packs. In one example (as further depicted for example in FIG. 12), transport thermo packs are placed between rows of a plurality of beverage containers. Transport thermo packs are placed, for example, between a first row 1026 and a second row 1028 of a plurality of beverage containers such that the transport thermo pack extends linearly between a plurality of beverage containers of the first row and a plurality of beverage containers of the second row. For example, three beverage containers could be disposed in the three through holes 1002, 1004, 1006, forming a first row 1026, and three beverage containers could be disposed in the three through holes 1008, 1010, 1012, forming a second row 1028. Three beverage containers may be disposed in holes forming a third row 1030, three beverage containers may be disposed in holes forming a fourth row 1032, and so on. Additional transport thermo packs may be installed between the second row 1028 and the third row 1030. Transport thermo packs may also be installed between the third row 1030 and fourth row 1032. The center support 1000 is configured to accommodate transport thermo packs between the first row 1026 and a second row 1028, between the second row 1028 and third row 1030, and/or between the third row 1030 and fourth row 1032. The center support 1000 allows the thermo packs to be installed between the beverage containers, while maintaining the structural integrity of the packaging.

In another example (as further depicted for example in FIG. 13), transport thermo packs are placed between columns of a plurality of beverage containers. Transport may be placed between a first column 1034 and second column 1036 of a plurality of beverage containers such that the transport thermo pack extends linearly between a plurality of beverage containers of the first column and a plurality of beverage containers of the second column. For example, four beverage containers could be disposed in the four through holes forming a first column 1034, and four beverage containers could be disposed in the four through holes forming a second column 1036. Four beverage containers may be disposed in holes forming a third column 1038. Transport thermo packs may be installed between the first column 1034 and the second column 1036. Transport thermo packs may be installed between the second column 1036 and third column 1038. The center support 1000 is configured to accommodate transport thermo packs between the first column 1034 and a second column 1036 and/or between the second column 1036 and third column 1038.

As discussed herein, the transport thermo pack may be, for example, an ice pack, or substance that can be cooled or frozen and can absorb thermal energy from the beverage containers and the environment, keeping the beverage containers cool. Alternatively, the transport thermo pack may be a heating pack that radiates thermal energy, thereby maintaining the beverage containers at a higher temperature than would be possible without a heating source. The center support 1000 according to various embodiments may accommodate a plurality of transport thermo packs. Each transport thermo pack may transmit thermal energy to or absorb thermal energy from one or more beverage containers. The transport thermo pack may be contoured to match the space between adjacent rows of beverage containers.

According to various embodiments, support columns 1022, 1024 extend between a first row 1026 and a second row 1028 of beverage containers. Support columns 1040, 1042 also extend between second row 1028 and third row 1030. Support columns may also extend between the third row 1030 and fourth row 1032.

According to various embodiments, the center support includes a plurality of support columns 1022, 1024, 1040, 1042, 1044, 1046. The total number of the support columns may be equal, less than, and/or greater than the total number of the one or more first support columns of the bottom tray (e.g., first support columns 204 of FIG. 2). The second support columns 1022, 1024, 1040, 1042, 1044, 1046 provide structural support and/or rigidity as the packaging is exposed to loading and impact during transit. For example, the second support columns 1022, 1024, 1040, 1042, 1044, 1046 transmit load between the top tray and bottom tray when the package is subjected to vertical loading. In certain cases, load from the top tray is transferred through the walls of the through holes, into the support columns, and into the first support columns of the bottom tray. For example, the center support 1000 may include six second support columns 1022, 1024, 1040-1046, while the bottom tray 200 depicted in FIG. 2 includes six first support columns 204.

The center support 1000 may include a lower edge 1050 that forms a perimeter around the through holes. The lower edge 1050 may extend to an inner surface of a box or other container in which the beverage packing assembly is disposed. The lower edge 1050 may connect to the walls 1052 defining the through holes on the edges of the center support 1000. For example, in FIG. 10, there are ten through holes on the edges of the center support 1000, and two through holes 1010, 1018 on the interior of the center support 1000. Each of the through holes on the edges of the center support 1000 is at least partially defined by a wall. In certain cases, each of the through holes on the corners of the center support 1000 are partially defined by a wall that is configured to extend more than 180 degrees around the beverage container. In various embodiments, the wall defining the certain through holes may be configured to extend about 270 degrees around the beverage container. In certain cases, some through holes may be configured to extend less than or equal to 180 degrees around the beverage container. The one or more of the through holes along the edges of the center support 1000 that are not on the corners of support 1000 are partially defined by a wall that is configured to extend less than 180 degrees around the beverage container. The walls of adjacent through holes may connect to form a continuous, undulating surface along the side of the center support 1000. The walls may have an inverted cup-like shape, with the walls tilting inward slightly from the edge 1050 at the base of the center support 1000 to the through holes as the top of the center support. In certain cases, the walls may include draft, such as a seven-degree draft, for example to enable the center tray to be easily removed from a mold during fabrication.

In certain cases, the through holes are contoured to fit particular types of bottles. The through holes may be various shapes, such as circular, oval, rectangular, and/or any shape. In some configurations, one or more of the through holes may include different sizes and/or shapes. For example, one or more of the through holes may configured for smaller bottle, while other through holes are configured for larger bottles.

Although the center support depicted in FIG. 10 according to various embodiments includes 12 through holes with six support columns 1022, 1024, 1040-1046, this disclosure is not limited to this configuration and is intended to encompass a wide variety of center support designs. The center support 1000 may include more or fewer through holes and more or fewer support columns. Further, the second support columns may have different positions than those shown in the drawings. The second support columns may have alternative positions that still allow the center support to accommodate a transport thermo pack.

Figure 11:
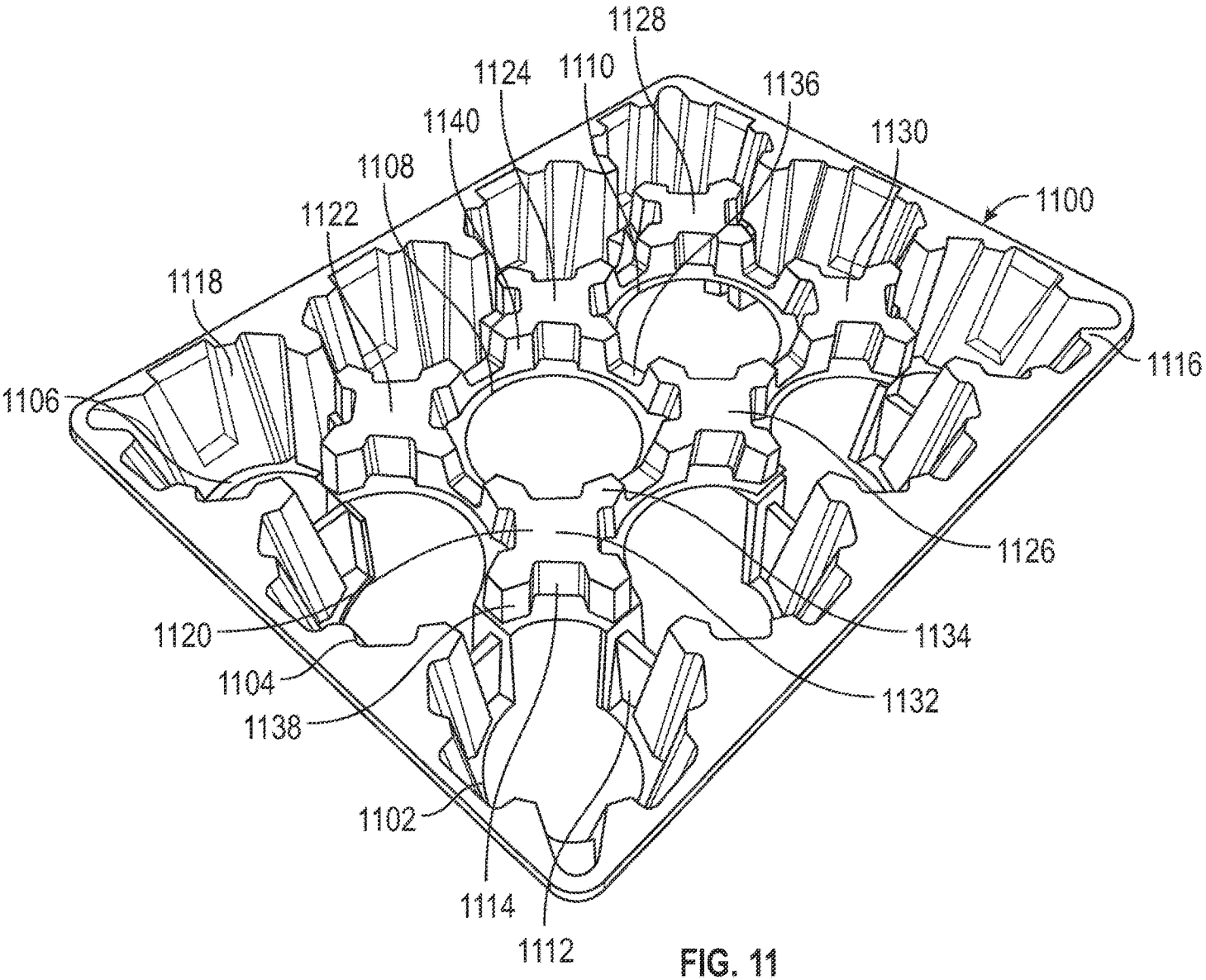
FIG. 11 depicts an underside of a center support according to various embodiments.

FIG. 11 depicts an underside of a center support according to various embodiments. In the example shown, a center support includes multiple through holes 1102-1110. The through holes may be defined by one or more side walls. For example, corner through hole 1102 may include at least two sides: a first side wall 1112, a second side wall 1114, and/or other side walls. A first side wall 1112 may extend from the bottom surface 1116 to the top surface (not shown) of the center support 1100. As shown, the first side wall 1112 may be configured to surround more than half of a beverage container. The second side wall 1114 extends from the bottom surface 1116 to a point short of the top surface of the center support 1100. The second side wall 1114 may be shorter than the first side wall 1112. The second side wall 1114 may include a portion the support columns 1120-1130. The side wall(s) 1112 may define the through holes along the edges of the center support 1100 form a continuous, undulating surface that surrounds all 12 of the through holes, providing support and protection for the beverage containers disposed therein. The side walls 1112 may also include deformable elements 1118. The deformable elements 1118 may contact the beverage container and/or secure the beverage containers in place during transit. The deformable elements 1118 may also be configured to deform when a load is applied to the beverage container packaging. When the deformable elements 1118 flex, the center support 1100 absorbs the impact of any load applied and protects the beverage containers from damage. In certain cases, the deformable elements 1118 may include denesting lugs and may aid in denesting a stack of nested center supports.

In various embodiments, the center support 1100 includes one or more support columns 1120-1130. In the example shown, the center support 1100 includes six support columns 1120-1130. The support columns 1120-1130 may include and/or correspond to the support columns 1022, 1024, 1040, 1042, 1044, 1046 of FIG. 10. In certain cases, the support columns 1120-1130 may include the shape of star-shaped posts, cross-shaped contoured posts, and/or other elements. The second support columns 1120-1130 include a diamond-shaped inner portion 1132 (e.g., square and/or rectangular shaped inner portion) and star point elements 1134 that extend away from the center of the support columns 1120-1130. The star-point elements 1134 may extend, for example, at ninety-degree angles (e.g., orthogonal to one another) to form the shape of a star and/or cross. In certain cases, the support columns 1120-1130 include deformable elements 1138. The deformable elements 1138 may contact the beverage container and/or secure the beverage containers in place during transit. The deformable elements 1138 may also be configured to deform when a load is applied to the beverage container packaging. In certain cases, the deformable elements 1138 of the support columns may function similar to the deformable elements 1118. In certain cases, a center support 1100 includes recessed elements 1136 elements between the posts 1120-1130. The recessed elements 1136 between posts 1120-1130 allow the posts 1120-1130 to tilt relative to one another and the center support 1100 to flex during use.

In various embodiments, through holes 1108, 1110 in the inner portion of the center support 1100 are surrounded (at least partially) by support columns. For example, through hole 1108 is surrounded by four support columns 1120, 1122, 1124, 1126. The support columns may include deformable elements 1140 that contact the beverage container and secure the container in place during transit.

According to some embodiments, the support columns 1120-1130 may be hollow and have an inverted shape with respect to the shape of the first support columns of the bottom tray. As depicted in FIGS. 2 and 3, the first support columns (e.g., support columns 204 of FIG. 2) of the bottom tray may be hollow and may have a width that tapers to a flat upper surface. When the center support 1100 is in an upright orientation, as in FIG. 10, the second support columns 1120-1130 have a width that tapers to a flat lower surface, thus having an inverted shape with respect to the shape of the first support columns of the bottom tray. The flat surfaces of the center support columns 1120-1130 contact the flat upper surfaces of the bottom tray support columns. When the support columns of the bottom tray (e.g., support columns 204 of FIG. 2) contact the support columns 1120-1130 a load path is generated transfer any applied loads through the centers support 1100 and into the bottom tray, while reducing loading on and damage to the beverage containers.

In various embodiments, the second support columns 1120-1130 may be connected to form adjoining support columns. The adjoining columns may include to adjoined towers with two distinct high points. The adjoining columns in certain cases may resemble multiple towers adjoined by a lower base portion. There may include for example a U-shaped or V-shaped recessed elements (depressions) 1136 between the two high points of the columns. This configuration may be advantageous in, for example, improving the structural strength of the packaging.

Figure 12:
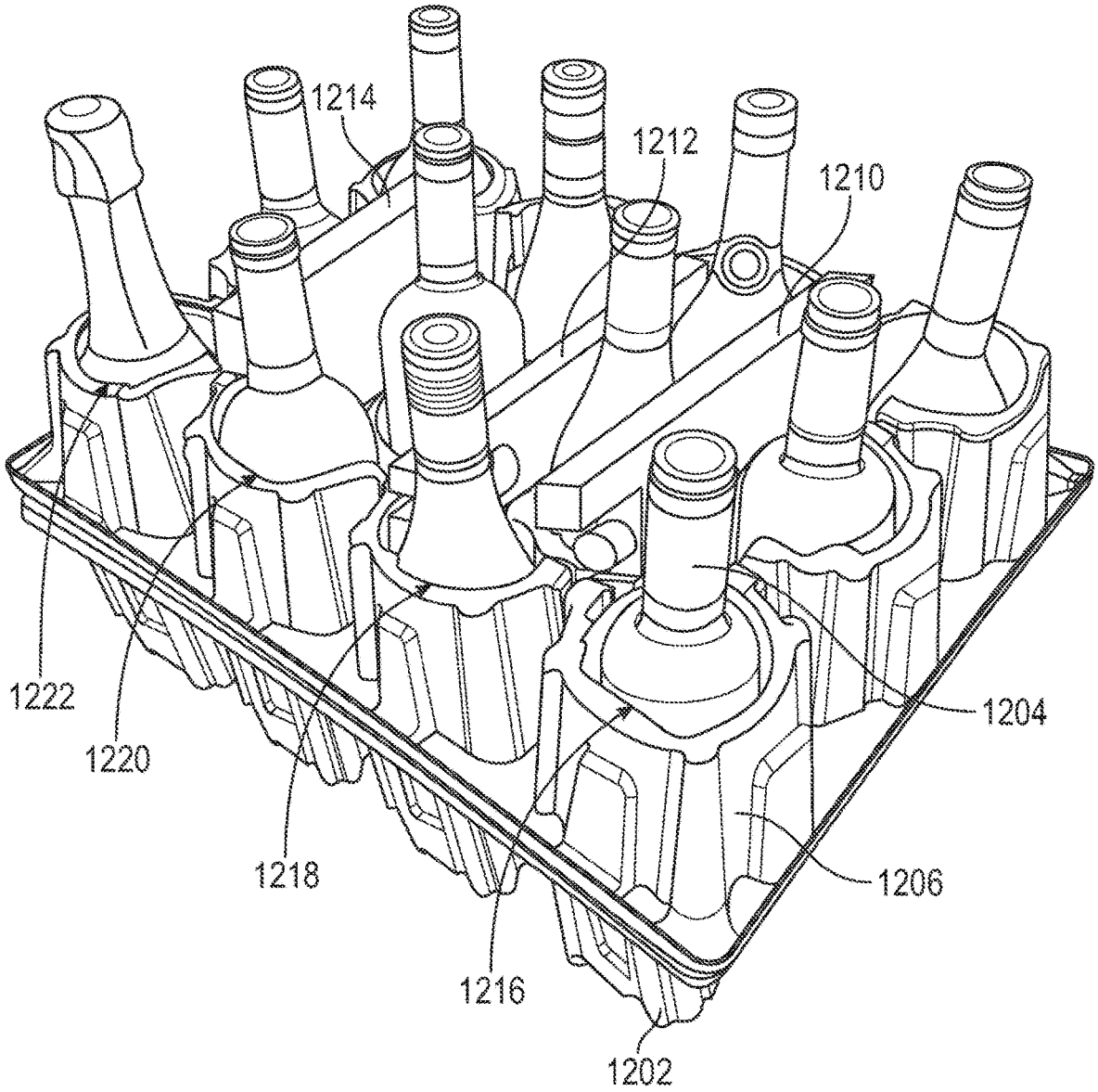
FIG. 12 depicts a first configuration of a bottom tray supporting twelve beverage containers, a center support disposed on the bottom tray, and three transport thermo packs disposed in the center support according to various embodiments.

FIG. 12 depicts a first configuration of a bottom tray supporting twelve beverage containers, a center support disposed on the bottom tray, and three transport thermo packs disposed in the center support according to various embodiments. In the example shown, a bottom tray 1202 houses twelve beverage containers 1204. A center support 1206 rests on the bottom tray 1202. The twelve beverage containers 1204 are arranged in four rows of three beverage containers. The center support 1206 is configured to accommodate transport thermo packs 1210, 1212, 1214. A transport thermo pack 1210 may be installed between a first row 1216 of beverage containers (e.g., through holes) and a second row 1218 of beverage containers such that the transport thermo pack 1210 extends linearly between a plurality of beverage containers of the first row 1216 and a plurality of beverage containers of the second row 1218. A transport thermo pack 1212 may be installed between the second row 1218 of beverage containers and a third row 1220 of beverage containers such that the transport thermo pack 1212 extends linearly between a plurality of beverage containers of the second row 1218 and a plurality of beverage containers of the third row 1220. A transport thermo pack 1214 may be installed between the third row 1220 of beverage containers and a fourth row 1222 of beverage containers such that the transport thermo pack 1214 extends linearly between a plurality of beverage containers of the third row 1220 and a plurality of beverage containers of the fourth row 1222.

As described herein, the transport thermo packs 1210, 1212, 1214 can be heating packs or cooling packs, so that the transport packs 1210, 1212, 1214 can heat or cool the beverage containers. The ability to heat or cool the beverage containers enables the assembly to be used to transport temperature-sensitive beverages. The transport thermo pack may directly contact the beverage containers to facilitate the transfer of energy between the transport thermo pack and the beverage containers. The transport thermo packs 1210, 1212, 1214 may directly contact at least a portion of the beverage containers 1204 to facilitate the transfer of energy between the transport thermo pack and the beverage containers. In some cases, the transport thermo packs 1210, 1212, 1214 may directly contact at least a portion of each beverage containers 1204 (e.g., all twelve beverage containers depicted in FIG. 12).

As described in detail herein, transport thermo packs 1210, 1212, 1214 may be contoured based on the packaging geometry, beverage containers, and/or other elements. Transport thermo packs 1210, 1212, 1214 may be shaped to accommodate the outer contour of a beverage container. The transport thermo packs 1210, 1212, 1214 may shaped to contact a portion of the surface of the beverage containers. For example, the width, height, and/or thickness of the transport thermo pack may be designed to accommodate the shape of a beverage container 1204.

In some embodiments, transport thermo packs 1210, 1212, 1214 are shaped to encapsulate at least a portion of the beverage containers. Transport thermo packs 1210, 1212, 1214 may, for example, fully encapsulate a single beverage container, a set of beverage containers, or all beverage containers in a package. A package may include multiple transport thermo packs 1210, 1212, 1214 each including different shapes. The shapes of each of the one or more transport thermo packs 1210, 1212, 1214 may be configured to accommodate the shapes of the beverage containers in the package.

In some embodiments, a transport thermo pack 1210, 1212, 1214 may be configured to control the temperature and humidity in the package. The transport thermo pack may, for example, increase the humidity in the package. In some cases, the transport thermo pack may absorb moisture in the package to decrease the humidity of the package. Humidity control may be useful in scenarios where beverage containers are transmitted in conjunction with food items, vegetation, tobacco products, medicines, and/or other material affected by humidity changes.

In various embodiments, a transport thermo pack (for example, the transport thermo packs 1210, 1212, 1214) may be, for example, an ice pack, or substance that can be cooled or frozen and can absorb thermal energy from the beverage containers and the environment, keeping the beverage containers cool. A thermo pack may include, for example, a plastic or other material that encloses a fluid or solid that absorbs thermal energy. In one example, the thermo pack includes a gel-based cold pack. In another example, the thermo pack includes ice, a solid that simulates ice, and/or other solid that absorbs thermal energy.

Alternatively, a transport thermo pack may be a heating pack that radiates thermal energy, thereby maintaining the beverage containers at a higher temperature than would be possible without a heating source. The center support according to various embodiments may accommodate a plurality of transport thermo packs. Each transport thermo pack may transmit thermal energy to or absorb thermal energy from one or more beverage containers. The transport thermo pack may be contoured to match the space between adjacent rows of beverage containers.

Figure 13:
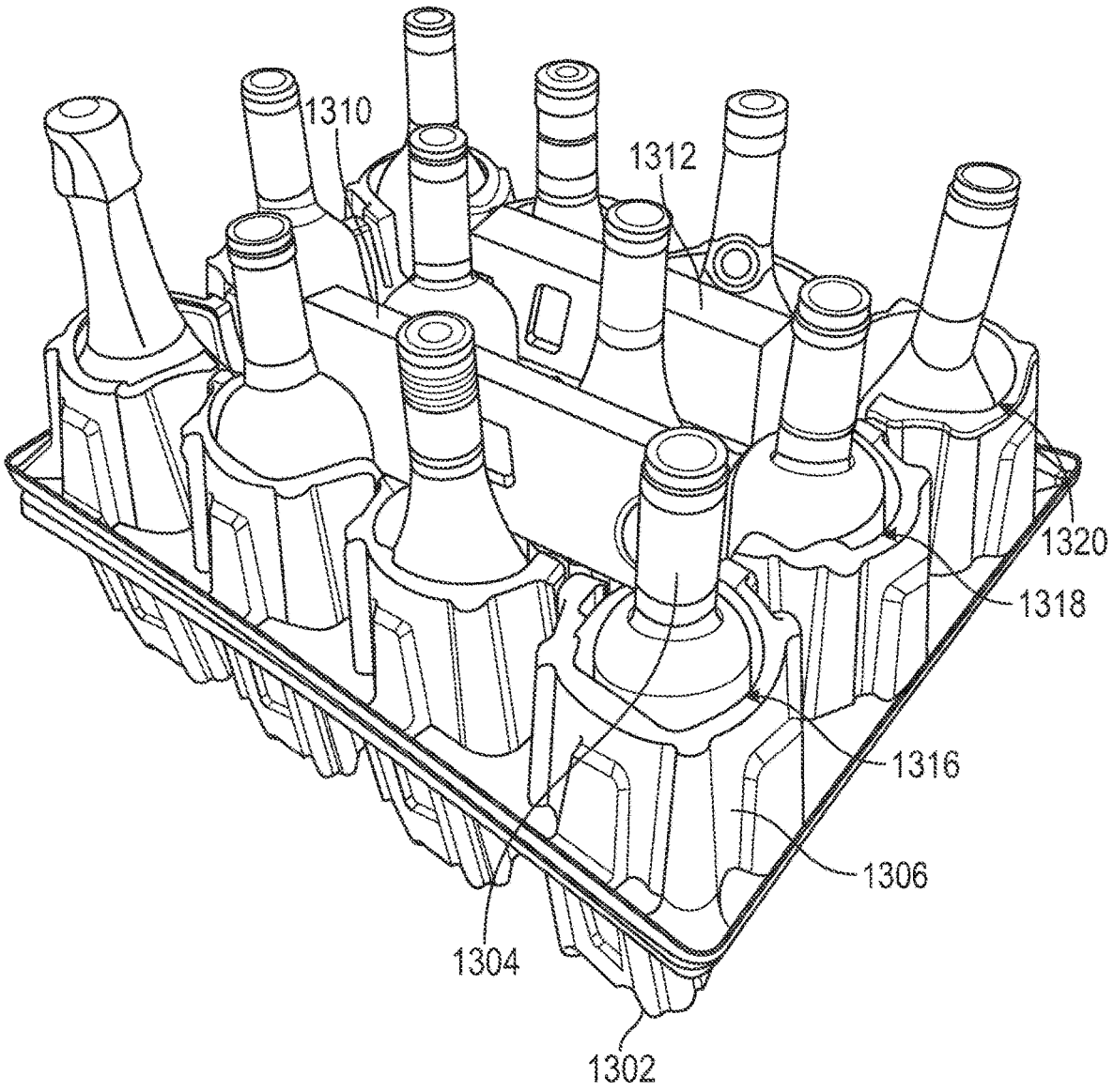
FIG. 13 depicts a second configuration of a bottom tray supporting twelve beverage containers, a center support disposed on the bottom tray, and two transport thermo packs disposed in the center support according to various embodiments.

FIG. 13 depicts a second configuration of a bottom tray supporting twelve beverage containers, a center support disposed on the bottom tray, and two transport thermo packs disposed in the center support according to various embodiments. In the example shown, a bottom tray 1302 and a center support 1306 supporting twelve beverage containers 1304 according to various embodiments. The twelve beverage containers 1304 are arranged in four rows of three beverage containers, or alternatively three columns 1316, 1318, 1320 of four beverage containers. The center support 1306 is configured to accommodate one or more transport thermo packs. In the example shown, two transport thermo packs 1310, 1312 are used. A transport thermo pack 1310 may be installed between a first column 1316 of beverage containers and a second column 1318 of beverage containers such that the transport thermo pack 1310 extends linearly between a plurality of beverage containers of the first column 1316 and a plurality of beverage containers of the second column 1318. A transport thermo pack 1312 may be installed between the second column 1318 of beverage containers and a third column 1320 of beverage containers such that the transport thermo pack 1312 extends linearly between a plurality of beverage containers of the first column 1318 and a plurality of beverage containers of the second column 1320.

The transport thermo packs 1310, 1312 may be similar to transport thermo packs 1210, 1212, 1214 of FIG. 12. The transport thermo packs 1310, 1312 may directly contact at least a portion of the beverage containers 1304 to facilitate the transfer of energy between the transport thermo pack and the beverage containers. In some cases, the transport thermo packs 1310 may directly contact at least a portion of each beverage containers 1304 (e.g., all twelve beverage containers depicted in FIG. 13). For example, transport thermo pack 1310 may contact the four beverage containers in the first column 1316 and the four beverage containers in the second column 1318. Transport thermo pack 1312 may contact the four beverage containers in the second column 1318 and the four beverage containers in the third column 1320.

As described in detail herein, transport thermo packs 1310, 1312 may be contoured based on the packaging geometry, beverage containers, and/or other elements. Transport thermo packs 1310, 1312 may be shaped to accommodate the outer contour of a particular beverage container. The transport thermo packs 1310, 1312 may shaped to contact a portion of the surface of the beverage containers. For example, the width, height, and/or thickness of the transport thermo pack may be designed to accommodate the shape of a beverage container 1304. Different transport thermo packs 1310, 1312 may be used depending the type of beverage containers transport, the beverages included therein, environmental factors (e.g., temperature, humidity, pressure, etc.) expected during transit, and/or a variety of other factors.

Figure 14:
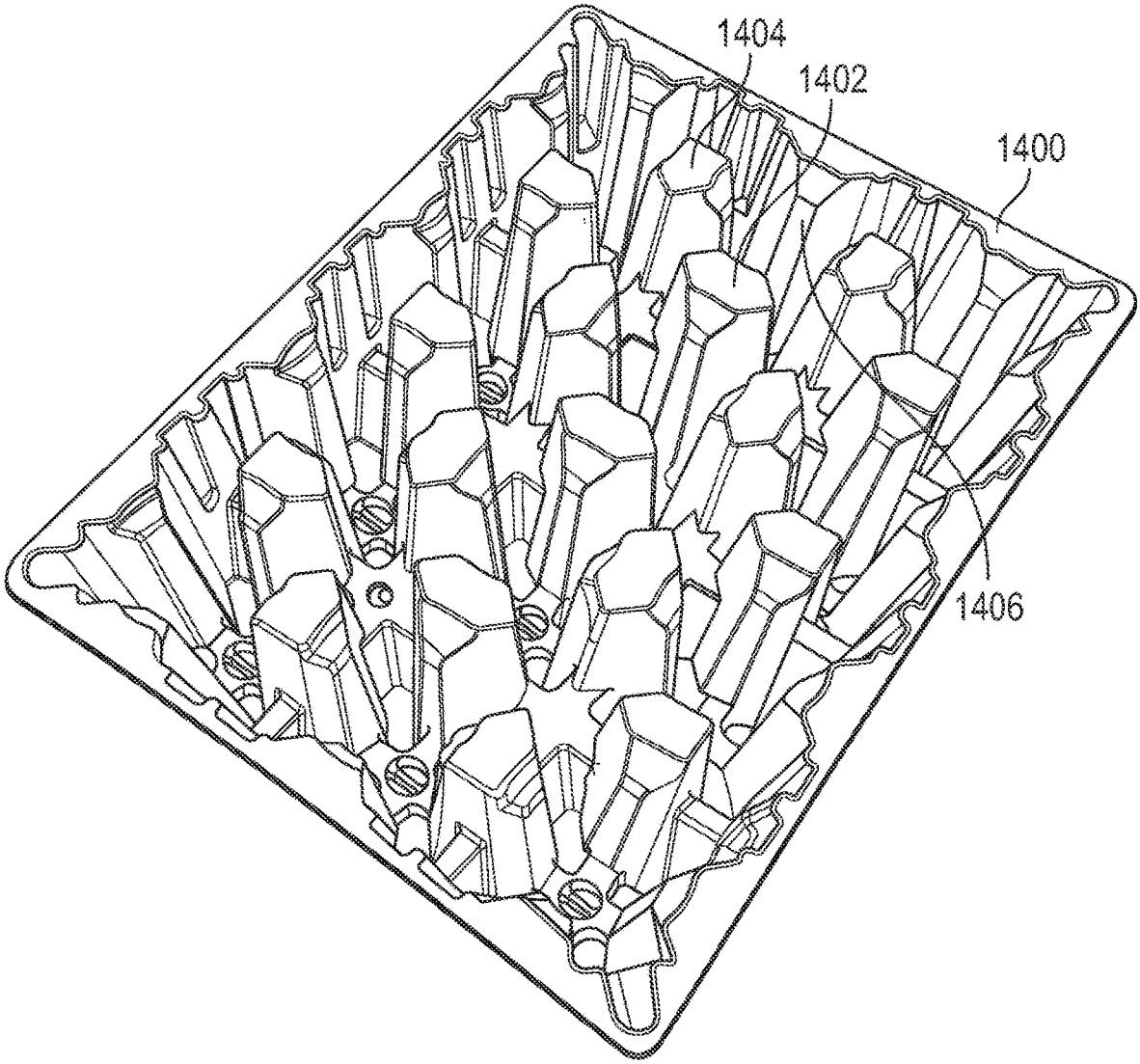
FIG. 14 depicts a top tray of a beverage container packing assembly according to some embodiments.

FIG. 14 depicts a top tray of a beverage container packing assembly according to some embodiments. In the example shown, the top tray 1400 (e.g., top tray 104 of FIG. 1) includes multiple vertical posts 1402, 1404. In certain cases, the vertical posts 1402, 1404 form the sides (bounds) of second compartments 1406 in the top tray 1400. The second compartments are configured to receive a portion of a beverage container therein, such as a neck of a wine bottle. The number of second compartments 1406 corresponds to a number of beverage containers the top tray 1400 is configured to accommodate. In the example shown, the top tray 1400 includes twelve second compartments 1406—three (3) rows of four (4) second compartments—and the top tray 1400 is configured to accommodate twelve beverage containers. Some of the vertical posts 1402, 1404 may be third support columns that that are configured to stack on top of the linear surface of the center support. For example, in FIG. 14, vertical post 1402 (e.g., support column) may be a third support column that is configured to stack on top the center support. A total number of the plurality of second support columns of the center support may be less than a total number of the plurality of third support columns.

Figure 15:
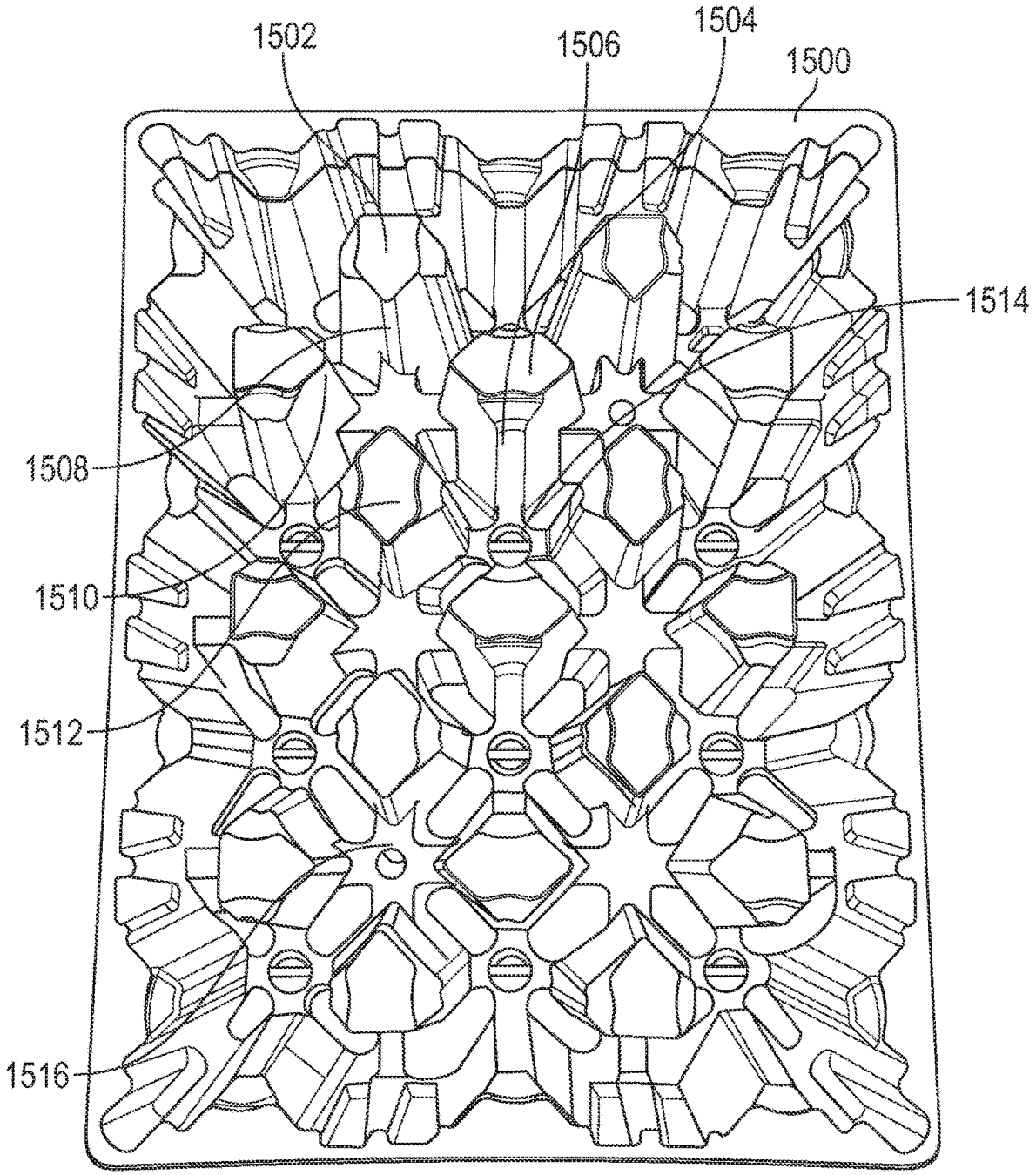
FIG. 15 depicts a second view of a top tray according to some embodiments.

FIG. 15 depicts a second view of a top tray according to some embodiments. In the example shown, the top tray 1500 includes multiple vertical posts 1502, 1504 that form second compartments 1506. For example, the vertical posts 1502, 1504 may include deformable elements 1508, 1510 that contact the neck of a beverage container and hold it in place during shipping. The deformable elements 1508, 1510 may also deform to absorb lateral loads applied to a bottle during transit. In some cases, the vertical posts 1502, 1504 may include trapezoidal deformable elements 1512 (e.g., protrusions) on a top of the vertical post 1502, 1504. The trapezoidal elements 1512 may contact portions of the center support.

In certain cases, a top end of the second compartments 1506 includes a circular depression 1514 (e.g., circular depressed region). The circular depression 1514 may accommodate the size of a wine cork such that the wine bottle rim contacts the top tray but not the cork, for example, when a load is applied down on the top tray 1500. The circular depression 1514 may include a thin deformable element bisecting the circular depression 1514.

In some embodiments, the top tray 1500 includes one or more holes 1516. Similar to the holes discussed with respect to other components of bottle packing assembly, the holes 1516 reduce vacuum generated when the top tray is placed into a box.

Figure 16:
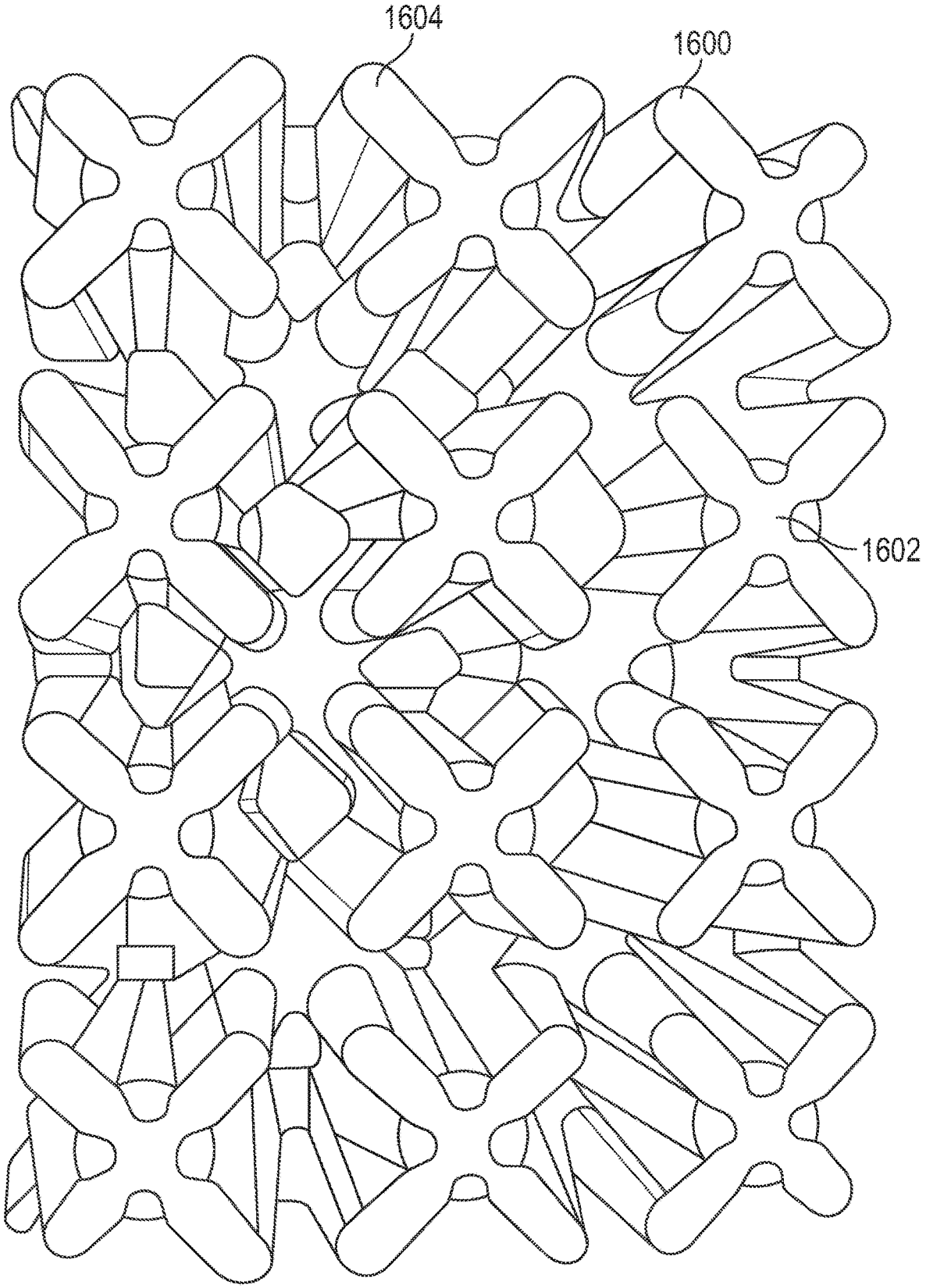
FIG. 16 depicts a third view of a top tray in an upright orientation according to various embodiments.

FIG. 16 depicts a third view of a top tray in an upright orientation according to various embodiments. In the example shown, the top tray 1600 includes the structure underlying the second compartments 1602 (e.g., the second compartments 1506 of FIG. 15). The top side (on assembly) of the top tray 1600 includes pulp paper. The top side of the second compartments 1602 may include cross-shaped protrusions 1604 (e.g., four protrusions meeting at a point in the example shown). The cross-shaped protrusions 1604 may absorb impact and reduce loads applied to the beverage containers during, for example, an impact event.

Figure 17:
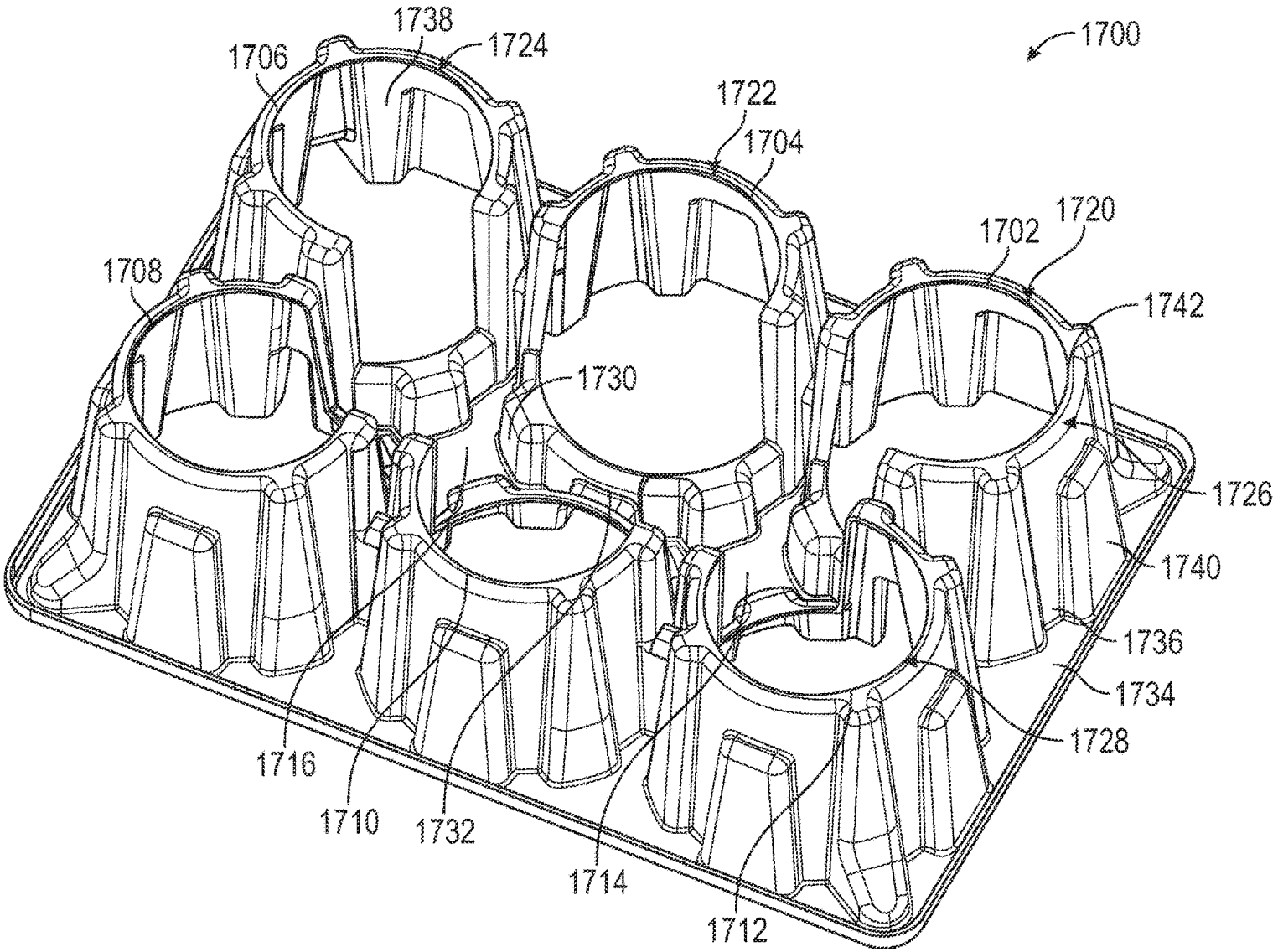
FIG. 17 depicts a center support of a beverage container packing assembly according to various embodiments.

FIG. 17 depicts a center support of a beverage container packing assembly according to various embodiments. In the example shown, a center support 1700 (also referred to as a support body) of a beverage container packing assembly is depicted. The center support 1700 in this example may be configured to accommodate six beverage containers. The center support 1700 defines a plurality of through holes 1702-1712. Each of the plurality of through holes 1702-1712 is configured to receive a portion of a beverage container therethrough. The center support 1700 may include support columns 1714, 1716 (two shown), which may include second support columns. The support columns 1714, 1716 are configured to stack on one or more first support columns of a bottom tray configured to accommodate six beverage containers.

In use, the center support 1700 is configured to accommodate one or more transport thermo packs. The transport thermo packs may be installed in various configurations in the center support 1700. The center support 1700 comprises multiple surfaces to accommodate installation of the thermo packs. In one example, transport thermo packs are placed between rows of a plurality of beverage containers. Transport thermo packs are placed, for example, between a first row 1720 and a second row 1722 of a plurality of beverage containers such that the transport thermo pack extends linearly between a plurality of beverage containers of the first row 1720 and a plurality of beverage containers of the second row 1722. For example, two beverage containers could be disposed in the two through holes 1702, 1712, forming a first row 1720, and two beverage containers could be disposed in the two through holes 1704, 1710, forming a second row 1722. Two beverage containers may be disposed in two through holes 1706, 1708 forming a third row 1724, and so on. Additional transport thermo packs may be installed between the second row 1722 and the third row 1724. The center support 1000 is configured to accommodate transport thermo packs between the first row 1720 and a second row 1722 and/or between the second row 1722 and third row 1724. The center support 1700 allows the thermo packs to be installed between the beverage containers, while maintaining the structural integrity of the packaging.

In another example, transport thermo packs are placed between columns of a plurality of beverage containers. Transport may be placed between a first column 1726 (e.g., columns may refer to rows of more than two through holes in the example shown) and second column 1728 of a plurality of beverage containers. The terms row and columns may be used interchangeably when referring to sets of through holes or beverage containers. The transport thermo pack may extend linearly between a plurality of beverage containers (or through holes) of the first column 1726 and a plurality of beverage containers of the second column 1728. For example, three beverage containers could be disposed in the three through holes forming a first column 1726, and three beverage containers could be disposed in the three through holes forming a second column 1728. Transport thermo packs may be installed between the first column 1726 and the second column 1728.

As discussed herein, the transport thermo pack may be, for example, an ice pack, or substance that can be cooled or frozen and can absorb thermal energy from the beverage containers and the environment, keeping the beverage containers cool. Alternatively, the transport thermo pack may be a heating pack that radiates thermal energy, thereby maintaining the beverage containers at a higher temperature than would be possible without a heating source. The center support 1700 according to various embodiments may accommodate a plurality of transport thermo packs. Each transport thermo pack may transmit thermal energy to or absorb thermal energy from one or more beverage containers. The transport thermo pack may be contoured to match the space between adjacent rows or columns of beverage containers.

According to various embodiments, a support column 1714 extend between a first row 1720 and a second row 1722 of beverage containers. A support column 1716 also extends between the second row 1722 and the third row 1724. According to various embodiments, support columns 1714, 1716 may extend between a first column 1726 and second column 1728 of beverage containers.

In some embodiments, the support columns 1714, 1716 resemble a star, cross, or x-shaped cup. A support column 1714, 1716 may include one or more protruding elements 1730. The support columns 1714, 1716 may be connected by a channel element 1732 (e.g., channel portion, recessed portion).

According to various embodiments, the center support includes a plurality of support columns 1714, 1716 The total number of the support columns may be equal, less than, and/or greater than the total number of the one or more first support columns of a bottom tray. The second support columns 1714, 1716 provide structural support and/or rigidity as the packaging is exposed to loading and impact during transit. For example, the second support columns 1714, 1716 transmit load between the top tray and bottom tray when the package is subjected to vertical loading. In certain cases, load from the top tray is transferred through the walls of the through holes, into the support columns, and into the first support columns of the bottom tray. For example, the center support 1700 may include two second support columns 1714, 1716 while the bottom tray includes an equal number of support columns.

The center support 1700 may include a lower edge 1734 that forms a perimeter around the through holes. The lower edge 1734 may extend to an inner surface of a box or other container in which the beverage packing assembly is disposed. The lower edge 1734 may connect to the walls 1736 defining the through holes on the edges of the center support 1700. Each of the through holes of the center support 1700 is at least partially defined by a wall. In certain cases, each of the through holes on the corners of the center support 1700 (e.g., through holes 1702, 1706, 1708, 1712) are partially defined by a wall 1736 that is configured to extend more than 180 degrees around the beverage container. In certain cases, the wall 1736 includes multiple deformable elements 1740 (e.g. protrusions that form an undulating surface along the wall 1736). In various embodiments, the wall defining the certain through holes may be configured to extend about 270 degrees around the beverage container. In certain cases, some through holes may be configured to extend less than or equal to 180 degrees around the beverage container. One or more of the through holes along the edges of the center support 1700 that are not on the corners of support 1700 (e.g., through holes 1704, 1710) are partially defined by a wall that is configured to extend 180 degrees or less around the beverage container. The walls of adjacent through holes may connect to form a continuous, undulating surface 1738 along the side of the center support 1700. The walls may have an inverted cup-like shape, with the walls tilting inward slightly from the edge 1734 at the base of the center support 1700 to the through holes as the top 1742 of the center support. In certain cases, the walls may include draft, such as a seven-degree draft, for example to enable the center tray to be easily removed from a mold during fabrication.

In certain cases, the through holes are contoured to fit particular types of bottles. The through holes may be various shapes, such as circular, a shape defined by multiple radii, oval, rectangular, and/or any shape. In some configurations, one or more of the through holes may include different sizes and/or shapes. For example, one or more of the through holes may configured for smaller bottle, while other through holes are configured for larger bottles.

Although the center support depicted in FIG. 17 according to various embodiments includes six through holes with two support columns 1714, 1716 this disclosure is not limited to this configuration and is intended to encompass a wide variety of center support designs. The center support 1700 may include more or fewer through holes and more or fewer support columns. Further, the second support columns 1714, 1716 may have different positions than those shown in the drawings. The second support columns 1714, 1716 may have alternative positions that still allow the center support to accommodate a transport thermo pack.

Figure 18:
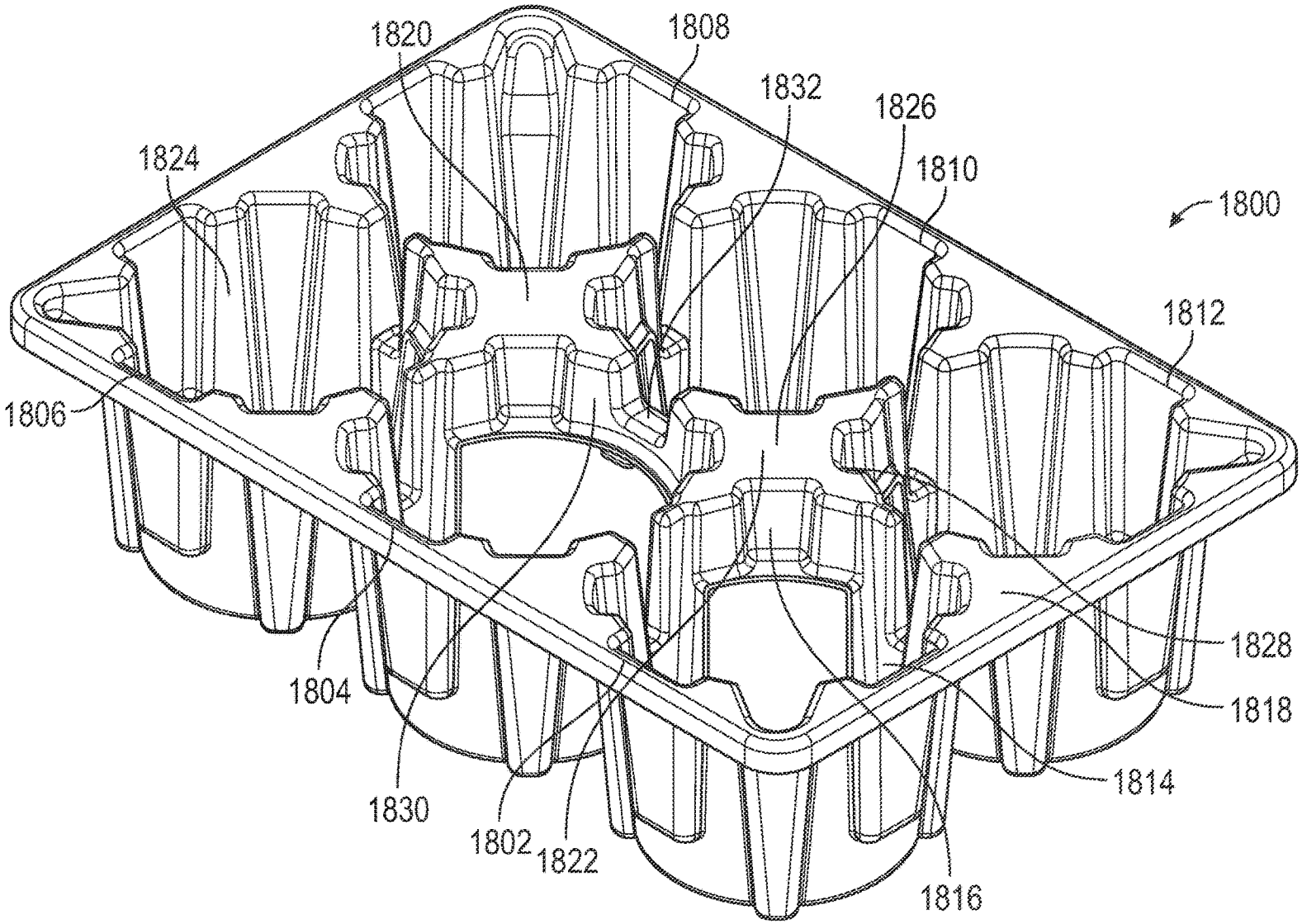
FIG. 18 depicts an underside view of a center support according to various embodiments.

FIG. 18 depicts an underside view of a center support according to various embodiments. In the example shown, a center support includes multiple through holes 1802-1812. The through holes may be defined by one or more side walls. For example, corner through hole 1802 may include at least two sides: a first side wall 1814, a second side wall 1816, and/or other side walls. A first side wall 1814 may extend from the bottom surface 1818 to the top surface (not shown) of the center support 1800. As shown, the first side wall 1814 may be configured to surround more than half of a beverage container. The second side wall 1816 extends from the bottom surface 1818 to a point short of the top surface of the center support 1800 (e.g., the second side wall does not extend the entire length between bottom surface 1818 and the top surface of the center support 1800). The second side wall 1816 may be shorter than the first side wall 1814. The second side wall 1816 may include a portion of the support columns 1820, 1822. The side wall(s) 1814 may define the through holes along the edges of the center support 1800 that form a continuous, undulating surface that surrounds all six of the through holes, providing support and protection for the beverage containers disposed therein. The side walls 1814 may also include deformable elements 1824. The deformable elements 1824 may contact the beverage container and/or secure the beverage containers in place during transit. The deformable elements 1824 may also be configured to deform when a load is applied to the beverage container packaging. When the deformable elements 1824 flex, the center support 1800 absorbs the impact of any load applied and protects the beverage containers from damage. In certain cases, the deformable elements 1824 may include de-nesting lugs and may aid in de-nesting a stack of nested center supports.

In various embodiments, the center support 1800 includes one or more support columns 1820, 1822. In the example shown, the center support 1800 includes two support columns 1820, 1822. The support columns 1820, 1822 may include and/or correspond to the support columns 1714, 1716 of FIG. 17. In certain cases, the support columns 1820, 1822 may include the shape of star-shaped posts, cross-shaped contoured posts, Chinese star shaped posts, rectangular shaped posts, rhomboid shaped posts, and/or other elements. The second support columns 1820, 1822 include a diamond-shaped inner portion 1826 (e.g., square and/or rectangular shaped inner portion) and star point elements 1828 that extend away from the center of the support columns 1820, 1822. The star-point elements 1828 may extend, for example, at ninety-degree angles (e.g., orthogonal to one another) to form the shape of a star and/or cross. In certain cases, the support columns 1820, 1822 include deformable elements 1830. The deformable elements 1830 may contact the beverage container and/or secure the beverage containers in place during transit. The deformable elements 1830 may also be configured to deform when a load is applied to the beverage container packaging. In certain cases, the deformable elements 1830 of the support columns may function similar to the deformable elements 1824. In certain cases, a center support 1800 includes recessed elements 1832 elements between the posts 1820, 1822. The recessed elements 1832 between posts 1820, 1822 allow the posts 1820, 1822 to tilt relative to one another and the center support 1800 to flex during use.

According to some embodiments, the support columns 1820, 1822 may be hollow and have an inverted shape with respect to the shape of the first support columns of the bottom tray. In certain cases, the first support columns of a bottom tray may be hollow and may have a width that tapers to a flat upper surface. When the center support 1800 is in an upright orientation, as in FIG. 17, the second support columns 1820, 1822 have a width that tapers to a flat lower surface, thus having an inverted shape with respect to the shape of the first support columns of the bottom tray. The flat surfaces of the center support columns 1820, 1822 contact the flat upper surfaces of the bottom tray support columns. When the support columns of the bottom tray contact the support columns 1820, 1822 a load path is generated transfer any applied loads through the centers support 1800 and into the bottom tray, while reducing loading on and damage to the beverage containers.

In various embodiments, the second support columns 1820, 1822 may be connected to form adjoining support columns. The adjoining columns may include to adjoined towers with two distinct high points. The adjoining columns in certain cases may resemble multiple towers adjoined by a lower base portion. There may include for example a U-shaped or V-shaped recessed elements (depressions) 1832 between the two high points of the columns. This configuration may be advantageous in, for example, improving the structural strength of the packaging.

Figure 19:
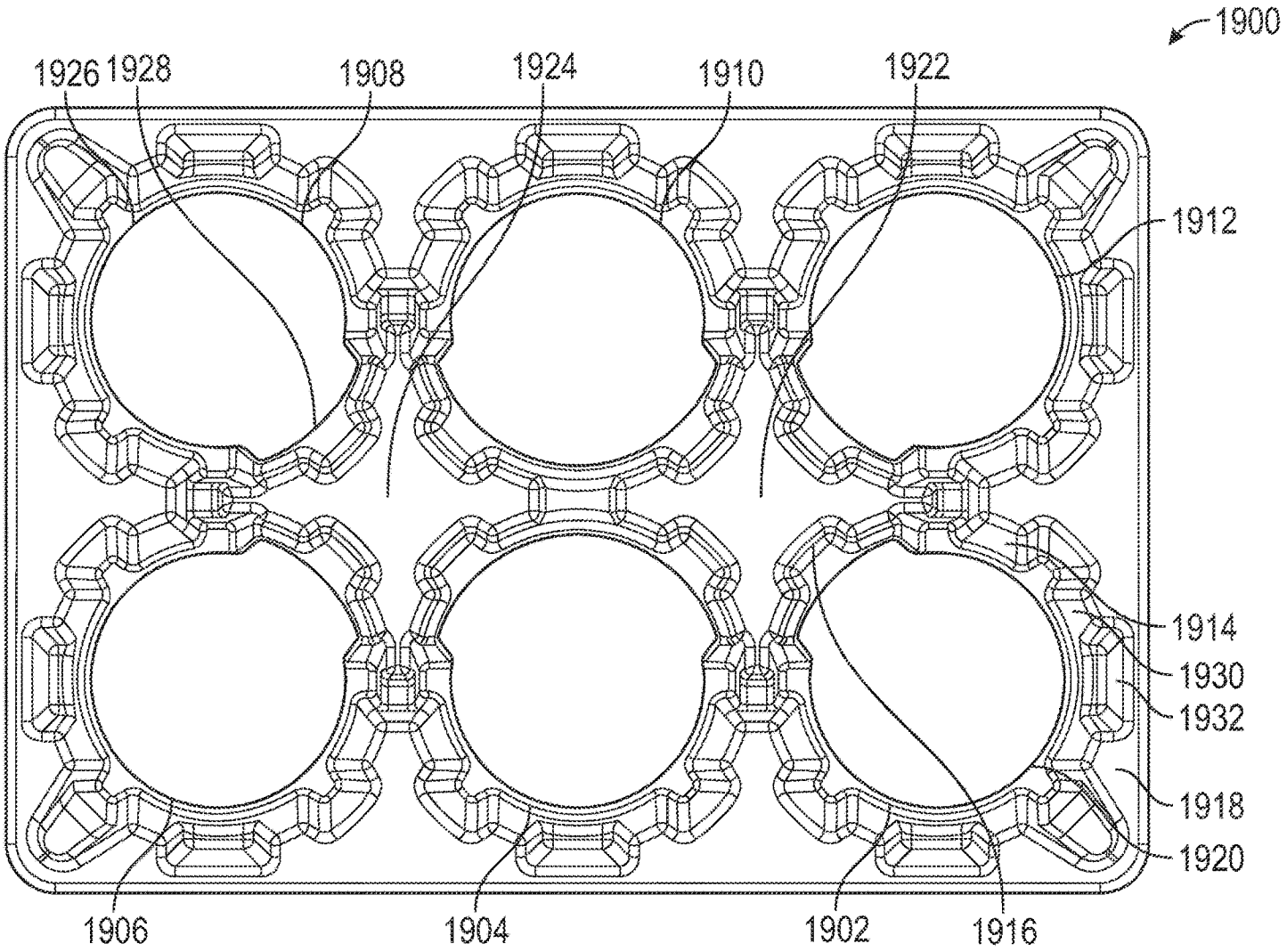
FIG. 19 depicts an underside view of a center support according to various embodiments.

FIG. 19 depicts an underside view of a center support according to various embodiments. In the example shown, a center support includes multiple through holes 1902-1912 (e.g., six through holds in the example shown). The through holes 1902-1912 include a cut out defined by multiple radii. For example, a first portion of the through hole 1926 is defined by a first radius, and a second portion of the through hole 1928 is defined by a second radius. In certain cases the second radius may be larger than the first radius. The first portion of the through hole 1926 may extend around 180 degrees or more of the hole, and the second portion 1928 may extend around less than 180 degrees. The size of the first portion 1926 and second portion 1928 may vary dependent on the location of the through hole 1902-1912. For example, through holes 1902, 1906, 1908, 1912 located on the corners of the center support 1900 may include larger first portion 1926 (e.g., a first portion of greater circumference) than the first portions in holes 1904, 1910 that are located on the sides of the center support 1900 (e.g., not on the corners).

In various embodiments, the through holes may be defined by one or more side walls. For example, corner through hole 1902 may include at least two sides walls: a first side wall 1914, a second side wall 1916, and/or other side walls. A first side wall 1914 may extend from the bottom surface 1918 to the top surface 1920 of the center support 1900. As shown, the first side wall 1914 may be configured to surround more than half of a beverage container. The second side wall 1916 extends from the bottom surface 1918 to a point short of the top surface 1920 of the center support 1900 (e.g., the second side wall does not extend the entire length between bottom surface 1918 and the top surface 1920 of the center support 1900). The second side wall 1916 may be shorter than the first side wall 1914 (e.g., shorter in height from bottom to top). The second side wall 1916 may include a portion of the support columns 1922, 1924. The second side walls 1916 may form the sides of the support columns 1922, 1924.

According to some embodiments, the side wall(s) 1914 form a continuous, undulating surface that surrounds all six of the through holes, providing support and protection for the beverage containers disposed therein. The side walls 1914 may include one or more protrusions 1930 (e.g., deformable elements) and depressions 1932 around the circumference of the through hole 1902. In certain instances, the protrusions 1930 and depressions 1932 form an undulating surface that around at least a portion of the circumference of the through hole 1902. The protrusions 1930 may contact the beverage container and/or secure the beverage containers in place during transit. The protrusions 1930 may also be configured to deform when a load is applied to the beverage container packaging. When the deformable elements 1930 flex, the center support 1900 absorbs the impact of any load applied and protects the beverage containers from damage. In certain cases, the deformable elements 1930 may include de-nesting lugs and may aid in de-nesting a stack of nested center supports.

Figure 20:
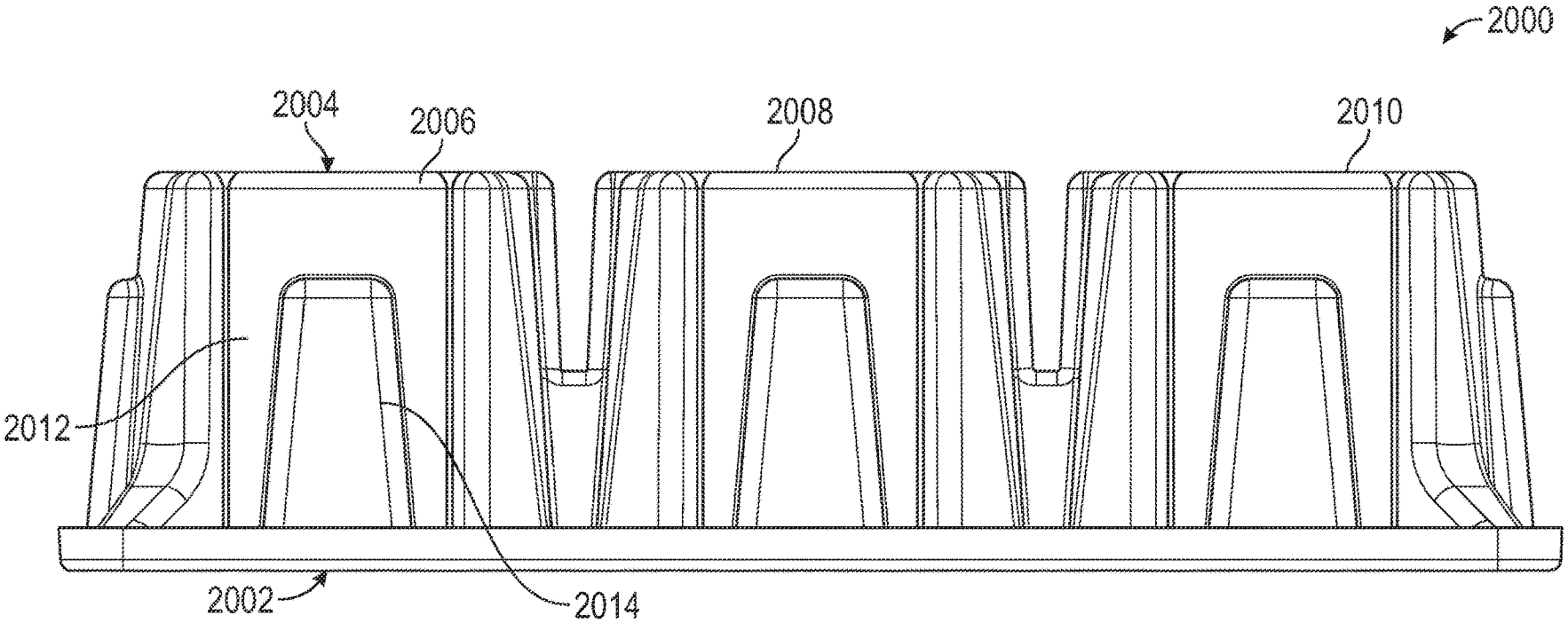
FIG. 20 depicts side view of a center support according to various embodiments.

FIG. 20 depicts side view of a center support according to various embodiments. In the example shown, a beverage container center support 2000 includes a bottom surface 2002 and a top surface 2004. The beverage container center support 2000 includes beverage container accommodating spaces 2006, 2008, 2010. The beverage container accommodating spaces 2006, 2008, 2010 may include through holes as described herein. In certain cases a wall 2012 surrounding the beverage container accommodating spaces 2006, 2008, 2010 includes multiple protruding elements 2014 (e.g., deformable elements). The wall 2012 in certain cases may include an undulating shape.

Figure 21:
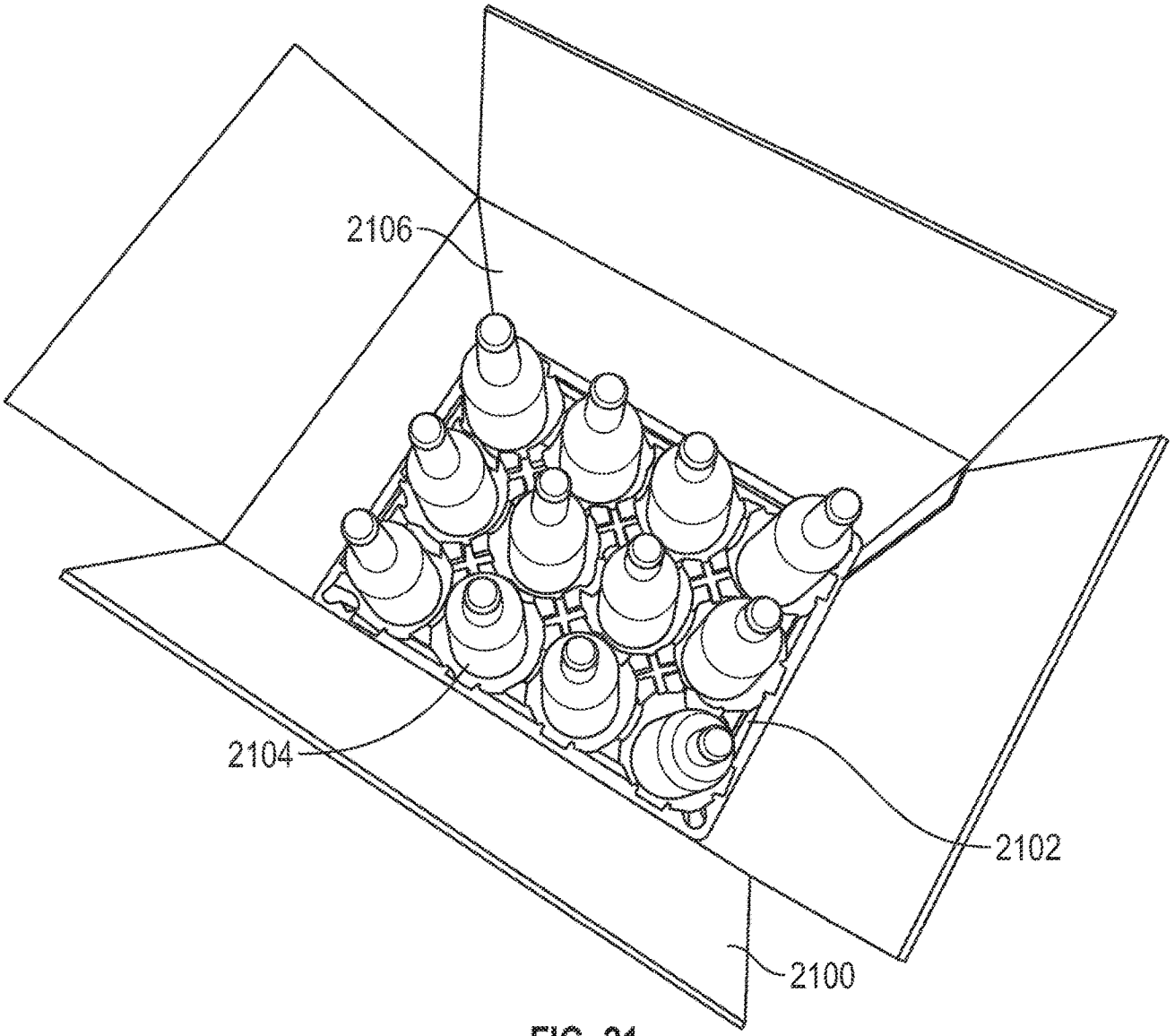
FIG. 21 depicts an example shipping container according to various embodiments.

FIG. 21 depicts an example shipping container according to various embodiments. As shown in FIG. 21, the bottom tray 2102 extends to the inner surface 2106 of the shipping container 2100. In use, the bottom tray 2102 is placed in the shipping container 2100. The beverage containers 2104 are placed in the bottom tray 2102. In a subsequent step as depicted in FIG. 21, a center support and thermo transport packs are placed in to the shipping container 2100.

Figure 22:
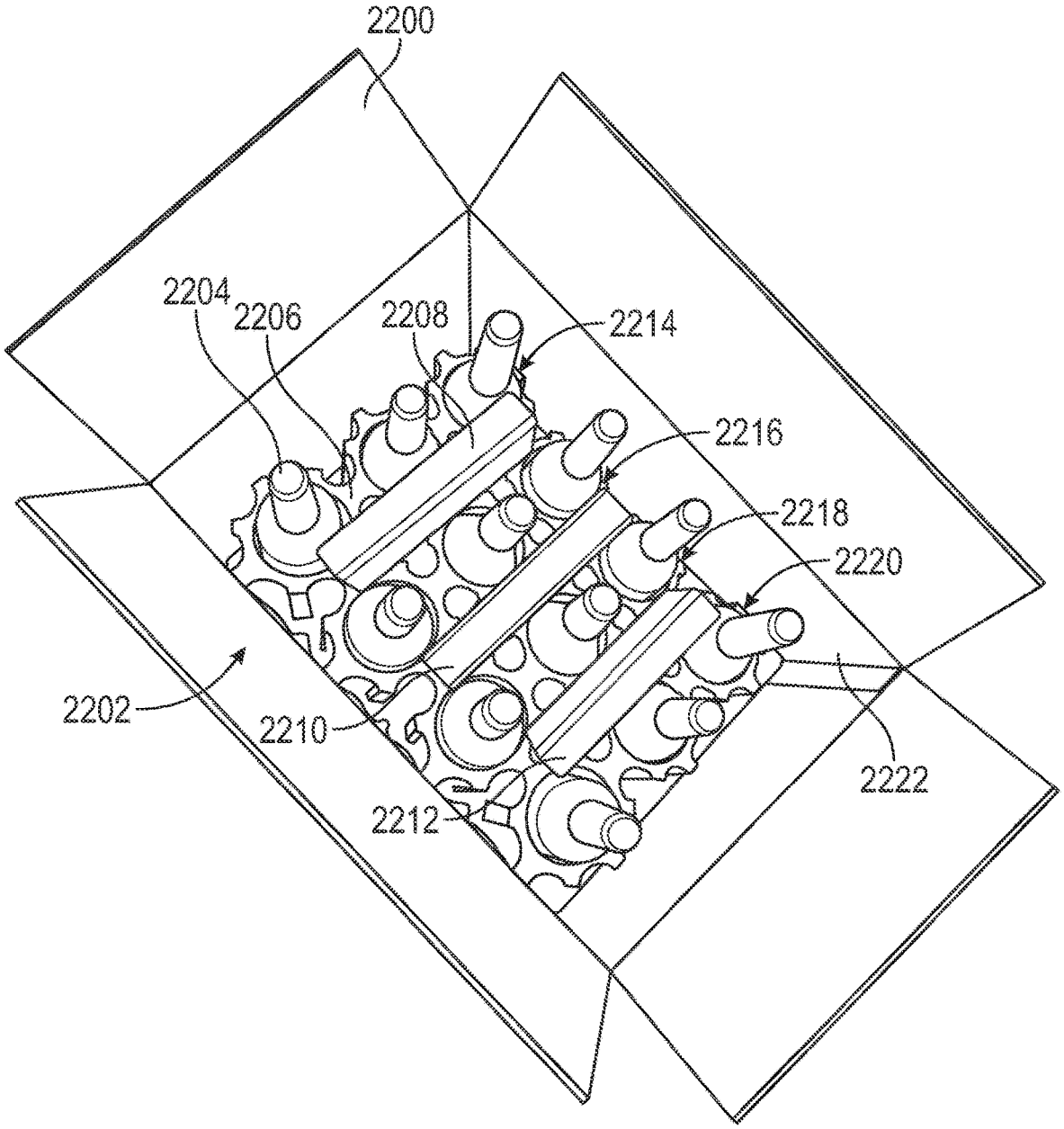
FIG. 22 depicts an example shipping container with a bottom tray and center support disposed therein according to various embodiments.

FIG. 22 depicts an example shipping container according to various embodiments. In the example shown, a shipping container 2200 includes the following: a bottom tray 2202, beverage containers 2204, a center support 2206, transport thermo packs 2208, 2210, 2212, and/or other elements. The bottom tray 2202 is disposed in a shipping container 2200, for example, a cardboard box. Beverage containers 2204 are placed in the bottom tray 2202. In the example shown, 12 beverage containers 2204 are placed in the bottom tray 2202. The center support 2206 is disposed in a shipping container 2200. The center support 2206 may be placed on the bottom tray 2202 and may surround the beverage containers 2204. The center support 2206 extends to the inner surface 2222 of the shipping container 2200. The center support 2206 may be similar to center support 1000 of FIG. 10, center support 1100 of FIG. 11, center support 1206 of FIG. 12, and/or center support 1306 of FIG. 13.

The center support 2206 accommodates transport thermo packs 2208, 2210, 2212. Transport thermo packs 2208, 2210, 2212 are placed between rows of beverage containers, such that for example the transport thermo packs 2208, 2210, 2212 contact each of the beverage containers 2204. For example, a first transport thermo pack 2208 may be installed between a first row 2214 and second row 2216 of beverage containers, a second transport thermo pack 2210 may be installed between the second row 2216 and a third row 2218 of beverage containers, and a third transport thermo pack 2212 is installed between the third row 2218 and a fourth row 2220 of beverage containers.

In some embodiments, the shipping container 2200, the bottom tray 2202, the center support 2206, and/or the top tray (not shown) may include a water-resistant coating. For example, a coating may be applied to the molded paper pulp such that the paper pulp maintains its shape in the presence of moisture. The transport thermo pack disposed between the bottom tray and the center support may leak, or a temperature difference between the atmospheric temperature and the temperature of the transport thermo pack may cause condensation to form. By coating the bottom tray, the center support, and the top tray with a water-resistant coating, the assembly can maintain its shape and provide support and cushioning for the beverage containers.

The coating according to various embodiments is a water-based additive that is mixed in the paper slurry before the actual molding cycle. Less than 3% of water used in production is made of the additive. The water-based material does not outgas, deform, or add any negative effects to the parts and environment. It does, however, add slight moisture and/or water resistance. This reduces the likelihood of degradation during use with thermo packs, product transportation, and shipping through humid areas. The outer shipping container may not need any coating as the pulp inners may retain moisture with the bottom cavities, such as the first compartments of the bottom tray. The additive to the pulp allows the paper material to absorb moisture and pull moisture from wine labels. The additive to the pulp also allows the paper material to exchange moisture with the atmosphere, thereby allowing the bottom tray, the center support, and/or the top tray to expel moisture without degrading their structural integrity.

In some embodiments, the container 2200, bottom tray 2202, center support 2206, top tray (no shown), and/or other components of the packaging may include material sufficiently thick to withstand environmental effects (e.g., condensation, humidity, etc.) associated with the thermo packs. For example, the bottom tray, center support, and/or top tray may include thick molded paper pulp to withstand the environmental effects resulting from inclusion of a thermos pack in the packaging assembly.

After the beverage packing assembly and the beverage containers have been disposed in the shipping container, the shipping container may be sealed by, for example, closing the flaps of the box and/or applying tape. The shipping container may be then be shipped to its recipient. And upon receipt, a recipient may perform the inverse (opposite) of these steps to unpack the beverage container packing assembly.

In various embodiments, these and other steps to assemble and disassemble a container packing assembly may be performed in other sequences to achieve similar results.

Figure 23:
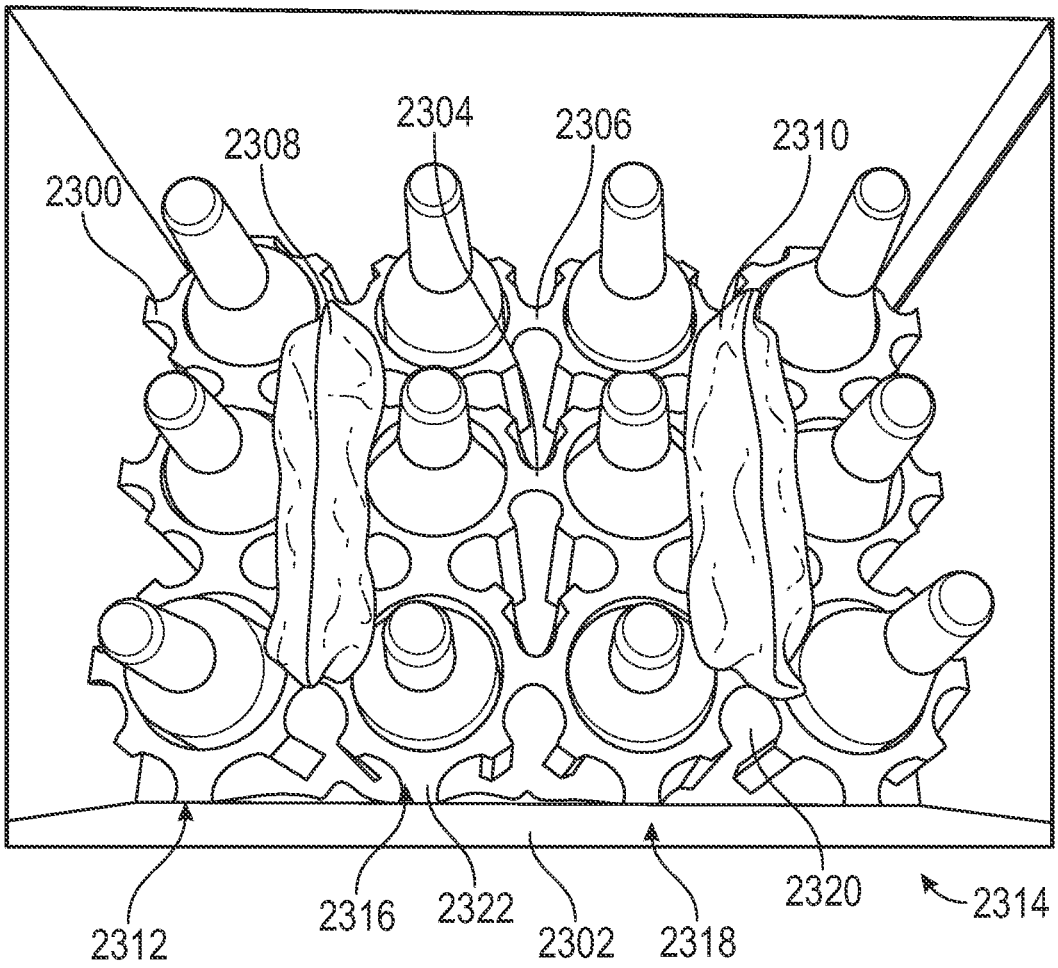
FIG. 23 depicts an example shipping container with a bottom tray and center support disposed therein according to various embodiments.

FIG. 23 depicts an example shipping container with a bottom tray and center support disposed therein according to various embodiments. FIG. 23 shows a center support 2300 according to various embodiments. The center support 2300 is disposed in a shipping container 2302, for example, a cardboard box. The center support 2300 includes star-shaped structures 2304, 2306 bisecting the center support 2300. The center support 2300 also accommodate transport thermo packs 2308, 2310 between the outer row 2312, 2314 and the inner rows 2316, 2318 of the beverage containers. The star-shaped structures 2304, 2306 may stack on first support columns of a bottom tray, and may provide support for third support columns of a top tray. The star-shaped structures 2304, 2306 may form hollow columns that are open at the top, and closed at the bottom. The outer walls of the center support 2300 may include repeating half-star shapes 2320. The vertices 2322 between adjacent half-star shapes 2320 may protrude to the inner surface of the shipping container 2302, preventing the beverage containers from moving laterally during transit.

The center support 2300 may include similar features to center support 1000 of FIG. 10, center support 1100 of FIG. 11, center support 1206 of FIG. 12, and/or center support 1306 of FIG. 13. One potential difference in center support 2300 relative to center supports 1000, 1100, 1206, and 1306 may include the star-shaped structures 2304, 2306 bisecting the center support 2300. The star-shaped structures 2304, 2306 may provide additional support and rigidity in the center of the packaging. In certain cases, the star-shaped structures 2304, 2306 may accommodate thermo transport packs. For example, a smaller or custom shaped thermo transport pack.

Figure 24:
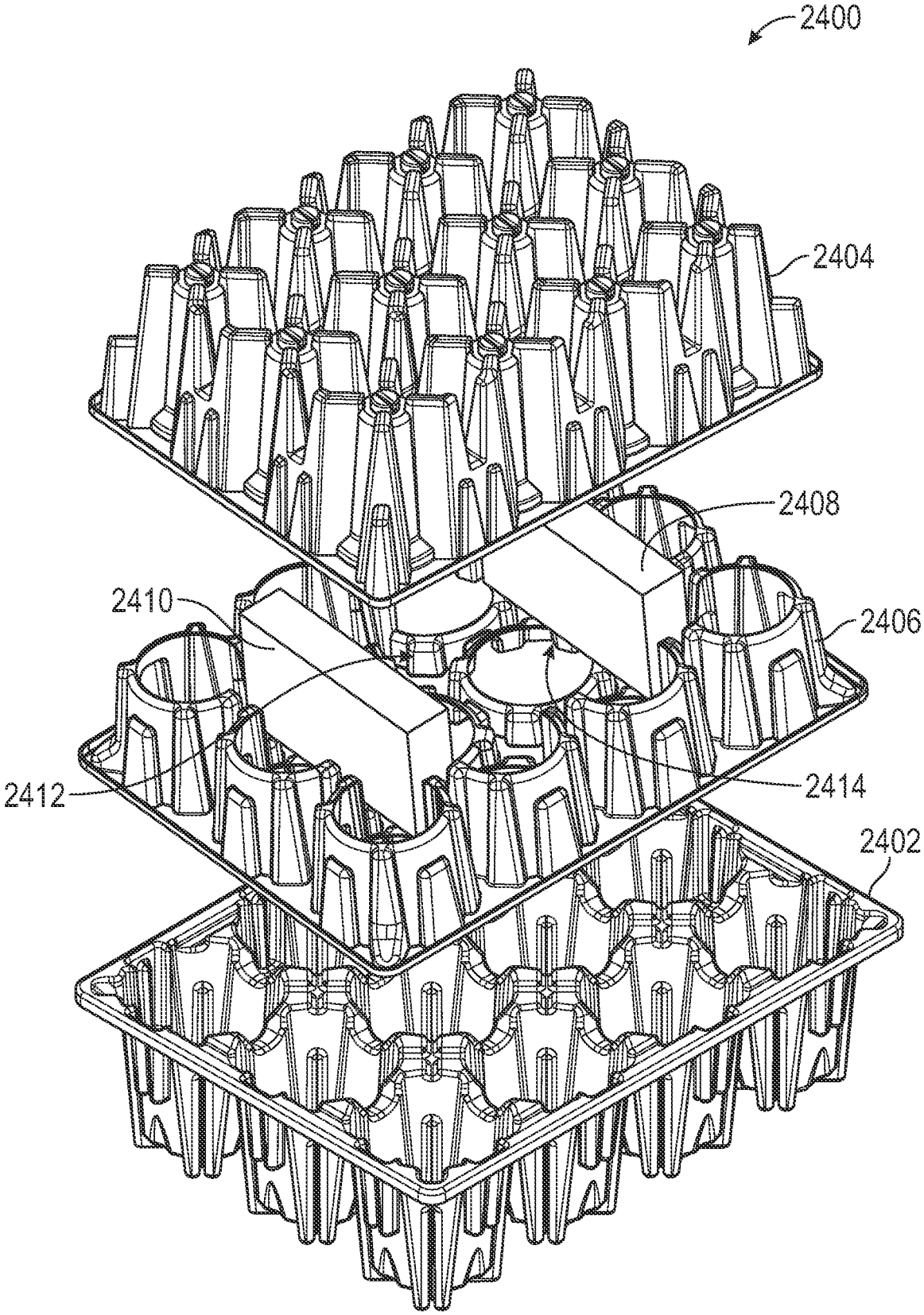
FIG. 24 depicts a beverage container packing assembly according to various embodiments.

FIG. 24 depicts a beverage container packing assembly according to various embodiments. In the example shown, a beverage container packing assembly 2400 may include a bottom tray 2402 (e.g., bottom element), a top tray 2404 (e.g., a top element), a center support 2406 (e.g., center support element, partition element), transport thermo packs 2408, 2410, and/or other components. The beverage container packaging assembly 2400 is configured to package a plurality of beverage containers for transit. In the example shown, the beverage container packing assembly 2400 is configured to package twelve (12) beverage containers (not shown). The center support 2406 separates the bottom tray 2402 and top tray 2404. The top tray 2404 rests on the center support 2406. The transport thermo packs 2408, 2410 are installed on center support 2406. Center support 2406 may include, for example, transport thermo pack accommodating spaces 2412, 2414 (e.g., center tray thermo pack accommodating spaces). The center tray thermo pack accommodating spaces 2412, 2414 may be sized to accommodate the transport thermo packs 2408, 2410. The center tray thermo pack accommodating spaces 2412, 2414 are configured and positioned to allow the transport thermo packs 2408, 2410 to be housed in the same packing tray with the beverage containers and at least partially in contact with one or more beverage containers. The top tray 2404 includes thermo pack accommodating spaces. The top of the beverage container is encapsulated in a compartment of the top tray 2404. The center support 2406 prevents the beverage containers from contacting during shipping and provides spacing between the bottom tray 2402 and top tray 2404. As discussed in detail herein, the center support 2406 is also configured to accommodate one or more transport thermo packs (not shown) that contact the beverage containers and/or maintain the beverage containers within in desired temperature range during transit.

Figure 25:
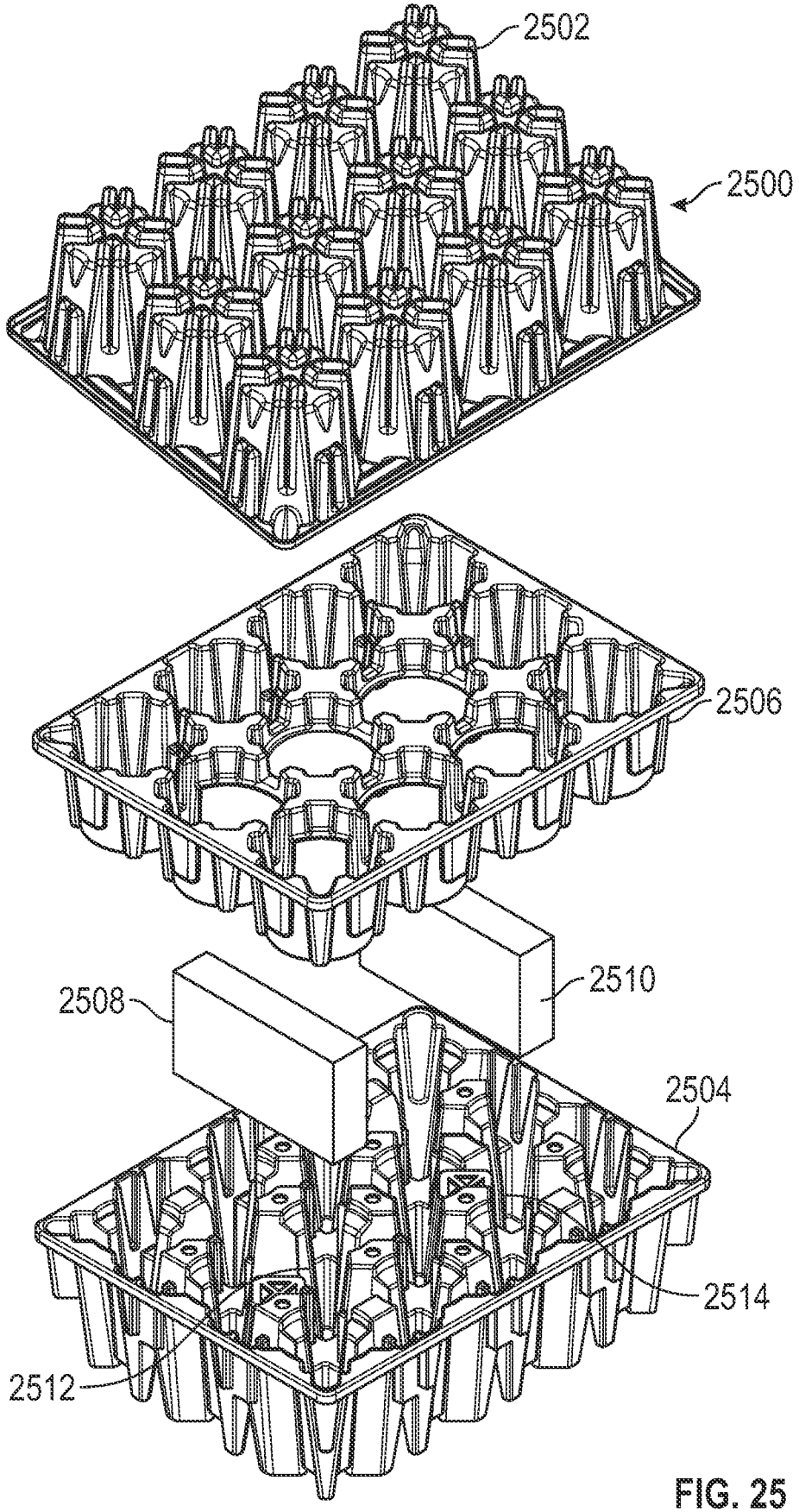
FIG. 25 depicts a beverage container packing assembly according to various embodiments.

FIG. 25 depicts a beverage container packing assembly according to various embodiments. The beverage container packing assembly 2500 of FIG. 25 may be similar to the beverage container packing assembly 2400 of FIG. 24, but viewed from a bottom side. In the example shown, a beverage container packing assembly 2500 may include a bottom tray 2502 (e.g., bottom element), a top tray 2504 (e.g., a top element), a center support 2506 (e.g., center support element, partition element), transport thermo packs 2508, 2510, and/or other components. The top tray 2504 may include thermo pack accommodating spaces 2512, 2514. For example, the top tray may include a first thermo pack accommodating space 2512 (e.g., a first top tray thermo pack accommodating space) to accommodate a first thermo pack 2508 and second thermo pack accommodating space 2514 (e.g., a first top tray thermo pack accommodating space) to accommodate a second thermo pack 2510. The thermo pack accommodating spaces 2512, 2514 may be sized to accommodate thermo packs 2508, 2510 in the same tray with beverage containers. The thermo pack accommodating spaces 2512, 2514 may be sized and positioned to place the thermo packs 2508, 2510 in contact with at least one beverage containers, multiple beverage containers, and/or all beverage containers in the beverage container packing assembly. The thermo pack accommodating spaces 2512, 2514 may be sized to match geometry of the thermo packs 2508, 2510. For example, the thermo pack accommodating spaces 2512, 2514 may be sized to hold the thermo packs 2508, 2510 in a stationary and/or a substantially stationary position during transit of the beverage container packing assembly. The thermo pack accommodating spaces 2512, 2514 may be sized to hold the thermo packs 2508, 2510 in an interference fit, fixed fit, press fit, and/or other form of temporary fastening. The thermo pack accommodating spaces 2512, 2514 may be sized so that the thermo pack is temporarily fastened to the top tray 2504.

In some embodiments, the thermo pack accommodating spaces 2512, 2514 in the top tray 2504 may correspond to thermo pack accommodating spaces in the center support (e.g., thermo pack accommodating spaces 2412, 2414). The thermo pack accommodating spaces 2512, 2514 in the top tray may correspond in size, relative location, orientation, and/or other features with the thermo pack accommodating spaces in the center support. The thermo pack accommodating spaces 2512, 2514 in the top tray may function in conjunction with the thermo pack accommodating spaces in the center tray 2506 to orient transport thermo packs in a desired configuration.

Figure 26:
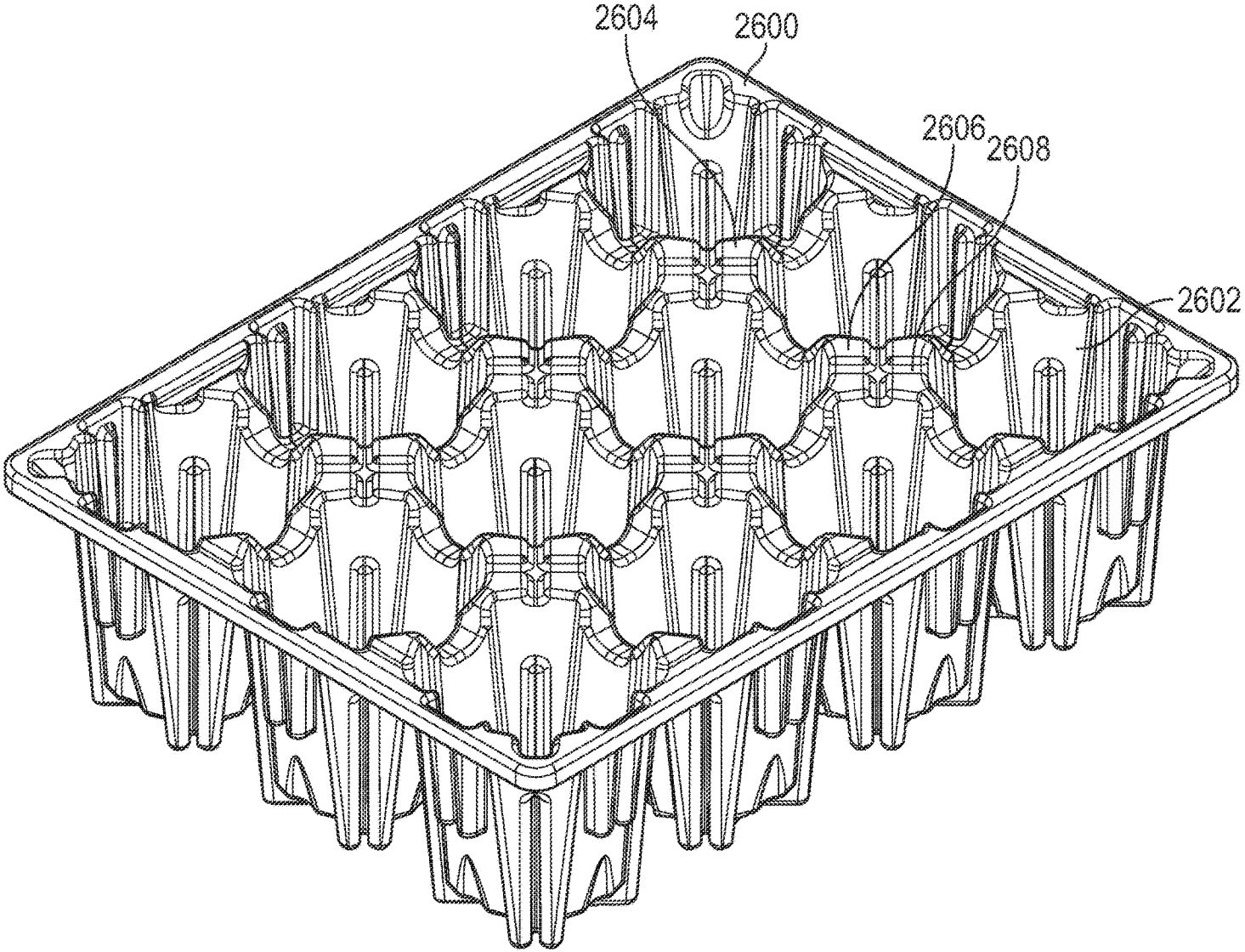
FIG. 26 depicts a bottom tray of a beverage container packaging assembly according to some embodiments.

FIG. 26 depicts a bottom tray of a beverage container packaging assembly according to some embodiments. The bottom tray 2600 of FIG. 26 may be similar to the bottom tray 200 of FIG. 2. As shown, the bottom tray 2600 includes a plurality of first compartments 2602. The number of first compartments 2602 corresponds to a number of beverage containers the bottom tray 2600 is configured to accommodate. In the example shown, the bottom tray 2600 includes twelve first compartments 2602—three rows of four first compartments 2602 or four columns of three first compartments 2602. The bottom tray 2600 shown is configured to accommodate twelve (12) beverage containers. FIG. 26 depicts one example configuration of first compartments. Aspects of this disclosure, however, are in no way limited to the depicted configuration or number of first compartments 2602. In other instances, a bottom tray (and associated beverage container packaging) be configured to accommodate six beverage containers (three rows of two beverage containers), nine beverage containers (three rows of three containers), 15 containers (five rows of three containers), 16 containers (four rows of four containers), and so on.

In certain cases, the bottom tray 2600 includes one or more first support columns 2604 configured to support the center support (not shown). Each of the first support columns 2604 (six in the example shown) may include a plurality of platforms 2606 (e.g., deformable post elements, protrusions, etc.) that form flat surfaces to contact the center support. The platforms 2606 may be arranged in sets to resemble a cross-shape or X-shape. The platforms 2606 may also be deformable and/or flexible to absorb load applied to the bottom tray 2600, thereby reducing any load applied to the beverage containers. The platforms 2606 may be separated by a depressed portion, such as the cross-shaped or X-shaped depressed portion 2608.

Figure 27:
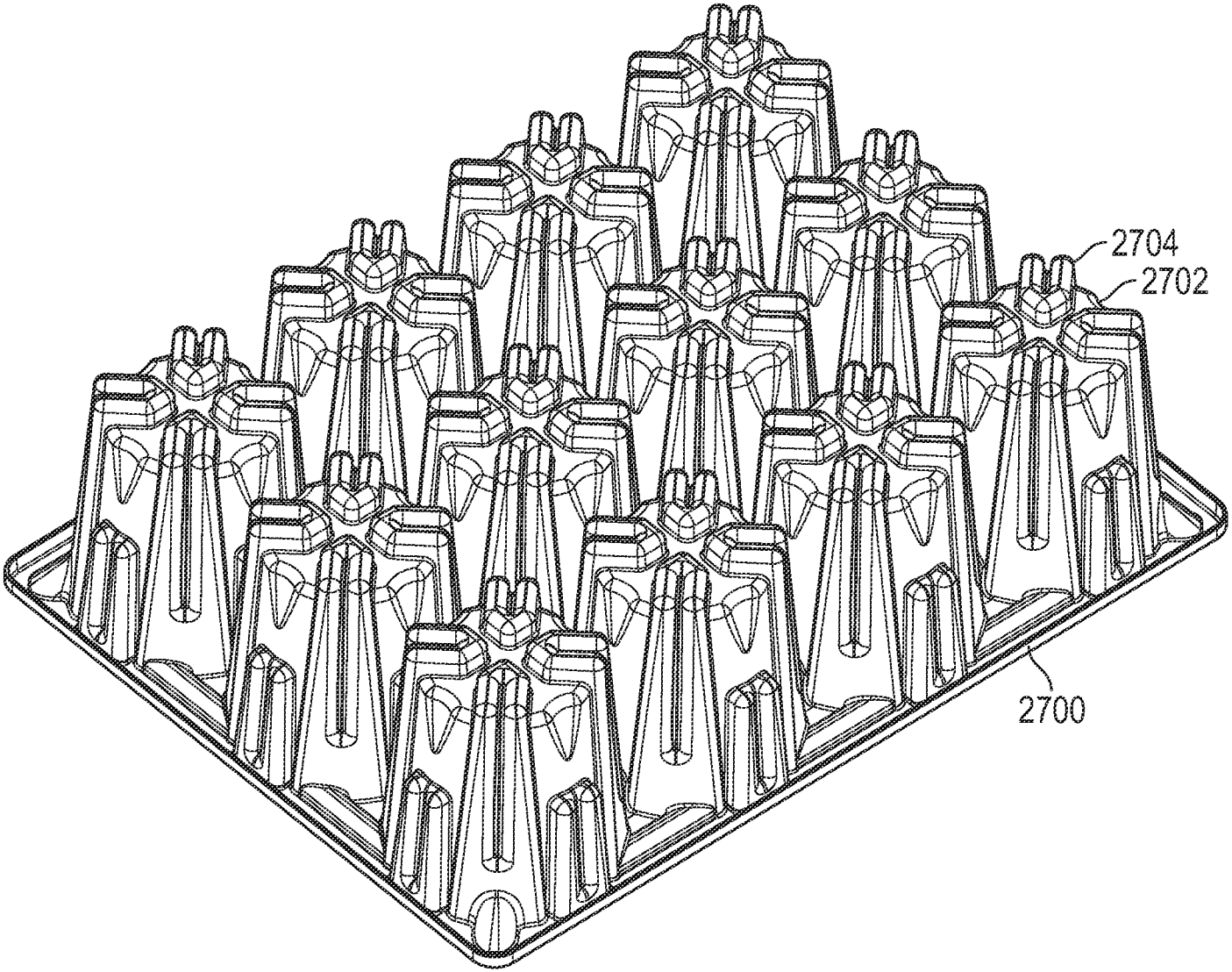
FIG. 27 depicts a second view of a bottom tray according to various embodiments.

FIG. 27 depicts a second view of a bottom tray according to various embodiments. In the example shown, which may include an opposite side of the bottom tray from FIG. 26, a bottom tray 2700 includes multiple first compartments 2702. The bottom side of the bottom tray 2700 includes pulp paper. The bottom side of the first compartments 2702 may include protrusions 2704 (e.g., four protrusions in the example shown) extending from the bottom of the first compartments 2702 up each side. The protrusions 2704 may absorb impact and reduce loads applied to the beverage containers during, for example, an impact event.

Figure 28:
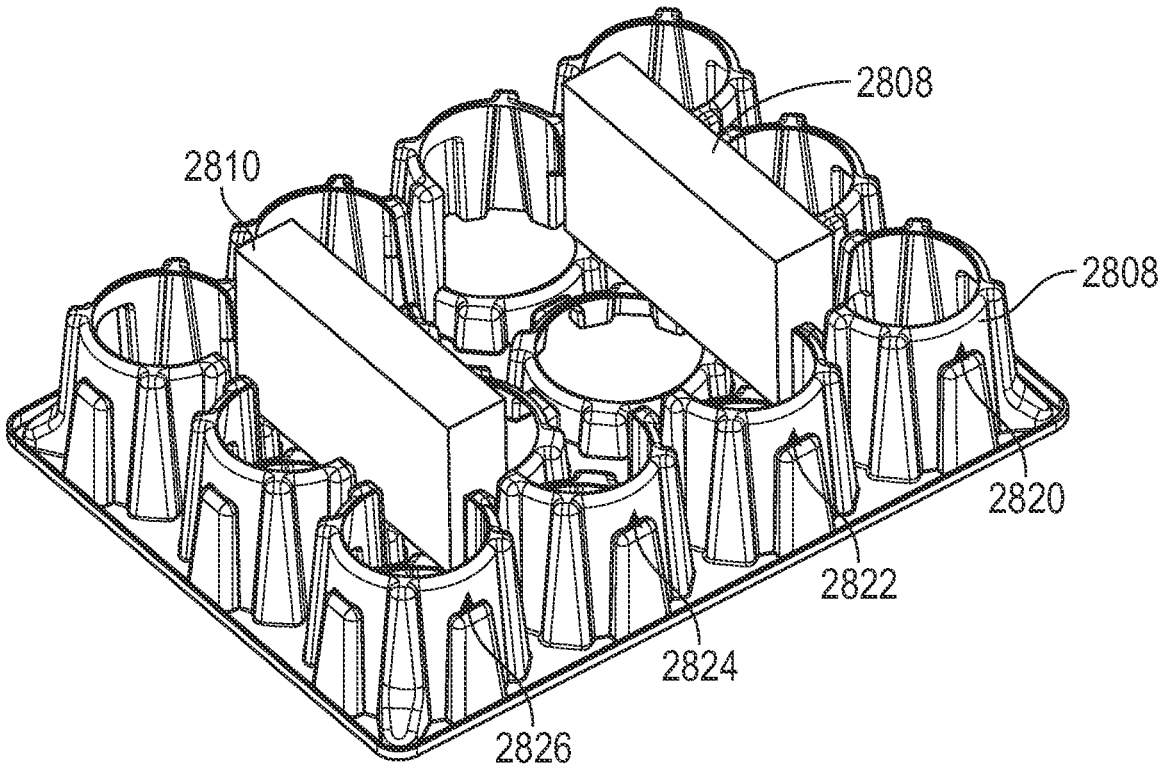
FIG. 28 depicts a center support with two transport thermo packs disposed in the center support according to various embodiments.

FIG. 28 depicts a center support with two transport thermo packs disposed in the center support according to various embodiments. In the example shown, a center support 2800 is configured to house twelve beverage containers (not shown) are arranged in four rows of three beverage containers. The center support 2800 is configured to accommodate transport thermo packs 2808, 2810. A transport thermo pack 2808 may be installed between a first row 2820 of beverage containers (e.g., through holes) and a second row 2822 of beverage containers such that the transport thermo pack 2808 extends linearly between a plurality of beverage containers of the first row 2820 and a plurality of beverage containers of the second row 2822. A transport thermo pack 2810 may be installed between the third row 2824 of beverage containers and a fourth row 2826 of beverage containers such that the transport thermo pack 2810 extends linearly between a plurality of beverage containers of the third row 2824 and a plurality of beverage containers of the fourth row 2826.

As described herein, the transport thermo packs 2808, 2810 can be heating packs or cooling packs, so that the transport packs 2808, 2810 can heat or cool the beverage containers. The ability to heat or cool the beverage containers enables the assembly to be used to transport temperature-sensitive beverages. The transport thermo pack may directly contact the beverage containers to facilitate the transfer of energy between the transport thermo pack and the beverage containers. The transport thermo packs 2808, 2810 may directly contact at least a portion of the beverage containers to facilitate the transfer of energy between the transport thermo pack and the beverage containers. In some cases, the transport thermo packs 2808, 2810 may directly contact at least a portion of each beverage container (e.g., all twelve beverage containers housed in the center support 2800).

As described in detail herein, transport thermo packs 2808, 2810 may be contoured based on the packaging geometry, beverage containers, and/or other elements. Transport thermo packs 2808, 2810 may be shaped to accommodate the outer contour of a beverage container. The transport thermo packs 2808, 2810 may be shaped to contact a portion of the surface of the beverage containers. For example, the width, height, and/or thickness of the transport thermo pack may be designed to accommodate the shape of a beverage container.

In some embodiments, transport thermo packs 2808, 2810 are shaped to encapsulate at least a portion of the beverage containers. Transport thermo packs 2808, 2810 may, for example, fully encapsulate a single beverage container, a set of beverage containers, or all beverage containers in a package. A package may include multiple transport thermo packs 2808, 2810 each including different shapes. The shapes of each of the one or more transport thermo packs 2808, 2810 may be configured to accommodate the shapes of the beverage containers in the package.

Figure 29:
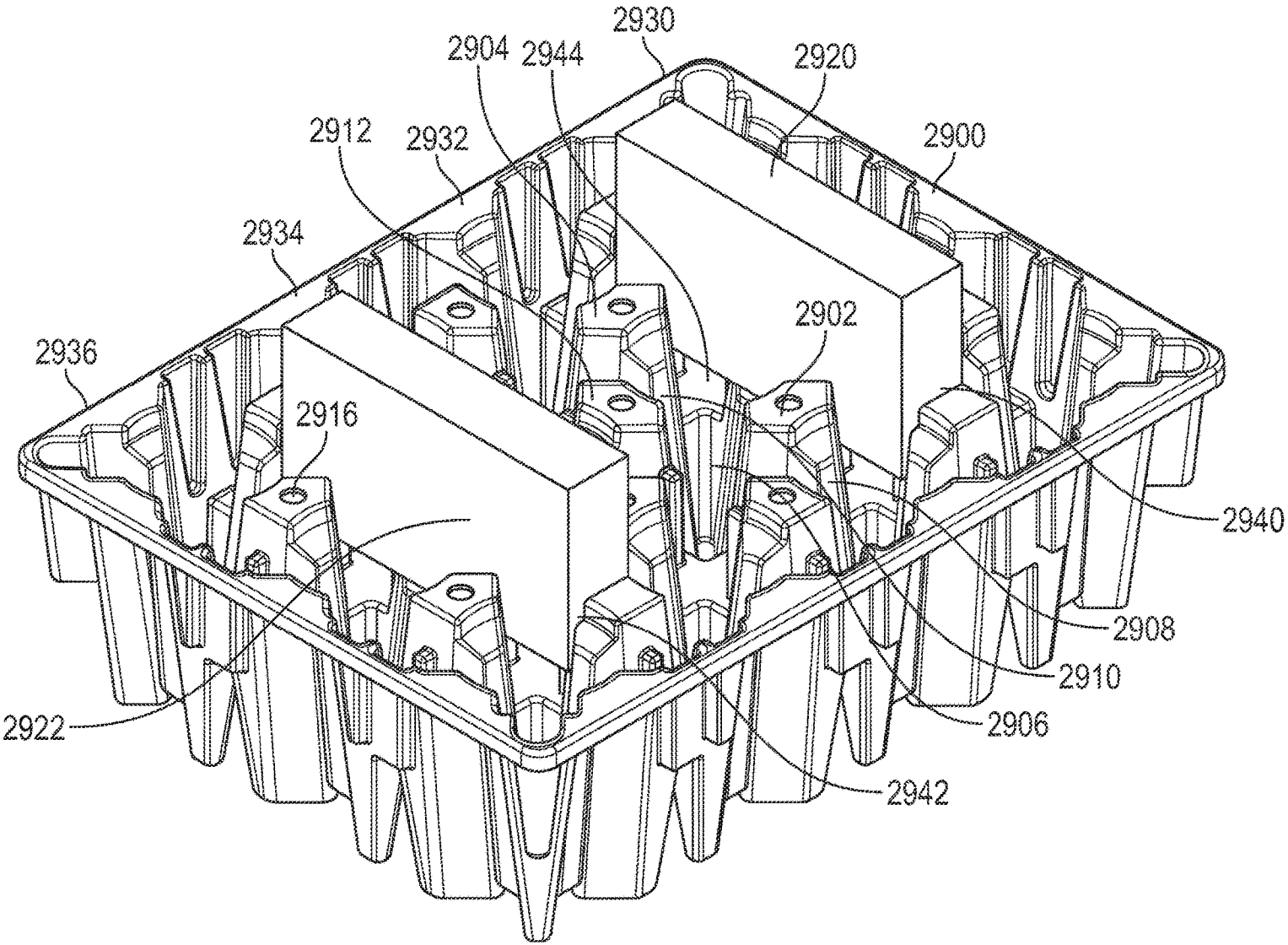
FIG. 29 depicts a top tray with two transport thermo packs disposed in the top tray according to various embodiments.

FIG. 29 depicts a top tray with two transport thermo packs disposed in the top tray according to various embodiments. In the example shown, the top tray 2900 includes multiple vertical posts 2902, 2904 that form second compartments 2906 (e.g., beverage container neck accommodating spaces). For example, the vertical posts 2902, 2904 may include deformable elements 2908, 2910 that contact the neck of a beverage container and hold it in place during shipping. The deformable elements 2908, 2910 may also deform to absorb lateral loads applied to a bottle during transit. In some cases, the vertical posts 2902, 2904 may include trapezoidal deformable elements 2912 (e.g., protrusions) on a top of the vertical post 2902, 2904. The trapezoidal elements 2912 may contact portions of the center support.

In some embodiments, the top tray 2900 includes one or more holes 2916. Similar to the holes discussed with respect to other components of bottle packing assembly, the holes 2916 reduce vacuum generated when the top tray is placed into a box.

In the example shown, a top tray 2900 is configured to house twelve beverage containers (not shown) are arranged in four rows of three beverage containers. The top tray 2900 is configured to accommodate transport thermo packs 2920, 2922. A transport thermo pack 2920 may be installed between a first row 2930 of beverage container neck accommodating spaces and a second row 2932 of beverage container neck accommodating spaces. The transport thermo pack 2920 extends linearly between a plurality of beverage containers (e.g., necks of beverage containers) of the first row 2930 and a plurality of beverage containers of the second row 2932. A transport thermo pack 2922 may be installed between the third row 2934 of beverage containers and a fourth row 2936 of beverage containers such that the transport thermo pack 2922 extends linearly between a plurality of beverage containers of the third row 2934 and a plurality of beverage containers of the fourth row 2936.

In various embodiments, the top tray 2900 includes thermo pack accommodating spaces 2940, 2942. In the example shown, the top tray 2900 includes a first thermo pack accommodating space 2940 (e.g., a first top tray thermo pack accommodating space) to accommodate a first thermo pack 2920 and second thermo pack accommodating space 2942 (e.g., a first top tray thermo pack accommodating space) to accommodate a second thermo pack 2922. In certain cases, the thermo pack accommodating spaces 2940, 2942 may be formed by removing vertical posts (as compared to, for example, the top tray 1500 of FIG. 15). Removing at least one vertical post creates space in the top tray 2900 to accommodate installation of the thermo packs 2920, 2922 in the top tray 2900. The thermo pack accommodating spaces 2940, 2942 may include a surface 2944 upon which the thermo packs 2920, 2922 contact the top tray 2900. The thermo packs 2920, 2922 are also surrounded by and in contact with vertical posts 2902, 2904 in the top tray 2900. The vertical posts 2902, 2904 hold the transport thermo pack in place. In the example shown, six vertical posts contact each thermo pack 2920, 2922.

In various embodiments, the thermo pack accommodating spaces 2940, 2942 may be sized to accommodate thermo packs 2920, 2922 in the same tray with beverage containers. The thermo pack accommodating spaces 2940, 2942 may be sized and positioned to place the thermo packs 2920, 2922 in contact with at least one beverage containers, multiple beverage containers, and/or all beverage containers in the beverage container packing assembly. The thermo pack accommodating spaces 2940, 2942 may be sized to match geometry of the thermo packs 2920, 2922. For example, the thermo pack accommodating spaces 2940, 2942 may be sized to hold the thermo packs 2920, 2922 in a stationary and/or a substantially stationary position during transit of the beverage container packing assembly. The thermo pack accommodating spaces 2940, 2942 may be sized to house the thermo packs 2920, 2922 in an interference fit, press fit, press fit, and/or other form of temporary fastening. The thermo pack accommodating spaces 2940, 2942 may be sized so that the thermo pack is temporarily fastened to the top tray 2900.

Figure 30:
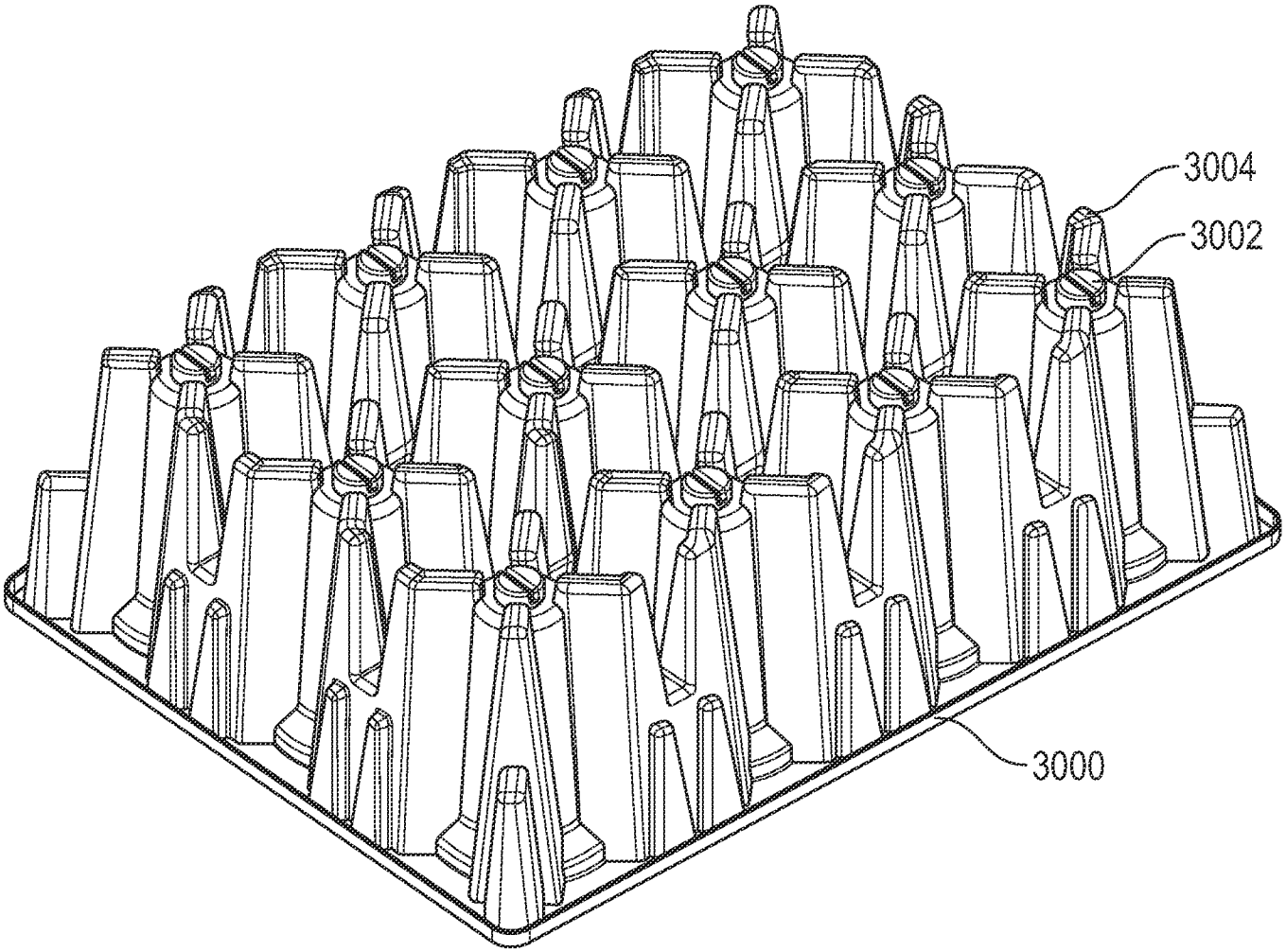
FIG. 30 a top tray in an upright orientation according to various embodiments.

FIG. 30 a top tray in an upright orientation according to various embodiments. In the example shown, the top tray 3000 includes the structure underlying the second compartments 3002. The top side (on assembly) of the top tray 3000 includes pulp paper. The top side of the second compartments 3002 may include cross-shaped protrusions 3004 (e.g., four protrusions meeting at a point in the example shown). The cross-shaped protrusions 3004 may absorb impact and reduce loads applied to the beverage containers during, for example, an impact event.

Figure 31:
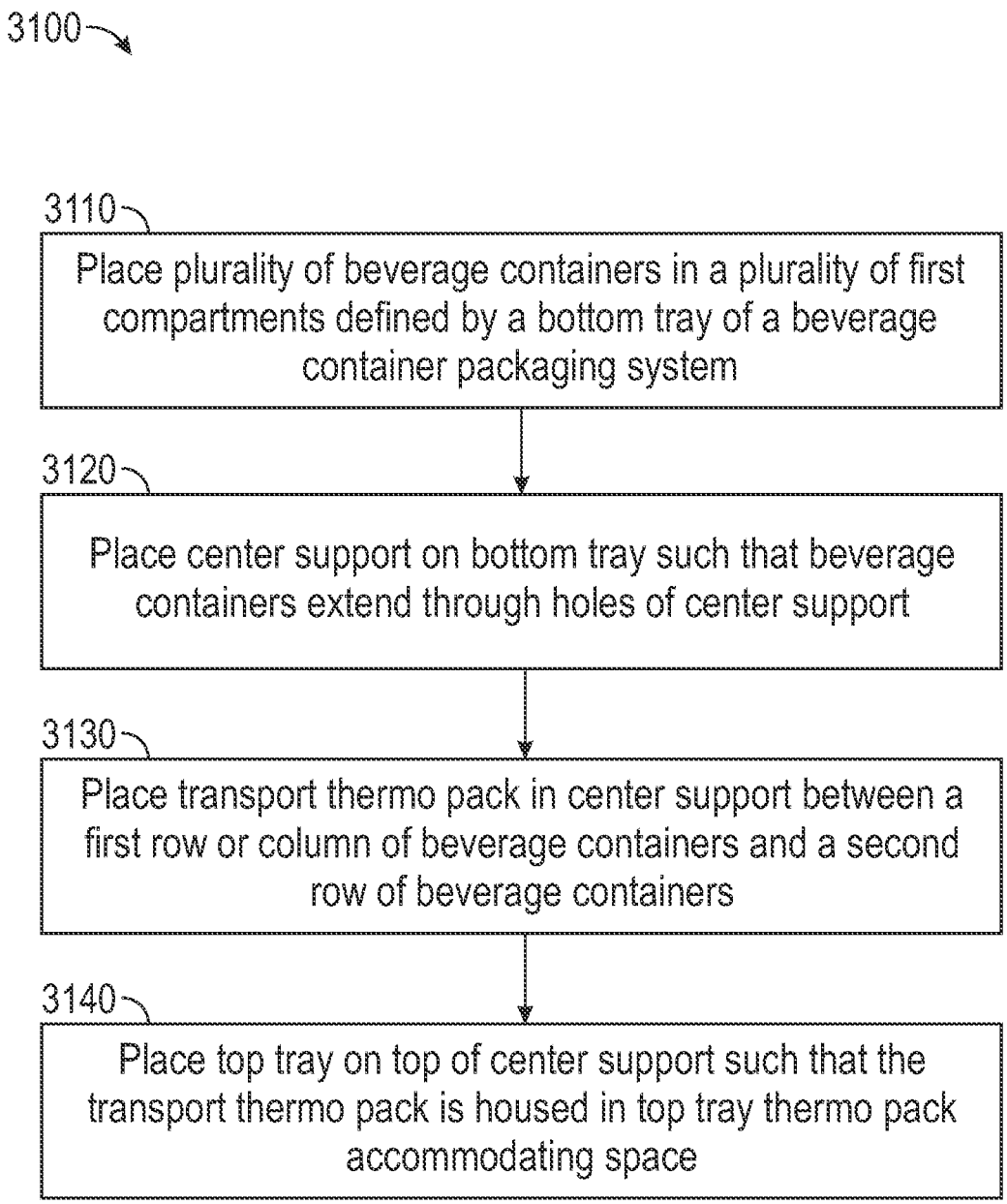
FIG. 31 is a flowchart depicting a method of packing beverage containers according to various embodiments.

FIG. 31 is a flowchart depicting a method of packing beverage containers according to various embodiments. In the example shown, a method 3100 of packing beverage containers. The method 3100 includes placing (3110) a plurality of beverage containers in a plurality of first compartments defined by a bottom tray of a beverage container packing assembly. The bottom tray may be placed in a shipping container, such as a cardboard box. The beverage containers are disposed in the bottom tray in shipping container, as depicted for example in FIG. 21.

In various embodiments, a box liner is placed in the shipping container. The box liner may include insulating material. In certain cases, the box liner may be, for example, placed in the shipping container before the bottom tray, center support, top tray, or beverage containers. The box liner may resemble and/or follow the contour of the inner surface of the shipping container. In certain cases, the box liner and shipping container may resemble a box within a box. With the box liner in place, for example along the inside of the shipping container, the bottom tray and beverage containers may then be placed in the beverage container package. In some cases, the box liner may be added to the shipping container after the bottom tray, center support, top tray, and beverage containers. The box liner may in conjunction with for example, the thermo transport packs may increase the R value of the cooling time range for the beverage container packaging.

The method includes placing (3120) placing a center support on the bottom tray such that the beverage containers extend through holes of the center support. The center support may rest on and/or contact the bottom tray upon installation. The center support may also contact and/or surround one or more of the beverage containers. For example, the center support may include through holes corresponding to the compartments in the bottom tray and/or corresponding to the beverage containers so that one or more of the beverage containers pass through holes in the center support. FIGS. 12 and 13 depicts a bottom tray holding a plurality of beverage containers and center support resting on the bottom tray.

The method further includes placing (3130) transport thermo packs into the center support between rows and/or columns of beverage containers. For example, a transport thermo pack may be placed between a first row and a second row of the plurality of beverage containers such that the transport thermo pack extends linearly between a plurality of beverage containers of the first row and a plurality of beverage containers of the second row, and rests upon and/or is supported by the center support of the beverage container packing assembly. FIG. 28 depicts a center support 2800 with thermo pack 2808 placed between a first row 2820 and second row 2822 of the plurality of beverage containers. A thermo pack 2810 is placed between a third row 2824 and fourth row 2826 of the plurality of beverage containers.

The method 3100 includes placing (3140) a top tray of the beverage container packing assembly on top of the center support such that the transport thermo packs are housed in the transport thermo pack accommodating spaces. For example, FIG. 24 depicts a top tray 2404 placed on top of the center support 2406 support. The transport thermo packs 2408, 2410 are housed thermo pack accommodating spaces in the top tray 2404. For example, FIG. 29 depicts a top tray 2900 with thermo packs 2920, 2922 housed in thermo pack accommodating spaces 2940, 2942. The transport thermo packs 2920, 2922 may be housed between vertical posts 2902, 2904.

The method 3100 may also include, prior to placing the plurality of beverage containers in the plurality of first compartments defined by the bottom tray, placing the bottom tray in a shipping container such as a cardboard box, crate, and/or other container. The beverage containers, center support, and top tray may be subsequently placed in the shipping container. According to various embodiments, each of the bottom tray, the center support, and the top tray extend to an inner surface of the shipping container.

Further aspects of the present disclosure are provided by the subject matter of the following clauses.

According to one aspect, a beverage container packing assembly includes a bottom tray, having one or more first support columns and defining a group of first compartments. Each of the first compartments are configured to receive a first portion of a beverage container therein. The beverage container packing assembly further includes a center support, defining a group of through holes and configured to receive a second portion of a beverage container therethrough. The center support includes one or more second support columns each configured to stack on one of the first support columns. The beverage container packing assembly further includes a top tray, defining a group of second compartments. Each of the second compartments are configured to receive a third portion of a beverage container therein. The center support is configured to accommodate a thermo pack between a first row of the plurality of through holes and a second row of the plurality of through holes.

The beverage container packing assembly of the preceding clause, such that the center support is further configured to accommodate the thermo pack installed in one of a first configuration and a second configuration, the first configuration including installing the thermo pack between the first row and second row and the second configuration including installing the thermo pack between a first column of through holes and a second column of through holes.

The beverage container packing assembly of any preceding clause, such that the rows and columns include different numbers of through holes.

The beverage container packing assembly of any preceding clause, such that the center support includes a group of second support columns, and a total number of second support columns is less than a total number of the first support columns.

The beverage container packing assembly of any preceding clause, such that the second support columns include diamond-shaped elements and star point elements that extend away from the center of the second support columns.

The beverage container packing assembly of any preceding clause, such that the top tray includes a group of third support columns, and a total number of the second support columns is less than a total number of the third support columns.

The beverage container packing assembly of any preceding clause, such that each of the bottom tray, the center support, and the top tray are configured to be disposed in a shipping container.

The beverage container packing assembly of any preceding clause, such that each of the bottom tray, the center support, and the top tray extend to an inner surface of the shipping container.

The beverage container packing assembly of any preceding clause, such that the bottom tray, the center support, and the top tray include molded paper pulp.

The beverage container packing assembly of any preceding clause, such that the bottom tray, the center support, and the top tray further include a water-resistant coating.

The beverage container packing assembly of any preceding clause, such that at least one of the first support columns and the second support columns are hollow.

The beverage container packing assembly of any preceding clause, such that the second support columns have an inverted shape with respect to a shape of the one or more first support columns.

The beverage container packing assembly of any preceding clause, such that the center support defines a through hole corresponding to each of the group of first compartments.

According to another aspect, a beverage container packing assembly center support includes a support body defining a group of through holes that are each configured to receive a portion of a beverage container therethrough. The support body includes one or more support columns that are configured to stack on a corresponding support column of a bottom tray of a beverage container packing assembly. The beverage container packing assembly center support is configured to accommodate a thermo pack between a first row of a group of beverage containers and a second row of a group of beverage containers such that the thermo pack extends linearly between the group of beverage containers of the first row and the group of beverage containers of the second row.

The beverage container packing assembly center support of the preceding clause, being further configured to accommodate the thermo pack installed in one of a first configuration and a second configuration. The first configuration includes installing the thermo pack between the first row and second row and the second configuration includes installing the thermo pack between a first column of beverage containers and a second column of beverage containers.

The beverage container packing assembly center support of any preceding clause, further including a surface to accommodate installation of the thermo pack.

The beverage container packing assembly center support of any preceding clause, such that the support body is further configured to be disposed in a shipping container.

The beverage container packing assembly center support of any preceding clause, such that the support body extends to an inner surface of the shipping container.

The beverage container packing assembly center support of any preceding clause, such that the beverage container packing assembly center support comprises molded paper pulp.

According to another aspect, a method of packing beverage containers includes placing a group of beverage containers in a group of first compartments defined by a bottom tray of a beverage container packing assembly, placing a center support of the beverage container packing assembly on top of the bottom tray such that the beverage containers extend through a group of through holes defined by the center support, placing a thermo pack between a first row and a second row of the group of beverage containers such that the thermo pack extends linearly between a group of beverage containers of the first row and a group of beverage containers of the second row, such that the thermo pack is supported by the center support of the beverage container packing assembly, and placing a top tray of the beverage container packing assembly on top of the center support such that the beverage containers extend into a group of second compartments defined by the top tray.

While various embodiments have been described above, it should be understood that they have been presented by way of example only, and not limitation. Thus, the breadth and scope of the disclosure should not be limited by any of the above-described illustrative embodiments but should instead be defined only in accordance with the following claims and their equivalents.

The invention claimed is:

1. A method of packing beverage containers, comprising:

placing a plurality of beverage containers in a plurality of first compartments defined by a bottom tray of a beverage container packing assembly;

placing a center support of the beverage container packing assembly on top of the bottom tray such that the plurality of beverage containers extend through a plurality of through holes defined by the center support;

placing a thermo pack between a first row and a second row of the plurality of beverage containers such that the thermo pack extends between a plurality of beverage containers of the first row and a plurality of beverage containers of the second row, and is supported by the center support of the beverage container packing assembly; and placing a top tray of the beverage container packing assembly on top of the center support such that the thermo pack is installed in a thermo pack accommodating space in the top tray.

2. The method of claim 1, wherein the thermo pack accommodating space is bound by a plurality of vertical posts.

3. The method of claim 2, wherein the plurality of vertical posts are configured to contact the thermo pack.

4. The method of claim 2, wherein the plurality of vertical posts comprise a boundary of the thermo pack accommodating space.

5. The method of claim 1, wherein the thermo pack is installed in the thermo pack accommodating space in one or more of an interference fit, a fixed fit, a press fit, and temporary fastening.

6. The method of claim 1, wherein the top tray comprises a surface to accommodate the thermo pack.

7. The method of claim 1, wherein the thermo pack accommodating space is configured to house the thermo pack between a first row of second compartments and a second row of the second compartments.

8. The method of claim 1, further comprising placing the bottom tray, the center support, and the top tray of the beverage container packing assembly in a shipping container.

9. The method of claim 8, wherein one or more of the bottom tray, the center support, and the top tray extend to an inner surface of the shipping container.

10. The method of claim 1, wherein one or more of the bottom tray, the center support, and the top tray comprise molded paper pulp.

11. The method of claim 1, wherein one or more of the bottom tray, the center support, and the top tray comprise a water-resistant coating.

12. The method of claim 1, wherein the center support defines a through hole corresponding to each of said plurality of first compartments.

* * * * *